US009604339B2

(12) United States Patent
Duescher et al.

(10) Patent No.: US 9,604,339 B2
(45) Date of Patent: Mar. 28, 2017

(54) VACUUM-GROOVED MEMBRANE WAFER POLISHING WORKHOLDER

(71) Applicants: Wayne O. Duescher, Roseville, MN (US); Cameron M. Duescher, Maplewood, MN (US)

(72) Inventors: Wayne O. Duescher, Roseville, MN (US); Cameron M. Duescher, Maplewood, MN (US)

( * ) Notice: Subject to any disclaimer, the term of this patent is extended or adjusted under 35 U.S.C. 154(b) by 0 days.

(21) Appl. No.: 14/980,172

(22) Filed: Dec. 28, 2015

(65) Prior Publication Data

US 2016/0129547 A1 May 12, 2016

Related U.S. Application Data

(63) Continuation-in-part of application No. 14/474,157, filed on Aug. 31, 2014, now Pat. No. 9,233,452, (Continued)

(51) Int. Cl.
*B24B 37/20* (2012.01)
*B24B 37/04* (2012.01)
*B24B 37/30* (2012.01)

(52) U.S. Cl.
CPC ..... *B24B 37/20* (2013.01); *B24B 37/042* (2013.01); *B24B 37/30* (2013.01)

(58) Field of Classification Search
CPC ..... B24B 37/30; B24B 37/042; B24B 37/345; B24B 49/16; B24B 13/00; B25B 11/005; H01L 21/304; H01L 21/6838
(Continued)

(56) References Cited

U.S. PATENT DOCUMENTS 4,593,495 A 6/1986 Kawakami et al.
4,918,870 A 4/1990 Torbert et al.
(Continued)

OTHER PUBLICATIONS

Wayne O. Duescher, Three-point spindle-supported floating abrasive platen, U.S. Appl. No. 12/661,212, filed Mar. 12, 2010. Earliest Publication No. US 20110223835 A1 Earliest Publication Date: Sep. 15, 2011. U.S. Pat. No. 8,740,668 granted Jun. 3, 2014.
(Continued)

*Primary Examiner* — George Nguyen
(74) *Attorney, Agent, or Firm* — Mark A. Litman & Associates, P.A.

(57) ABSTRACT

Hard-material, flat-surfaced workpieces such as semiconductor wafers or sapphire disks are attached with vacuum to the flexible elastomeric membrane of a rotatable wafer carrier that allows one surface of the workpiece to be in conformal abrading contact with a moving flat-surfaced abrasive. The elastomeric membrane external wafer attachment surface has a pattern of recessed vacuum grooves where vacuum supplied to the grooves firmly attach the rigid-material silicon wafer in flat-surfaced contact with the membrane. The attached wafer seals the vacuum grooves. A flexible thin metal annular membrane support disk is attached to the membrane within an abrading-pressure chamber where attached drive pins engage matching holes in the wafer carrier provide rotational torque to the wafer and restrain it laterally against abrading forces. Wafer polishing pressure is applied uniformly over the wafer surface. The rotating wafer peripheral edge does not contact a rigid retaining ring during a wafer polishing procedure.

22 Claims, 14 Drawing Sheets

Related U.S. Application Data which is a continuation-in-part of application No. 14/329,967, filed on Jul. 13, 2014, now Pat. No. 9,199,354, which is a continuation-in-part of application No. 14/185,882, filed on Feb. 20, 2014, now Pat. No. 9,011,207, which is a continuation-in-part of application No. 14/154,133, filed on Jan. 13, 2014, now Pat. No. 9,039,488, which is a continuation-in-part of application No. 14/148,729, filed on Jan. 7, 2014, now Pat. No. 8,998,678, which is a continuation-in-part of application No. 13/869,198, filed on Apr. 24, 2013, now Pat. No. 8,998,677, which is a continuation-in-part of application No. 13/662,863, filed on Oct. 29, 2012, now Pat. No. 8,845,394.

(58) Field of Classification Search
USPC ..... 451/41
See application file for complete search history.

(56) References Cited

U.S. PATENT DOCUMENTS 5,205,082 A 4/1993 Shendon et al.
5,329,732 A 7/1994 Karlsrud et al.
5,335,453 A 8/1994 Baldy et al.
5,364,655 A 11/1994 Nakamura et al.
5,421,768 A 6/1995 Fujiwara et al.
5,423,716 A 6/1995 Strasbaugh
5,443,416 A 8/1995 Volodarsky et al.
5,449,316 A 9/1995 Strasbaugh
5,569,062 A 10/1996 Karlsrud et al.
5,597,346 A 1/1997 Hempel, Jr.
5,643,053 A 7/1997 Shendon
5,643,067 A 7/1997 Katsuoka et al.
5,683,289 A 11/1997 Hempel, Jr.
5,738,574 A 4/1998 Tolles et al.
5,769,697 A 6/1998 Nishio
5,800,254 A 9/1998 Motley et al.
5,874,318 A 2/1999 Baker et al.
5,910,041 A 6/1999 Duescher
5,916,009 A 6/1999 Izumi et al.
5,944,583 A 8/1999 Cruz et al.
5,961,169 A 10/1999 Kalenian et al.
5,964,651 A 10/1999 Hose
5,964,653 A 10/1999 Pertlov et al.
5,967,882 A 10/1999 Duescher
5,975,997 A 11/1999 Minami
5,985,093 A 11/1999 Chen
5,989,104 A 11/1999 Kim et al.
5,993,298 A 11/1999 Duescher
5,993,302 A 11/1999 Chen et al.
6,024,630 A 2/2000 Shendon et al.
6,027,398 A 2/2000 Numoto et al.
6,048,254 A 4/2000 Duescher
6,050,882 A 4/2000 Chen
6,056,632 A 5/2000 Mitchel et al.
6,074,277 A 6/2000 Arai
6,080,050 A 6/2000 Chen et al.
6,089,959 A 7/2000 Nagahashi
6,102,777 A 8/2000 Duescher et al.
6,116,993 A 9/2000 Tanaka
6,120,352 A 9/2000 Duescher
6,126,993 A 10/2000 Orcel et al.
6,132,298 A 10/2000 Zuniga et al.
6,146,259 A 11/2000 Zuniga et al.
6,149,506 A 11/2000 Duescher
6,159,073 A 12/2000 Wiswesser et al.
6,162,116 A 12/2000 Zuniga et al.
6,165,056 A 12/2000 Hayashi et al.
6,168,506 B1 1/2001 McJunken
6,179,956 B1 1/2001 Nagahara et al.
6,183,354 B1 2/2001 Zuniga et al.
6,217,433 B1 4/2001 Herrman et al.
6,224,472 B1 5/2001 Lai et al.
6,251,215 B1 6/2001 Zuniga et al.
6,270,392 B1 8/2001 Hayashi et al.
6,299,741 B1 10/2001 Sun et al.
6,361,420 B1 3/2002 Zuniga et al.
6,371,838 B1 4/2002 Holzapfel
6,390,901 B1 5/2002 Hiyama et al.
6,390,905 B1 5/2002 Korovin et al.
6,394,882 B1 5/2002 Chen
6,398,906 B1 6/2002 Kobayashi et al.
6,425,809 B1 7/2002 Ichimura
6,436,828 B1 8/2002 Chen et al.
6,439,965 B1 8/2002 Ichino
6,439,978 B1 8/2002 Jones et al.
6,443,821 B1 9/2002 Kimura et al.
6,447,368 B1 9/2002 Fruitman et al.
6,491,570 B1 12/2002 Sommer et al.
6,506,105 B1 1/2003 Kajiwara et al.
6,558,232 B1 5/2003 Kajiwara et al.
6,585,567 B1 7/2003 Black et al.
6,592,434 B1 7/2003 Vanell et al.
6,592,439 B1 7/2003 Li et al.
6,607,157 B1 8/2003 Duescher
6,659,850 B2 12/2003 Korovin et al.
6,663,466 B2 12/2003 Chen et al.
6,672,949 B2 1/2004 Chopra et al.
6,729,944 B2 5/2004 Birang et al.
6,752,700 B2 6/2004 Duescher
6,769,969 B1 8/2004 Duescher
6,837,779 B2 1/2005 Smith et al.
6,893,332 B2 5/2005 Castor
6,896,584 B2 5/2005 Perlov et al.
6,899,603 B2 5/2005 Homma et al.
6,899,607 B2 5/2005 Brown
6,899,609 B2 5/2005 Hong
6,908,366 B2 6/2005 Gagliardi
6,935,013 B1 8/2005 Markevitch et al.
7,001,251 B2 2/2006 Doan et al.
7,001,257 B2 2/2006 Chen et al.
7,008,295 B2 3/2006 Wiswesser et al.
7,008,303 B2 3/2006 White et al.
7,014,535 B2 3/2006 Custer et al.
7,018,275 B2 3/2006 Zuniga et al.
7,018,906 B2 3/2006 Chen et al.
7,029,380 B2 4/2006 Horiguchi et al.
7,033,251 B2 4/2006 Elledge
7,044,838 B2 5/2006 Maloney et al.
7,081,042 B2 7/2006 Chen et al.
7,086,929 B2 8/2006 Wiswesser et al.
7,101,272 B2 9/2006 Chen et al.
7,101,273 B2 9/2006 Tseng et al.
7,125,313 B2 10/2006 Zelenski et al.
7,144,304 B2 12/2006 Moore
7,147,541 B2 12/2006 Nagayama et al.
7,166,016 B1 1/2007 Chen
7,250,368 B2 7/2007 Kida et al.
7,276,446 B2 10/2007 Robinson et al.
7,292,427 B1 11/2007 Murdoch et al.
7,357,699 B2 4/2008 Togawa et al.
7,367,867 B2 5/2008 Boller
7,393,790 B2 7/2008 Britt et al.
7,419,910 B2 9/2008 Minamihaba et al.
7,422,634 B2 9/2008 Powell et al.
7,445,847 B2 11/2008 Kulp
7,446,018 B2 11/2008 Brogan et al.
7,452,817 B2 11/2008 Yoon et al.
7,456,106 B2 11/2008 Koyata et al.
7,456,107 B2 11/2008 Keleher et al.
7,470,169 B2 12/2008 Taniguchi et al.
7,485,028 B2 2/2009 Wilkinson et al.
7,485,241 B2 2/2009 Schroeder et al.
7,488,235 B2 2/2009 Park et al.
7,488,236 B2 2/2009 Shimomura et al.
7,488,240 B2 2/2009 Saito
7,491,116 B2 2/2009 Sung
7,491,342 B2 2/2009 Kamiyama et al.
7,507,148 B2 3/2009 Kitahashi et al.
7,510,974 B2 3/2009 Li et al.
7,520,798 B2 4/2009 Muldowney et al.
7,520,800 B2 4/2009 Duescher

(56) References Cited

U.S. PATENT DOCUMENTS

| | | | |
|---|---|---|---|
| 7,527,271 | B2 | 5/2009 | Oh et al. |
| 7,527,722 | B2 | 5/2009 | Sharan |
| 7,553,214 | B2 | 6/2009 | Menk et al. |
| 7,568,970 | B2 | 8/2009 | Wang |
| 7,572,172 | B2 | 8/2009 | Aoyama et al. |
| 7,579,071 | B2 | 8/2009 | Huh et al. |
| 7,582,221 | B2 | 9/2009 | Netsu et al. |
| 7,601,050 | B2 | 10/2009 | Zuniga et al. |
| 7,614,939 | B2 | 11/2009 | Tolles et al. |
| 7,618,529 | B2 | 11/2009 | Ameen et al. |
| 7,632,434 | B2 | 12/2009 | Duescher |
| 7,648,410 | B2 | 1/2010 | Choi |
| 7,699,684 | B2 | 4/2010 | Prasad |
| 7,708,621 | B2 | 5/2010 | Saito |
| 7,731,568 | B2 | 6/2010 | Shimomura et al. |
| 7,741,656 | B2 | 6/2010 | Nakayama et al. |
| 7,753,761 | B2 | 7/2010 | Fujita |
| 7,754,611 | B2 | 7/2010 | Chen et al. |
| 7,762,870 | B2 | 7/2010 | Ono et al. |
| 7,807,252 | B2 | 10/2010 | Hendron et al. |
| 7,822,500 | B2 | 10/2010 | Kobayashi et al. |
| 7,833,907 | B2 | 11/2010 | Anderson et al. |
| 7,837,800 | B2 | 11/2010 | Fukasawa et al. |
| 7,838,482 | B2 | 11/2010 | Fukasawa et al. |
| 7,840,305 | B2 | 11/2010 | Behr et al. |
| 7,883,397 | B2 | 2/2011 | Zuniga et al. |
| 7,884,020 | B2 | 2/2011 | Hirabayashi et al. |
| 7,897,250 | B2 | 3/2011 | Iwase et al. |
| 7,922,783 | B2 | 4/2011 | Sakurai et al. |
| 7,947,190 | B2 | 5/2011 | Brown |
| 7,950,985 | B2 | 5/2011 | Zuniga et al. |
| 7,955,964 | B2 | 6/2011 | Wu et al. |
| 7,972,396 | B2 | 7/2011 | Feng et al. |
| 8,002,860 | B2 | 8/2011 | Koyama et al. |
| 8,021,215 | B2 | 9/2011 | Zuniga et al. |
| 8,025,813 | B2 | 9/2011 | Liu et al. |
| 8,029,640 | B2 | 10/2011 | Zuniga et al. |
| 8,043,140 | B2 | 10/2011 | Fujita |
| 8,047,899 | B2 | 11/2011 | Chen et al. |
| 8,062,096 | B2 | 11/2011 | Brusic et al. |
| 8,062,098 | B2 | 11/2011 | Duescher |
| 8,066,551 | B2 | 11/2011 | Chen et al. |
| 8,070,909 | B2 | 12/2011 | Shanmugasundram et al. |
| 8,071,479 | B2 | 12/2011 | Liu |
| 8,088,299 | B2 | 1/2012 | Chen et al. |
| 8,101,060 | B2 | 1/2012 | Lee |
| 8,101,093 | B2 | 1/2012 | De Rege et al. |
| 8,256,091 | B2 | 9/2012 | Duescher |
| 8,328,600 | B2 | 12/2012 | Duescher |
| 8,500,515 | B2 | 8/2013 | Duescher |
| 8,545,583 | B2 | 10/2013 | Duescher |
| 8,602,842 | B2 | 12/2013 | Duescher |
| 8,647,171 | B2 | 2/2014 | Duescher |
| 8,647,172 | B2 | 2/2014 | Duescher |
| 8,740,668 | B2 | 6/2014 | Duescher |
| 8,998,677 | B2 | 4/2015 | Duescher |
| 8,998,678 | B2 | 4/2015 | Duescher |
| 9,039,488 | B2 | 5/2015 | Duescher |
| 9,233,452 | B2 * | 1/2016 | Duescher ..... B24B 37/30 |
| 2005/0118939 | A1 | 6/2005 | Duescher |
| 2008/0299875 | A1 | 12/2008 | Duescher |
| 2010/0003904 | A1 | 1/2010 | Duescher |
| 2011/0223835 | A1 | 9/2011 | Duescher |
| 2011/0223836 | A1 | 9/2011 | Duescher |
| 2011/0223838 | A1 | 9/2011 | Duescher |
| 2014/0120806 | A1 | 5/2014 | Duescher |
| 2014/0127976 | A1 | 5/2014 | Duescher |

OTHER PUBLICATIONS

Wayne O. Duescher, Three-point fixed-spindle floating-platen abrasive system, U.S. Appl. No. 12/799,841, filed May 3, 2010. Earliest Publication No. US 20110223836 A1 Earliest Publication Date: Sep. 15, 2011. U.S. Pat. No. 8,602,842, granted Dec. 10, 2013.

Wayne O. Duescher, Abrasive Platen Wafer Surface Optical Monitoring System, U.S. Appl. No. 13/665,759, filed Oct. 31, 2012. Earliest Publication No. US 2014-0120802 A1 Earliest Publication Date: May 1, 2014.

Wayne O. Duescher, Bellows Driven Floatation-Type Abrading Workholder, U.S. Appl. 13/869,198, filed Apr. 24, 2013. Earliest Publication No. US 2014-0120805 A1 Earliest pubiccation date: May 1, 2014. Granted U.S. Pat. No. 8,998,677 on Apr. 7, 2015.

Wayne O. Duescher, Spider Arm Driven Flexible Chamber Abrading Workholder , U.S. Appl. No. 14/148,729, filed Jan. 7, 2014. Earliest Publication No. US 2014-0120806 A1 Earliest Publication Date: May 1, 2014. Granted U.S. Pat. No. 8,998,678 on Apr. 7, 2015.

Wayne O. Duescher, Pin Driven Flexible Chamber Abrading Workholder, U.S. Appl. No. 14/154,133, filed Jan. 13, 2014. Earliest Publication No. US 2014-0127976 A1 Earliest Publication Date: May 8. 2014. Granted U.S. Pat. No. 9,039,488 on May 26, 2015.

Wayne O. Duescher, Fixed-spindle and floating-platen abrasive system using spherical mounts , U.S. Appl. No. 12/807,802, filed Sep. 14, 2010. Earliest Publication No: US 20110223838 A1 Earliest Publication Date: Sep. 15, 2011. Granted U.S. Pat. No. 8,500,515 on Aug. 6, 2013.

* cited by examiner

VACUUM-GROOVED MEMBRANE WAFER POLISHING WORKHOLDER

RELATED APPLICATION DATA

This invention is a continuation-in-part of U.S. patent application Ser. No. 14/474,157 filed Aug. 31, 2014 that is a continuation-in-part of U.S. patent application Ser. No. 14/329,967 filed Jul. 13, 2014 that is a continuation-in-part of U.S. patent application Ser. No. 14/185,882 filed Feb. 20, 2014 that is a continuation-in-part of U.S. patent application Ser. No. 14/154,133 filed Jan. 13, 2014 that is a continuation-in-part of U.S. patent application Ser. No. 14/148,729 filed Jan. 7, 2014 that is a continuation-in-part of U.S. patent application Ser. No. 13/869,198 filed Apr. 24, 2013 that is a continuation-in-part of U.S. patent application Ser. No. 13/662,863 filed Oct. 29, 2012. These are each incorporated herein by reference in their entirety.

BACKGROUND OF THE INVENTION

Field of the Invention

The present invention relates to the field of abrasive treatment of surfaces such as grinding, polishing and lapping. In particular, the present invention relates to a high and low speed abrasive lapping or polishing workholder system for use with rotary, abrasive-coated flat-surfaced platens. The abrasive technology provides flat-surfaced and smooth-polished surfaces for semiconductor wafers and for other hard-material workpieces such as sapphire wafers or sapphire workpieces and ceramic or hard-metal rotary seals. The lapping and polishing production speeds of this system are many times faster than with conventional lapping systems.

In the present system, workpieces or wafers are attached with vacuum to the flexible elastomeric membrane of a wafer carrier that allows one surface of the workpiece to be in conformal abrading contact with a moving flat-surfaced abrasive. The elastomeric membrane external wafer attachment surface has a pattern of vacuum grooves and vacuum is supplied to the grooves to firmly attach the rigid-material silicon wafer in flat-surfaced contact with the membrane. The wafer provides lateral stiffness to the center portion of the membrane. An integral outer annular extension of the flexible elastomer membrane is attached to a rotatable rigid housing where the membrane annular extension maintains the wafer at its original location when abrading forces are applied to the wafer. The wafer peripheral edge does not contact a rigid retaining ring during a wafer polishing procedure.

To provide uniform material removal across the full surface of the workpiece, the carrier is rotated in the same direction as the platen at the same desired high rotation speeds as the platen. Often these rotating platens and workholder carriers have abrading speeds of over 10,000 surface feet per minute (SFPM). Here, a 12 inch diameter abrasive coated platen, and a workpiece carrier, can operate at 3,000 rpm to obtain these desired high abrading speeds. Larger diameter abrasive coated platens are rotated at slower speeds to attain these same high abrading speeds. Diamond abrasive particles are often used as they provide unexcelled material removal rates at high abrading speeds especially for flat-lapping of hard-material workpieces such as rotary sealing devices.

Conventional flexible membrane carrier heads loosely attach thin silicon wafers to a nominally-flat bottom surface of the membrane. The membrane is intentionally made flexible in a direction along the flat surface of the wafer to allow the outer periphery of the wafer to be in rolling contact with a rigid annular ring that surrounds the wafer. Here, the wafer having abrading forces applied to its abraded surface is confined within the carrier head by the rigid wafer retaining ring. These substantial abrading forces are transmitted through the laterally-stiff body of the wafer directly to the rigid retainer ring. The abrading forces are not transmitted through the flexible membrane.

With conventional wafer polishing, wafers are loosely attached to a membrane flat surface by a suction-bonding technique. A wafer is placed on a flat surface and the carrier head is moved into position over the wafer where both the wafer and the circular membrane are concentric. Then the membrane is pressed to be in flat-surfaced conformity with the wafer exposed flat surface. A weak suction-bond is established between the wafer and the membrane when all of the air is pushed out of the gap between the wafer and the flexible membrane. This suction-bond is sufficiently strong to transport the wafer to and from the wafer storage systems and to the rotatable resilient CMP pad that is surface-saturated with a liquid abrasive slurry mixture. After the wafer is pressed into conformal contact with the CMP pad and the pad is rotated, the weak suction-bond of the wafer does not need to resist the abrading forces applied to the wafer because the laterally-rigid wafer transmits these forces directly to the rigid wafer retainer ring.

However, the rolling contact of the outer periphery of the rigid, brittle and fragile silicon wafer with the retainer ring as the wafer is rotated can create abrading process problems. First, the fragile wafer edge can become cracked because of the rolling contact where dynamically changing abrading forces are concentrated at the point of contact of the wafer and the retainer ring. Here, when a circular wafer contacts an annular ring, the contact area is geometrically concentrated at a point. Also, neither the wafer nor the retainer ring has precisely circular surfaces. Any out-of-round portion of either of these will tend to concentrate the contact force at these circular high-spot areas.

Further, grooves tend to be worn into the annular wall surface of the retainer ring by the rolling-contact wafers. Then, when abrading forces are applied perpendicular to the wafer surface by the workholder carrier head pressure chamber, the wafer edge can become trapped in the retainer ring grooves. This lack of movement freedom of the wafer perpendicular to the wafer surface can prevent the application of a uniform abrading pressure on the wafer at its outer periphery. This non-uniform abrading pressure can result in non-uniform abrading of the wafer surface.

If wafer retainer rings are constructed from extremely hard materials, wear of the retainer ring is reduced but damage to the wafer edges is increased. Use of softer retainer ring materials helps increase the size of the contact area which reduces the localized stress on the wafer edge. However, softer retainer ring materials increases the wear of the retainer ring and the formation of annular grooves. Retainer rings are replaced periodically to minimize these problems.

Wafers are prepared for CMP pad polishing by grinding a curved spherical-type edge on the outer periphery edge of the wafer. Each wafer curved surface is different and the nominal thickness of each wafer is slightly different. The contact grooves worn into the retainer ring by these different-sized wafers affect the contact behavior of the wafers during a wafer polishing operation.

Other wafers are configured with one side cut-off to provide a straight-edge to orient or register the wafer during fabrication. This edge-cut wafer results in two contact points at the intersection of the cut line and the wafer outer circle. When this style of wafer is rotated, all of the wafer-restraining forces are concentrated at these two junction points as the wafer is rotated and the wafer edge contacts the retainer ring during a polishing operation.

Generally, the membrane type of carrier is rotated at very slow speeds. In part, these slow speeds are required to minimize damage to the edge of the wafer as it is rolling contact with the retainer ring. Also, localized distortion of the resilient CMP pad as it contacts the abraded surface of the wafer requires the CMP pad to be rotated at slow speeds. These slow abrading speeds result in slow material removal rates from the surface of the wafer. Carrier heads can also have multiple annular pressure chambers to provide annular zones of higher or lower abrading pressures across the radial surface of the wafer.

The flexibility of the wafer and the flexible carrier bottom allows applied fluid pressure applied to pressure chambers that are an integral part of the flexible membrane to exert a controlled abrading pressure across the surface of the wafer to provide uniform material removal from the full surface of the wafer.

With the present system, the planar-stiff silicon semiconductor wafers are flexible in a vertical direction that is perpendicular to the surface of the wafer but are very stiff in a horizontal direction that is in the plane of the wafer surface. Here, the planar-stiff wafers are firmly attached to the membrane surface with vacuum which rigidizes the whole inner circular portion of the flexible membrane along its nominally-flat surface area that is in contact with the wafer. However, both the membrane and the attached wafer are flexible in a vertical direction that is perpendicular to the flat surface of the wafer. The workpiece carrier head has a radial free-span annular portion of the membrane that is located between the outer periphery of the wafer and the inner portion of a rigid membrane restraining ring. Here the outer periphery of the membrane is attached to the rigid membrane-restraining ring that surrounds the wafer. The radial flexibility of the annular portion of the elastomer membrane that extends radially outward from the outer periphery of the wafer has substantial radial stiffness but has perpendicular flexibility. This allows the wafer to be moved vertically against a flat surfaced abrasive coated platen where the abrading force is uniform across the full surface of the wafer and the wafer is restrained laterally in the plane of the wafer by the radial free-span annular portion of the flexible membrane.

High speed flat lapping is typically performed using flexible abrasive disks that have an annular band of abrasive-coated raised islands. These raised-island disks are attached to flat-surfaced platens that rotate at high abrading speeds. Coolant water is applied to the abrading surface to remove heat generated by the abrading action, and also, to remove abrading debris. The use of the raised island disks prevent hydroplaning of the lapped workpieces when they are lapped at high speeds with the presence of coolant water. Hydroplaning causes the workpieces to tilt which results in non-flat lapped workpiece surfaces. Excess water is routed from contact with the workpiece flat surfaces into the recessed passageways that surround the abrasive coated raised island structures. The coolant water also continuously flushes the abrading debris from the top abrasive surface of the raised-island into the recessed channels.

Also, by using wafers that extend out slightly over both the inner and outer annular edges of the fixed abrasive, the abrasive is worn down uniformly across the annular-band surface of the raised islands. Uniform wear of the abrasive coated raised islands across the radial width of the annular band of abrasive continually provides a precision-flat abrasive surface that contacts the abraded surface of the wafers. If desired, a conditioning tool can periodically be used to refine the flat surface of the raised island abrasive.

To operate successfully at high abrading speeds, the flexible abrasive disks are conformally attached to the flat surfaces of precision-flat rotary platens. Also, the abrasive disks must be precisely uniform in thickness across their full annular abrading surface to provide full utilization of all the abrasive and to provide smooth abrading contact with the workpiece. Abrasive disks having circumferential thickness variations will provide undesirable "bumpy" abrasive contact with a wafer when the disks are rotated at high speeds. The flexible disks are quickly attached to the platens with the use of vacuum. A range of sizes of abrasive particles are typically used to optimize an abrading operation. Diamond particles, having a size of 30 microns encapsulated in ceramic beads that are coated on the top surfaces of the raised islands are used for coarse abrading. An abrasive disk having medium sized diamond particles of 10 or 3 microns is then used. The final polish is then done by sub-micron sized diamond particles.

Conventional wafer-polishing workholders are typically very limited to slow speeds and can not attain the high rotational speeds that are required for high speed lapping and polishing. Even very thin and ultra-hard disks such as sapphire can be easily abraded and polished at very high production rates with this high speed abrading system especially when using diamond abrasives. Extremely hard tungsten carbide (used as cutting tool bits for machine tools) can be "cut like butter" using diamond abrasives at high speeds>

The slide-pin arm-driven workholders having flexible annular diaphragm devices provide that a wide range of uniform abrading pressures can be applied across the full abraded surfaces of the workpieces such as semiconductor wafers. These slide-pin devices also allow the workholder carrier device flexible membrane to provide flat-surfaced contact of workpieces that are attached to the workholder device with a flat-surfaced abrasive coating on a rotating abrading platen. Also, one or more of the workholders can be used simultaneously with a rotary abrading platen.

Flat lapping of workpiece surfaces used to produce precision-flat and mirror smooth polished surfaces is required for many high-value parts such as semiconductor wafers and rotary seals. The accuracy of the lapping or abrading process is constantly increased as the workpiece performance, or process requirements, become more demanding. Required workpiece feature tolerances for flatness accuracy, the amount of material removed, the part thickness and the smoothness of the polish become more progressively more difficult to achieve with existing abrading machines and abrading processes. In addition, it is necessary to reduce the processing costs without sacrificing performance.

The chemical mechanical planarization (CMP) liquid-slurry abrading system has been in common use for polishing newly-deposited surface-layers on semiconductor wafers that are already exceedingly flat. During CMP polishing, a very small amount of material is removed from the surface of the wafer. Typically the amount of material removed by polishing is measured in angstroms where the overall global flatness of the wafer is not affected much. It is critical that the global flatness of the wafer surface is maintained in a precision-flat condition to allow new patterned layers of metals and insulating oxides to be deposited on the wafer surfaces with the use of photolithography techniques. Global flatness is a measure of the flatness across the full surface of the wafer. Site or localized flatness of a wafer refers to the flatness of a localized portion of the wafer surface where the photolithography deposition patterns are made.

The semiconductor industry has used wafer carrier heads having flexible polymer membranes for many years to polish the semiconductor-side surface of wafers after the deposition of layers of materials that form new semiconductor devices and electrical conductors. These membrane-type carrier heads are mostly used with flexible CMP pads that are saturated with a liquid abrasive slurry. However, the same type of membrane carrier head is also used to polish wafers with fixed-abrasive-island types of web-sheets of abrasive. The CMP pads are resilient and the carrier head thrusts the wafers down into the surface-depths of the rotating pads as the wafers are rotated. The fixed-abrasive web-sheets are quite rigid and they are supported by a stationary polymer platen which is also quite rigid so the wafers "ride" on the surface of the fixed-abrasive. Both the resilient CMP pads and the rigid fixed-abrasive sheets provide acceptable polishing of the semiconductor wafers.

Deformation of the CMP pads allows the pads to provide somewhat uniform abrading pressures across the full inner diameter of the wafer. However, distortion of the CMP pads occurs at the periphery of the wafer as the rotating pad moves against the stationary-positioned but rotating wafer. This wafer-edge pad distortion causes excessive wafer deposition material removal at the outer annular portion of the wafer. As a result, the polished wafer is not precisely flat across the full surface of the wafer. In order to compensate for the uneven material removal across the surface of the wafer due to the wafer-periphery CMP pad distortion, multiple annular abrading pressure chambers are used with these membrane-type wafer carrier heads.

The abrading pressure is independently controlled in each annular membrane chamber to attempt uniform material removal at different annular portions of the wafer. However, these independent pressure chambers are at fixed locations within the carrier head where each pressure zone is adjacent to another zone. Here, the abrading rate of each annular pressure fixed-position zone is completely different than that in a directly adjacent zone as the pressure in each zone is different. From an abrading standpoint here, there is no logical reason that the non-uniform abrading of a wafer by a CMP pad has step variations that occur exactly at the annular demarcation lines that exist at the locations of the independent flexible membrane pressure zones. Rather, it is expected that the material removal rate will have a smooth (non-step) variation radially across the surface of the rotating wafer. The use of more independent annular pressure chambers improves the performance somewhat.

When flexible membranes having one or more independent abrading pressure chambers are used where wafers are attached by suction-bonding the wafers to the bottom nominally-flat membrane surface, rigid wafer-retaining rings are commonly used with these carrier heads. The flexible membrane has little stiffness in a lateral direction along the surface of the wafer so the stiff circular wafer disk is forced against the rigid wafer-retaining rings that surround the wafer perimeter. As the wafer rotates, the substantial abrading forces imposed on the wafer abraded surface urges the wafer edge to be in rolling contact with the outer retaining ring. The relatively thin silicon wafers are brittle and fragile so damage to the wafer can easily occur as the wafer if polished. Slow rotational speeds of the wafer are required with this operation because of the continual lateral movement of the elastomer membrane and the attached wafer. If the retainer rings are not used, the wafer would not be contained within the confines of the wafer carrier head.

It is well known that the rate of material removal at localized portions of the wafer are directly proportional to both the abrading speed and the abrading pressure that exist at these localized portions. For CMP polishing, a resilient CMP pad is attached to a rotatable platen and the wafer is attached to a rotatable carrier. The wafer carrier and the pad can be rotated in the same direction at the same rotation speeds to provide a uniform localized abrading speed over the full surface of the wafer. Often the rotational speed of the wafer is half, or less, than the rotational speed of the CMP pad which can be well below the optimal speed of the wafer. However, it is quite difficult to provide a uniform localized abrading pressure over the full surface of the wafer because of the distortions of the resilient pad when the wafer is thrust down into the surface-depths of the moving pad. Because these localized abrading pressures are not uniform, the material removal rates from the surface of the wafer are not uniform.

Wear patterns on the surface of the CMP pad itself can be a cause of non-uniform material removal on wafers. Because of the travel path of the wafer relative to the larger-sized CMP pad, the inner annular portion of the pad can become more worn than the inner and outer annular portions of the pad. This non-level pad surface results in non-uniform surface shapes of the wafer. Also, when a pad is used for some time, the pad tends to accumulate abrading debris and worn abrasive particles, often in the central annular region of the pad. This contaminated central area of the pad can result in above-average aggressive material removal of portions of the wafer surface. Wafers tend to have "domed" or "dished" central portions, depending on the conditions of the pad and the relative rotational speeds of both the pad and the wafer. CMP pads are typically continuously "dressed" with sharp-edged diamond tools to break-up the debris caused hardened surfaces of the pad. More surface debris is generated by these pad dressing tools.

Liquid abrasive slurry is continually supplied to the surface of the pads but there is little movement of the spent slurry, containing dull abrasive particles, pad particles and wafer debris from the surface of the large flat pads to a region off the surface of the pads. The wafers are in constant abrading contact with this debris. CMP pads are changed as their effective use life is quite limited.

The individual fibers of a resilient CMP pad are considered to protrude upward from the nominal surface of the pad where the free ends of these individual fibers are in abrading contact with the surface of a polished wafer. When a high-spot of a rotating wafer contacts the protruding ends of these fibers, the pad fiber free ends are pushed down by this high spot as it moves past the individual fibers. Due to the nature of the construction of the resilient pads and also due to the liquid abrasive slurry that coats the pads, it takes some time for the "pushed-down" individual fibers to recover their full original protruded heights after the wafer moving high spot has passed. This motion-damping effect of the pad body and its protruding fiber ends is enhanced by the presence of the liquid slurry. Here, the low-spot areas of the rotating wafer that directly follow the high-spot areas are not contacted effectively with the depressed fiber ends that do not have enough time to "spring-back" to their original protruded heights. The result is less amounts of material are removed from the deposition layer on the low-spot areas of the wafer than was preferentially removed from the high-spot areas of the wafer.

The whole object of removing a uniform depth of the deposited semiconductor material across the full surface of the wafer can not be achieved unless the wafer is rotated slow enough that the damped individual fiber ends of the CMP pads have time to "spring back" enough to provide uniform abrading pressures. By comparison, when a fixed-abrasive raised-island, rigid-thickness abrasive disk is used for abrading at high speeds, there is no abrasive surface "spring-back" issue because the abrasive surface is rigid.

Another cause of non-uniform material removal from a wafer surface is the deformation of the wafer into a free-standing non-flat condition by the high temperature furnace processing of the wafers. Uneven heating of the wafer by radiation typically causes the outer periphery of the wafer to heat up more rapidly than the inner central portion of the wafer. This uneven temperature causes thermal stresses in the wafer which distort the wafer. Non-uniform heating of the wafer can cause saddle-shaped wafers. Non-uniform cooling of the wafer can cause cone-shaped wafers. Each wafer has different semiconductor die patterns, different semiconductor materials and different thermal processing which results in different amounts of deformation and different patterns of deformation for individual wafers. These wafer non-flat deformations are present prior to the individual wafers being abrasively polished.

For the use of the stationary-position fixed abrasive web-sheets, the membrane type carrier head rotates at same time it pivots on an eccentric crank-shaft swing-arm to provide uniform localized abrading speeds across the full surface of the wafer. The flexibility of the carrier head membrane can provide near-uniform abrading pressure at the localized areas of the wafer during the polishing action. The rigid-thickness raised-island abrasive web does not provide a precision-flat abrasive surface as it is supported by a large flat platen surface made of a polymer that is not precisely flat. Also, the wafer is swept in a path that tends to leave a worn recessed annular central area having raised abrasive walls that are encountered by the wafer as the abrasive web is periodically incremented forward. These raised annular walls primarily contact the outer periphery of the wafers which results in a non-uniform polishing of the wafer surface.

Presently, wafers typically range in size from 4 to 12 inches (300 mm) diameter and are typically 0.027 inches (680 microns) thick and have unpolished deposited semiconductor coatings that are about 2 microns (about 0.1 thousands of an inch) thick. Large diameter 450 mm (18 inches) wafers being developed can also be polished by this system. Deposited semiconductor coatings on the wafer are then abraded and polished to have a resultant thickness of approximately 0.8 microns (about 0.03 thousandths of an inch) where the variation of the polished coating deposition layer is only about 0.02 microns. This very small variation is about 1 millionth of an inch or about 0.1 lightbands. A 12 inch diameter wafer that is only 0.027 inches thick is nominally quite flexible perpendicular to its planar surface even though it is made from silicon, which is quite stiff. These wafers have this substantial thickness to allow them to be repetitively handled during the multiple manufacturing steps required to produce the individual semiconductor chips. After the wafer has been completed, the back side of the wafer is ground off to produce a very thin wafer that is scribed and cut into individual chips. Also, the circular wafers need to be relatively thick because their outer periphery edges contact a rigid retainer ring to contain the wafer in a carrier head when large lateral abrading friction forces are applied to the wafer surface in a polishing operation as the flexible membranes can not provide this support.

When a wafer is loosely attached to a carrier head by pressing the wafer into intimate contact with the flexible nominally-flat membrane, the wafer becomes attached to the membrane by "suction" forces. Here, neither the wafer nor the flexible membrane assumes a flat-surfaced shape. The relatively thin wafer tends to flex with the flexed membrane to create controlled localized abrading forces as pressure is applied to the carrier pressure chamber that is part of the membrane. The nominally non-flat but thin wafers are pressed into a relatively more-flat condition against the abrasive slurry CMP pad (or fixed-abrasive web sheet) by the carrier head flexible membrane which has an abrading pressure applied to it by the internal pressure chamber. Because the flexible wafer is held in pressurized contact with the abrasive CPM pad (or abrasive island web) by the flexible membrane, material is removed quite uniformly across most of the abraded surface of the wafer, completely independent of reference to the back side of the wafer.

However, when a photolithographic device is used to create a material deposition pattern on a semiconductor device, the wafer is backside-mounted on a precision-flat platen with vacuum. Thus, the critical focusing of the photolithographic device across the full selected pattern area on the front side of a wafer is indirectly referenced to the back side of the wafer. The whole localized patterned area of the wafer being exposed to the light source is laterally positioned under the photolithographic device by a stepper device that moves the platen-attached wafer horizontally in two independent and perpendicular directions. Even though the stepper platen can be rotated spherically, it is important that the front polished surface of the wafer is precisely flat relative to the flat back-side surface of the wafer to minimize the localized spherical adjustment of the wafer as the different selected areas of the wafer are sequentially exposed.

Free-standing wafers are often non-flat as they assume curled shapes when not attached to a flat surface. When a wafer is conformally attached to a flat rigid platen, the exposed surface of the wafer assumes the shape of the platen if the two opposed surfaces of the wafer are perfectly parallel to each other. If a platen is not precisely flat, the exposed surface of the wafer will not be precisely flat. For a rigid abrading system, any variation in the flatness of the abraded surface of the wafer that exceeds the desired uniformity of 0.02 microns can prevent uniform material removal on a wafer surface.

With the present membrane wafer polishing system, the fixed abrasive is supported by a rigid rotatable platen having a precision-flat abrading surface. The wafer abraded surface assumes a uniform flat surface as it conforms to the flat abrasive surface. As the abrading pressure is uniform across the full abraded surface of the wafer, material removal is uniform across the full abraded surface of the wafer. This uniformity of material removal is achieved because of the stable and rigid precision flatness of the abrasive coated platen.

A level-coated fixed-abrasive disk or a raised-island abrasive disk can be used with the precision-flat platen to achieve these highly desirable uniform material removals from a polished wafer surface. Also, a thin liquid abrasive slurry coating can be applied to a rigid precisely-flat surface of a rotatable platen to provide uniform material removal using the vacuum-grooved flexible elastomer membrane workpiece carrier head. The raised-island disks having an annular band of fixed-abrasive coated islands can be used at very high abrading speeds with water coolant without hydroplaning. A flexible disk with an annular level-coating of fixed-abrasive can be used with water coolant but only at very low abrading speeds to avoid hydroplaning. The liquid abrasive slurry coated platen is also used at very low abrading speeds. All three of these abrasive media provide a rigid or semi-rigid flat-surfaced abrading surface because they are supported by or are attached to a precision-flat rigid rotary platen.

By contrast, when a conventional flexible membrane workpiece carrier head is used with a liquid abrasive slurry saturated resilient CMP pad, the outer periphery of a wafer experiences excessive material removal due to the wafer being plunged into the surface depths of the resilient CMP pad during a wafer polishing procedure. Both the wafer and the CPM pad are distorted out-of-plane during the CMP pad abrasive slurry wafer polishing procedure.

It is difficult to construct a lapping or polishing machine that has a rigid carrier attached to a rotating spindle where the spindle axis is maintained in precisely perpendicular alignment with a precision-flat surfaced rotating abrasive coated platen. Here, it is critical this alignment exists to provide precision-flat workpieces and wafers. However, the lack of precision perpendicular alignment of a rigid wafer carrier head spindle axis with the top surface of a platen abrasive can be overcome by the use of the flexible-membrane type of carrier head where the wafer abraded surface assumes conformal contact with the platen abrasive surface.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434; 7,520,800; 8,062,098; 8,256,091; 8,328,600; and 8,545,583; 8,647,171; 8,647,172 and U.S. patent application Ser. Nos. 12/661,212; 12/799,841; 13/665,759; 13/869,198; 14/148,729 and 14/154,133 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

U.S. Pat. No. 6,769,969 (Duescher) describes flexible abrasive disks that have annular bands of abrasive coated raised islands. These disks use fixed-abrasive particles for high speed flat lapping as compared with other lapping systems that use loose-abrasive liquid slurries. The flexible raised island abrasive disks are attached to the surface of a rotary platen to abrasively lap the surfaces of workpieces.

U.S. Pat. No. 8,062,098 (Duescher) describes the use of a spherical-action workpiece carrier that has an off-set center of rotation that coincides with the abraded surface of the workpiece. This device prevents tilting of the workpiece caused by abrading forces that are applied on the workpiece abraded surface. A spherical bearing is incorporated in the carrier to provide this spherical action motion as the workpiece is rotated by the carrier.

U.S. Pat. No. 8,328,600 (Duescher) describes the use of spherical-action mounts for air bearing and conventional flat-surfaced abrasive-covered spindles used for abrading where the spindle flat surface can be easily aligned to be perpendicular to another device. Here, in the present invention, this type of air bearing and conventional flat-surfaced abrasive-covered spindles can be used where the spindle flat abrasive surface can be easily aligned to be perpendicular with the rotational axis of a floating bellows-type workholder device.

Various abrading machines and abrading processes are described in U.S. Pat. No. 5,364,655 (Nakamura et al). U.S. Pat. No. 5,569,062 (Karlsrud), U.S. Pat. No. 5,643,067 (Katsuoka et al), U.S. Pat. No. 5,769,697 (Nisho), U.S. Pat. No. 5,800,254 (Motley et al), U.S. Pat. No. 5,916,009 (Izumi et al), U.S. Pat. No. 5,964,651 (Hose), U.S. Pat. No. 5,975,997 (Minami, U.S. Pat. No. 5,989,104 (Kim et al), U.S. Pat. No. 6,089,959 (Nagahashi, U.S. Pat. No. 6,165,056 (Hayashi et al), U.S. Pat. No. 6,168,506 (McJunken), U.S. Pat. No. 6,217,433 (Herrman et al), U.S. Pat. No. 6,439,965 (Ichino), U.S. Pat. No. 6,893,332 (Castor), U.S. Pat. No. 6,896,584 (Perlov et al), U.S. Pat. No. 6,899,603 (Homma et al), U.S. Pat. No. 6,935,013 (Markevitch et al), U.S. Pat. No. 7,001,251 (Doan et al), U.S. Pat. No. 7,008,303 (White et al), U.S. Pat. No. 7,014,535 (Custer et al), U.S. Pat. No. 7,029,380 (Horiguchi et al), U.S. Pat. No. 7,033,251 (Elledge), U.S. Pat. No. 7,044,838 (Maloney et al), U.S. Pat. No. 7,125,313 (Zelenski et al), U.S. Pat. No. 7,144,304 (Moore), U.S. Pat. No. 7,147,541 (Nagayama et al.), U.S. Pat. No. 7,166,016 (Chen), U.S. Pat. No. 7,250,368 (Kida et al.), U.S. Pat. No. 7,367,867 (Boller), U.S. Pat. No. 7,393,790 (Britt et al.), U.S. Pat. No. 7,422,634 (Powell et al.), U.S. Pat. No. 7,446,018 (Brogan et al.), U.S. Pat. No. 7,456,106 (Koyata et al.), U.S. Pat. No. 7,470,169 (Taniguchi et al.), U.S. Pat. No. 7,491,342 (Kamiyama et al.), U.S. Pat. No. 7,507,148 (Kitahashi et al.), U.S. Pat. No. 7,527,722 (Sharan) and U.S. Pat. No. 7,582,221 (Netsu et al).

Also, various CMP machines, resilient pads, materials and processes are described in U.S. Pat. No. 8,101,093 (de Rege Thesauro et al.), U.S. Pat. No. 8,101,060 (Lee), U.S. Pat. No. 8,071,479 (Liu), U.S. Pat. No. 8,062,096 (Brusic et al.), U.S. Pat. No. 8,047,899 (Chen et al.), U.S. Pat. No. 8,043,140 (Fujita), U.S. Pat. No. 8,025,813 (Liu et al.), U.S. Pat. No. 8,002,860 (Koyama et al.), U.S. Pat. No. 7,972,396 (Feng et al.), U.S. Pat. No. 7,955,964 (Wu et al.), U.S. Pat. No. 7,922,783 (Sakurai et al.), U.S. Pat. No. 7,897,250 (Iwase et al.), U.S. Pat. No. 7,884,020 (Hirabayashi et al.), U.S. Pat. No. 7,840,305 (Behr et al.), U.S. Pat. No. 7,838,482 (Fukasawa et al.), U.S. Pat. No. 7,837,800 (Fukasawa et al.), U.S. Pat. No. 7,833,907 (Anderson et al.), U.S. Pat. No. 7,822,500 (Kobayashi et al.), U.S. Pat. No. 7,807,252 (Hendron et al.), U.S. Pat. No. 7,762,870 (Ono et al.), U.S. Pat. No. 7,754,611 (Chen et al.), U.S. Pat. No. 7,753,761 (Fujita), U.S. Pat. No. 7,741,656 (Nakayama et al.), U.S. Pat. No. 7,731,568 (Shimomura et al.), U.S. Pat. No. 7,708,621 (Saito), U.S. Pat. No. 7,699,684 (Prasad), U.S. Pat. No. 7,648,410 (Choi), U.S. Pat. No. 7,618,529 (Ameen et al.), U.S. Pat. No. 7,579,071 (Huh et al.), U.S. Pat. No. 7,572,172 (Aoyama et al.), U.S. Pat. No. 7,568,970 (Wang), U.S. Pat. No. 7,553,214 (Menk et al.), U.S. Pat. No. 7,520,798 (Muldowney), U.S. Pat. No. 7,510,974 (Li et al.), U.S. Pat. No. 7,491,116 (Sung), U.S. Pat. No. 7,488,236 (Shimomura et al.), U.S. Pat. No. 7,488,240 (Saito), U.S. Pat. No. 7,488,235 (Park et al.), U.S. Pat. No. 7,485,241 (Schroeder et al.), U.S. Pat. No. 7,485,028 (Wilkinson et al), U.S. Pat. No. 7,456,107 (Keleher et al.), U.S. Pat. No. 7,452,817 (Yoon et al.), U.S. Pat. No. 7,445,847 (Kulp), U.S. Pat. No. 7,419,910 (Minamihaba et al.), U.S. Pat. No. 7,018,906 (Chen et al.), U.S. Pat. No. 6,899,609 (Hong), U.S. Pat. No. 6,729,944 (Birang et al.), U.S. Pat. No. 6,672,949 (Chopra et al.), U.S. Pat. No. 6,585,567 (Black et al.), U.S. Pat. No. 6,270,392 (Hayashi et al.), U.S. Pat. No. 6,165,056 (Hayashi et al.), U.S. Pat. No. 6,116,993 (Tanaka), U.S. Pat. No. 6,074,277 (Arai), U.S. Pat. No. 6,027,398 (Numoto et al.), U.S. Pat. No. 5,985,093 (Chen), U.S. Pat. No. 5,944,583 (Cruz et al.), U.S. Pat. No. 5,874,318 (Baker et al.), U.S. Pat. No. 5,683,289 (Hempel Jr.), U.S. Pat. No. 5,643,053 (Shendon),), U.S. Pat. No. 5,597,346 (Hempel Jr.).

Other wafer carrier heads are described in U.S. Pat. No. 5,421,768 (Fujiwara et al.), U.S. Pat. No. 5,443,416 (Volodarsky et al.), U.S. Pat. No. 5,738,574 (Tolles et al.), U.S. Pat. No. 5,993,302 (Chen et al.), U.S. Pat. No. 6,050,882 (Chen), U.S. Pat. No. 6,056,632 (Mitchel et al.), U.S. Pat. No. 6,080,050 (Chen et al.), U.S. Pat. No. 6,126,116 (Zuniga et al.), U.S. Pat. No. 6,132,298 (Zuniga et al.), U.S. Pat. No. 6,146,259 (Zuniga et al.), U.S. Pat. No. 6,179,956 (Nagahara et al.), U.S. Pat. No. 6,183,354 (Zuniga et al.), U.S. Pat. No. 6,251,215 (Zuniga et al.), U.S. Pat. No. 6,299,741 (Sun et al.), U.S. Pat. No. 6,361,420 (Zuniga et al.), U.S. Pat. No. 6,390,901 (Hiyama et al.), U.S. Pat. No. 6,390,905 (Korovin et al.), U.S. Pat. No. 6,394,882 (Chen), U.S. Pat. No. 6,436,828 (Chen et al.), U.S. Pat. No. 6,443,821 (Kimura et al.), U.S. Pat. No. 6,447,368 (Fruitman et al.), U.S. Pat. No. 6,491,570 (Sommer et al.), U.S. Pat. No. 6,506,105 (Kajiwara et al.), U.S. Pat. No. 6,558,232 (Kajiwara et al.), U.S. Pat. No. 6,592,434 (Vanell et al.), U.S. Pat. No. 6,659,850 (Korovin et al.), U.S. Pat. No. 6,837,779 (Smith et al.), U.S. Pat. No. 6,899,607 (Brown), U.S. Pat. No. 7,001,257 (Chen et al.), U.S. Pat. No. 7,081,042 (Chen et al.), U.S. Pat. No. 7,101,273 (Tseng et al.), U.S. Pat. No. 7,292,427 (Murdock et al.), U.S. Pat. No. 7,527,271 (Oh et al.), U.S. Pat. No. 7,601,050 (Zuniga et al.), U.S. Pat. No. 7,883,397 (Zuniga et al.), U.S. Pat. No. 7,947,190 (Brown), U.S. Pat. No. 7,950,985 (Zuniga et al.), U.S. Pat. No. 8,021,215 (Zuniga et al.), U.S. Pat. No. 8,029,640 (Zuniga et al.), and U.S. Pat. No. 8,088,299 (Chen et al.).

A number of other carrier heads are described in the following patents: U.S. Pat. No. 5,329,732 (Karlsrud et al), U.S. Pat. No. 5,449,316 (Strasbaugh), U.S. Pat. No. 5,423,716 (Strasbaugh), U.S. Pat. No. 5,335,453 (Baldy et al.), U.S. Pat. No. 5,964,653 (Perlov et al.), U.S. Pat. No. 5,961,169 (Kalenian et al.), U.S. Pat. No. 6,024,630 (Shendon et al.), U.S. Pat. No. 6,159,073 (Wiswesser et al.), U.S. Pat. No. 6,162,116 (Zuniga et al.), U.S. Pat. No. 6,224,472 (Lai et al.), U.S. Pat. No. 6,439,978 (Jones et al.), U.S. Pat. No. 6,663,466 (Chen et al.), U.S. Pat. No. 6,592,439 (Li et al.), U.S. Pat. No. 6,908,366 (Gagliardi), U.S. Pat. No. 7,008,295 (Wiswesser et al.), U.S. Pat. No. 7,018,275 (Zuniga et al.), U.S. Pat. No. 7,086,929 (Wiswesser), U.S. Pat. No. 7,101,272 (Chen et al.), U.S. Pat. No. 7,527,271 (Oh et al.), U.S. Pat. No. 8,021,215 (Zuniga et al.), U.S. Pat. No. 8,066,551 (Chen et al.), U.S. Pat. No. 8,070,909 (Shanmugasundram et al).

All references cited herein are incorporated in their entirety by reference.

SUMMARY OF THE INVENTION

Semiconductor wafers are attached to a carrier head that has an elastomer flexible bottom membrane where the wafer is attached to this membrane bottom with vacuum. A pattern of open shallow vacuum grooves are present on the exposed bottom flat surface of the elastomeric membrane. A wafer is placed in flat-surfaced contact with the membrane where the wafer surface seals the open vacuum grooves and vacuum is applied to the grooves. This applied vacuum creates a vacuum pressure across the surface of the wafer which firmly attaches the wafer to the flexible membrane where the wafer and the membrane mutually conform to each other. The circular silicon wafer is very rigid in the plane of the wafer but the thin wafer is somewhat flexible in a direction that is perpendicular to the planar surface of the wafer. The membrane assumes the planar rigidity of the wafer in the central region of the circular membrane where the wafer is attached.

An outer periphery annular portion of the membrane extends radially past the outer periphery of the attached wafer. This membrane outer annular portion is flexible in a direction that is perpendicular to the planar surface of the wafer but the elastomeric membrane outer annular portion is substantially stiff in a radial direction that is in the plane of the wafer. The membrane flexible annular outer portion is restrained radially at its outer periphery by a rigid membrane-restraining ring. Here, both the membrane and the attached wafer are flexible in a direction that is perpendicular to the planar surface of the wafer but both the membrane and the attached wafer are restrained radially by the elastomeric membrane outer annular portion that is substantially stiff in a radial direction that is in the plane of the wafer. When the surface of the wafer is subjected to abrading forces, the wafer remains radially-centered in the workpiece carrier head due to the planar stiffness of the wafer and due to the planar stiffness of the membrane flexible annular outer portion.

Unlike conventional membrane-type wafer carrier polishing heads, there is no rolling contact of the outer edge of the wafer with a rigid wafer-restraining ring during a wafer abrasive polishing procedure. Here, an integral outer annular extension of the flexible elastomer membrane is attached to a rotatable rigid housing where the radially-stiff membrane annular extension maintains the rotating circular wafer at its original position at the center of the circular membrane when abrading forces are applied to the wafer. Because of the radial stiffness of the elastomeric annular extension of the membrane, the center-restrained wafer peripheral edge does not contact a rigid retaining ring during a wafer polishing procedure. With this lack of rolling contact of the fragile silicon wafer with a rigid wafer retainer ring, no chipping of the wafer edge or other damage to the wafer occurs during a wafer polishing procedure. Also, the integral outer annular extension of the flexible elastomer membrane that is attached to a rotating carrier head housing transmits wafer rotational torque from the rotating housing to the wafer to rotate the wafer during a wafer polishing procedure.

Also, water cooled fixed-abrasive, raised-island flexible abrasive disks that are conformally attached to the precision-flat surface of a rotating platen are used to polish the wafer surface. And, unlike conventional liquid abrasive slurry polishing systems, the water coolant continually washes the wafer during the polishing procedure and the effort of removing the abrasive slurry from the wafer is eliminated. Further, the present invention system can be operated at very high abrading speeds with high productivity as compared to conventional nominally very slow CMP pad abrasive slurry wafer polishing systems.

The bottom flat surface of the membrane is sufficiently thick to allow the exterior surface to have patterns of shallow channels or grooves that can provide vacuum attachment of a wafer or workpiece to the membrane surface. A vacuum passageway and a vacuum source are provided for these vacuum grooves. Positive fluid pressure can also be supplied to these groves to separate the wafer from the membrane upon completion of a polishing procedure. Typically the vacuum surface grooves have curved upper groove-surfaces to allow the effective removal of abrading debris from the grooves by flushing the exposed vacuum grooves with water after an abrasively-polished wafer is separated from the membrane.

The membrane material or composite layers of a laminated membrane can be constructed from a variety of materials including thermoplastic and thermoset polyurethanes, woven cloths, individual polymer threads, carbon fibers, ceramic fibers, inorganic materials, organic materials and individual metal strands or woven metal strands, thin metals and composite or laminated layers of metals and non-metals. The elastomer membrane material can have a range of hardness of from 15 to 90 durometer. Laminated layers and reinforcing materials can be bonded together with adhesives, solvents or heat.

Single fibers or strands such as monofilaments or woven threads that are very stiff axially can be bonded to the membrane bottom surface with a nominal radial orientation to provide radial stiffness to the membrane. These fibers can preferably located at the outer circumference of the membrane and oriented in a radial direction to minimize the lateral stretching in the annular portion of the membrane that is located between the wafer periphery and a rigid ring that surrounds the wafer. Reinforcing fibers can bonded to the membrane as single strands or can have continuous loop patterns of long fiber strands. Mats of fiber cloth can also be bonded to the membrane.

The circular shaped wafer carrier membrane has a compliant layer of an elastomer that is flexible perpendicular to the membrane flat surface but is stiff radially along the membrane surface. This membrane provides radial support of the vacuum-attached wafer to minimize radial movement of the wafer with each revolution of a wafer as its abraded surface is subjected to abrading forces during an abrasive polishing operation. The wafer continually moves a small distance radially as it is rotated but the periphery of the wafer does not contact a rigid retainer ring during an abrading procedure. Moving contact of the rigid retainer ring by the wafer is avoided and the possibility of damage to the fragile and brittle silicon wafer edge is eliminated.

As the amount of material removal from the surface of a polished semiconductor wafer is so small (about 1 micron) there is an extremely small amount of vertical movement of the flexible membrane and the wafer toward the abrasive surface after a wafer polishing procedure is begun. Because of the very small vertical movement of the wafer, the angularity of the outer annular periphery of the membrane has little change. The result here is that the outer periphery of the membrane provides substantial radial support of the rotating wafer with little or no tendency to lift or push down the outer periphery of the wafer. It is desired to minimize these vertical forces on the edge of the wafer that would increase or decrease the abrading forces at that location.

Use of a longer radial span width of the outer periphery of the flat surface of the membrane in the annular zone between the wafer periphery and the membrane retainer ring minimizes the tilt angle of this outer annular zone. If the radial width of the annular free-span zone of the membrane is 1 inch and the vertical deflection of the wafer side of that zone is only 1 micron due to the wear-down polishing of the wafer surface, the resultant tilt angle of the annular membrane zone is insignificant. Correspondingly, the resultant changes in the lifting or pushing forces on the wafer periphery are insignificant.

The outboard edge of the free-span annular membrane that is located between the wafer and the membrane retainer ring is attached to the ring by mechanical clamps or adhesives or solvent bonding techniques. A minimal distance is provided between the bottom surface of the membrane in this annular zone and the moving surface of the abrasive coating on the platen. The flexible abrasive disk that is attached to the platen surface has a very uniform thickness so the top exposed surface of the moving abrasive is consistently at the same elevation. Also, the thicknesses of the wafers are consistently quite uniform at about 0.030 inches. The outer diameter annular free-span of the membrane is uniform in thickness so the attachment of the outer periphery of the membrane allows a controlled vertical gap to exist between the membrane and the moving abrasive.

All of the downward abrading pressure applied by the membrane to the wafer is confined to the area of the wafer by fluid abrading pressure that exists in a sealed abrading pressure chamber having the same approximate size as the flat surface of the wafer. The circular sealed abrading pressure chamber is formed in part by the flexible circular membrane and is located approximately concentric with the wafer that is attached to the flexible membrane.

The sealed abrading pressure chamber does not apply downward pressure directly on the outer free-span annular area of the membrane. The membrane in this annular zone has sufficient out-of-plane stiffness to prevent the membrane to droop within the zone where contact is made with the abrasive. The nominally small vertical gap between the body portions of the wafer carrier head and the moving abrasive is similar to the vertical gap used by conventional membrane-type wafer polishing heads.

The outer annular zone of the membrane can have an initial radial tensioning or the span tension can be neutral (no tension) or the membrane can be initially slack in this annular zone. A pre-tensioned membrane can provide extra-stiffness of the membrane in a radial direction but yet provide adequate flexibility in a perpendicular direction. A neutral-tensioned membrane provides minimal stiffness in a perpendicular direction but still provides stiffness in a radial direction. A slack membrane provides little perpendicular stiffness and little radial stiffness to the membrane initially but provides more stiffness to both when the wafer moves horizontally or laterally due to the applied abrading forces.

The present invention uses precision-thickness fixed-abrasive flexible disks having disk thickness variations of less than 0.0001 inches (3 microns) across the full annular bands of abrasive-coated raised islands to allow flat-surfaced contact with workpieces at very high abrading speeds. Use of a rotary platen vacuum flexible abrasive disk attachment system allows quick set-up changes where different sizes of abrasive particles and different types of abrasive material can be quickly attached to the flat platen surfaces.

Semiconductor wafers require extremely flat surfaces when using photolithography to deposit patterns of materials to form circuits across the full flat surface of a wafer. When theses wafers are abrasively polished between deposition steps, the surfaces of the wafers must remain precisely flat.

The same types of chemicals that are used in the conventional CMP pad polishing of wafers can also be used with this fixed-abrasive lapping or polishing system to enhance material removal rates. These liquid chemicals can be applied as a mixture with the coolant water that is used to cool both the wafers and the fixed abrasive coatings on the rotating abrading platen This mixture of coolant water and chemicals continually washes the abrading debris away from the abrading surfaces of the fixed-abrasive coated raised islands which prevents unwanted abrading contact of the abrasive debris with the abraded surfaces of the wafers.

Workpieces are often rotated at rotational speeds that are approximately equal to the rotational speeds of the platens to provide equally-localized abrading speeds across the full radial width of the platen annular abrasive when the workpiece spindles are rotated in the same rotation direction as the platens. To effectively use raised island abrasive disks at these very high abrading speeds, the disks must be precisely uniform in thickness and the rotating platen that the flexible disk is attached to must have a precision-flat surface.

The same types of abrading-process enhancing chemicals including ceria that are used in the conventional CMP polishing of wafers can be used with this abrasive lapping or polishing system. These liquid chemicals can be applied as a mixture with the coolant water that is used to cool both the wafers and the fixed abrasive coatings on the rotating abrading platen This mixture of coolant water and chemicals continually washes the abrading debris away from the abrading surfaces of the fixed-abrasive coated raised islands which prevents unwanted abrading contact of the abrasive debris with the abraded surfaces of the wafers. These same types of chemicals including ceria can also be mixed in liquid abrasive slurries that are also used to abrade or polish wafers.

The rotating wafer carrier heads having a flexible elastomeric vacuum-grooved wafer-attachment membrane can have an internal thin disk-shaped metal annular membrane support ring that is attached to the membrane. This annular membrane support ring restrains the membrane-attached wafer against flat-surfaced abrasive lateral forces acting tangentially along the flat abrasive coated surface of the rotating platen and also against abrading torsional forces. The membrane-attached wafer "floats" in a restrained position that is near-concentric with the rotating circular wafer carrier head without any force contact of the periphery of the rigid-material silicon wafer with a rigid retaining ring device. Chipping and degradation of the very expensive and fragile thin silicon wafer by having a peripheral edge in rolling contact with a rigid retainer ring is eliminated with the use of the membrane support ring. However, the radially restrained wafer moves freely in a vertical direction that is perpendicular to the plane of the circular wafer surface.

The annular support rings can be attached to the central portion of a carrier head vacuum-grooved elastomer flexible membrane approximately concentric to a semiconductor wafer that is attached to this membrane grooved bottom with vacuum. The thin flat-surfaced silicon wafer is very flexible in a vertical direction that is perpendicular to the plane of the wafer but is very rigid in a radial horizontal direction that is parallel to the plane of the wafer. Because both the wafer and the support ring are mutually attached to the wafer membrane and are near-concentric with each other, the planar structural stiffness of the wafer reinforces the planar structural stiffness of the support ring and the planar structural stiffness of the support ring reinforces the planar structural stiffness of the wafer. Lateral abrading forces that are applied to the horizontal abraded surface of the rotating wafer by the horizontal moving abrasive are transmitted to the rotating support ring that is restrained laterally.

Here, the radially-restrained annular steel support ring that is attached to the membrane restrains the membrane radially which, in turn, restrains the wafer that is attached to the membrane in a radial direction. When lateral abrading forces are applied on the wafer workpiece, the wafer is held nominally concentric with the rotating carrier head without requiring that the wafer peripheral edge having rolling contact with a rigid retraining ring. In addition, the wafer is restrained torsionally within the rotating carrier head without requiring that the wafer peripheral edge having rolling friction-coupled contact with a rigid retraining ring as the wafer is subjected to torsional abrading forces.

Both the thin wafer and the thin support ring are very flexible in a vertical direction that is perpendicular to the plane of the wafer. When controlled abrading air pressure is applied to the upper surface of the wafer attachment membrane located within a sealed chamber pressure chamber formed in part by the flexible membrane that contains the annular membrane support ring, both the annular support ring and the membrane flex and transmit this abrading pressure directly to the abraded surface of a wafer attached to the vacuum grooved membrane. Because the abrading pressure is uniform across the full upper surface of the wafer attachment membrane, it is transmitted through the thickness of the membrane wherein the abrading pressure is also applied uniformly across the full abraded surface of the wafer.

There is a substantial difference with this technique of restraining the wafer membrane by use of the membrane-attached annular thin metal membrane support ring and the wafer carrier heads in common use that have rigid retainer rings that are in rolling contact with the rigid and fragile silicon wafers. Wafers that are attached to the wafer carrier heads having wafer retainer rings tend to be positioned slightly off-center from the center of rotation of the rotating wafer carrier head during abrading procedures. This non-concentric wafer off-center position occurs because it is required that the circular wafer outside diameter must be slightly less than the inside diameter of the rigid retainer ring to allow the wafer to be freely inserted within the retainer ring prior to starting the wafer abrasive polishing procedure.

The differences in diameter between the wafer and retainer ring results in a nominal gap between the wafer periphery edge and the retainer ring around the circumference of the wafer. During the abrasive polishing procedure, lateral abrading forces that are applied by the moving abrasive urges the rotating flat surfaced rigid wafer outer peripheral edge into single-point rolling contact with the rigid wafer retainer ring. The structurally-weak rubber-like flexible elastomer membrane that the wafer is casually attached to, by flat-contact adhesion, distorts an incremental distance laterally along the flat surface of the abrasive due to the lateral abrading forces that are applied to the wafer.

During an abrasive polishing procedure, the wafer-edge rolling contact point is always located at a "far-downstream" position of the circular wafer at the location where the moving rotational platen abrasive surface "exits" the stationary-positioned flat abraded surface of the rotating wafer. As the wafer carrier head is rotated, the downstream wafer-edge contact point remains at a fixed position relative to the abrasive wafer polishing machine frame as the wafer carrier head rotates the wafer that is slightly off-set from the center of the stationary-positioned rotating wafer carrier head.

The attached circular wafer is not-precisely concentric with the wafer retainer ring because it is offset within the slightly-larger-diameter ring to establish the downstream rolling contact point that allows the rigid retainer ring to restrain the wafer that is attached to the structurally-weak elastomer membrane. However, this rolling contact point changes location on the circumference of both the circular wafer and the inner diameter of the rigid retainer ring as both are mutually rotated by the rotating wafer holder head. The rigid retainer ring applies a compressive force on the downstream rolling contact point on the planer-rigid silicon wafer as a reaction to the applied "upstream" lateral rotating platen tangential abrading forces. Upstream forces on the wafer are generally-located from the center-half portion of the wafer toward the direction of the platen abrasive that "approaches" the stationary-positioned rotating wafer as the platen rotates. Downstream forces on the wafer are generally-located from the center-half portion of the wafer toward the direction of the platen abrasive that "exits" the stationary-positioned rotating wafer as the platen rotates.

Rotational torque forces are also applied to the wafer as it is rotated when in abrading pressure friction contact with the platen abrasive. When large torsional forces are applied to the wafer, the wafer is prevented from slipping relate to the retainer head by friction that is present between the single rolling point of contact between the wafer and the retained ring. The flexible wafer-attachment elastomeric wafer-attachment elastomeric membrane has very little structural torsional stiffness so the nominally-flat membrane surface will tend to twist and "wrinkle" if the wafer is not rotationally-locked to the retainer ring by friction between the two at the rolling contact point. Any distortion of the flexible flat bottom surface of the wafer head wafer attachment membrane will tend to result in non-uniform flatness of the attached wafer that is weak and flexible in a direction that is perpendicular to the abraded plane of the wafer. Out-of-plane distortion of the wafer during an abrading procedure will tend to result in undesirable non-uniform abrasive polishing of the wafer abraded surface.

The thin annular membrane support ring can be restrained by the use of wires or spokes that protrude out radially from the elastomer membrane device and are attached to a torsional drive ring that is attached to the rotatable wafer carrier head. The radial spokes can be formed into patterns where the spokes are angled to each other to provide torsional rigidity for the vacuum-grooved membrane and the attached wafer. Radial slack can be provided along the individual lengths of the spokes to allow the wafer to freely move up and down vertically from the abrasive surface to compensate for wafer-thickness abrading wear. When the wafer translates a controlled incremental distance laterally due to abrading forces that are applied laterally to the wafer, the slack in the "upstream" location spokes disappears and these spokes become rigid under force tension and restrain the wafer from moving downstream as the wafer is rotated. At the same time, the slack in the "downstream" spokes increases. Because the slack in the downstream spokes is maintained as the wafer rotates, the wafer can move freely up and down vertically to compensate for changes in the wafer thickness as material is abrasively removed from the abraded surface of the wafer.

In another embodiment, the "floating" thin annular membrane support ring can be restrained and rotationally driven by the use of drive pins that are attached to the wafer carrier head. The pins penetrate through matching-location holes that are in the annular support ring that is attached to the wafer membrane. The circular or geometric pattern of the carrier head pins and the receptacle location-matching support ring drive holes are concentric with each other and both are also concentric with the axis of rotation of the wafer carrier head rotational drive shaft. The annular support ring floats a limited amount relative to the wafer carrier head as the annular support ring is attached to the flexible elastomer membrane that has limited-motion relative to the rigid wafer carrier head due to the flexibility of the elastomer membrane material of construction.

In an additional embodiment, drive pins that are attached to the membrane-floating thin metal membrane support ring can be engaged by matching-location drive-pin holes in the rotatable wafer carrier head. When the floating annular membrane support ring is rotationally driven by the pins, the pins and the membrane support ring restrain the wafer to be concentric with the axis of rotation of the wafer carrier head when the wafer is subjected to lateral abrading forces and also to torsional abrading forces. The wafer does not move laterally relative to the center of the carrier head as the carrier head is rotated. Furthermore, use of the membrane support ring drive pins eliminates the use of external radial spoke wires or the use of an annular elastomer diaphragm that extend radially outward from the membrane body to restrain the membrane body radially.

The thin annular membrane support ring can be attached to the flexible membrane by different techniques including: adhesives, mechanical attachment devices, heat-fusing the ring to a thermoplastic elastomeric membrane or by molding the annular ring into the body of the elastomeric membrane. Also, the flexible annular support ring can be configured to have non-annular shapes that include: circular, oval, triangular, square, rectangular, star, diamond, pentagon, octagon, hexagon and polygon shapes. These non-annular shapes can have one or more circular or non-circular open areas.

The annular membrane support ring can be constructed from materials including metals, spring steel, polymers, fiber or wire reinforced polymers, inorganic materials, organic materials and composite woven fiber impregnated polymers. The reinforcing fiber materials can include metals, carbon fibers, inorganic materials and organic materials. The annular membrane support ring is very flexible in a vertical direction that is perpendicular to the plane of the support ring but is very rigid in a radial horizontal direction that is parallel to the plane of the support ring.

The vacuum-grooved elastomer membrane wafer carrier head described here having single or multiple abrading pressure chambers can be retrofitted on existing prior art wafer polishing machines that have flexible elastomer membrane multiple-chamber wafer carrier heads with rigid wafer retainer rings. Use of these vacuum-grooved membrane heads eliminate chipping of expensive semiconductor wafer periphery edges by rolling contact of the wafers with the rigid wafer retainer rings. Large cost savings can be made by eliminating damage to the semiconductor wafers.

Vacuum-grooved elastomer wafer carrier heads can be used with liquid abrasive particle slurries and resilient CMP pads or they can be used with non-slurry water-cooled fixed abrasives disks or fixed abrasive roll-type sheets. They can also be used with raised-island fixed-abrasive disks having annular bands of abrasives. Because the raised-island fixed abrasives are water cooled, these vacuum-grooved wafer carrier heads can be used at higher abrading speeds with lowered production costs and higher productivity than the existing prior art wafer polishing machines.

Coolant water has a much lower viscosity than the liquid abrasive slurries. This lowers the abrading shearing forces that are applied on the wafer and the flexible elastomer membranes. In addition, the continuous distortion and spring-back of the resilient CMP pads which limits the abrading speed of the slurry-pad abrading system is avoided with the use of the water cooled fixed-abrasive systems.

DETAILED DESCRIPTION OF THE INVENTION

Figure 1:
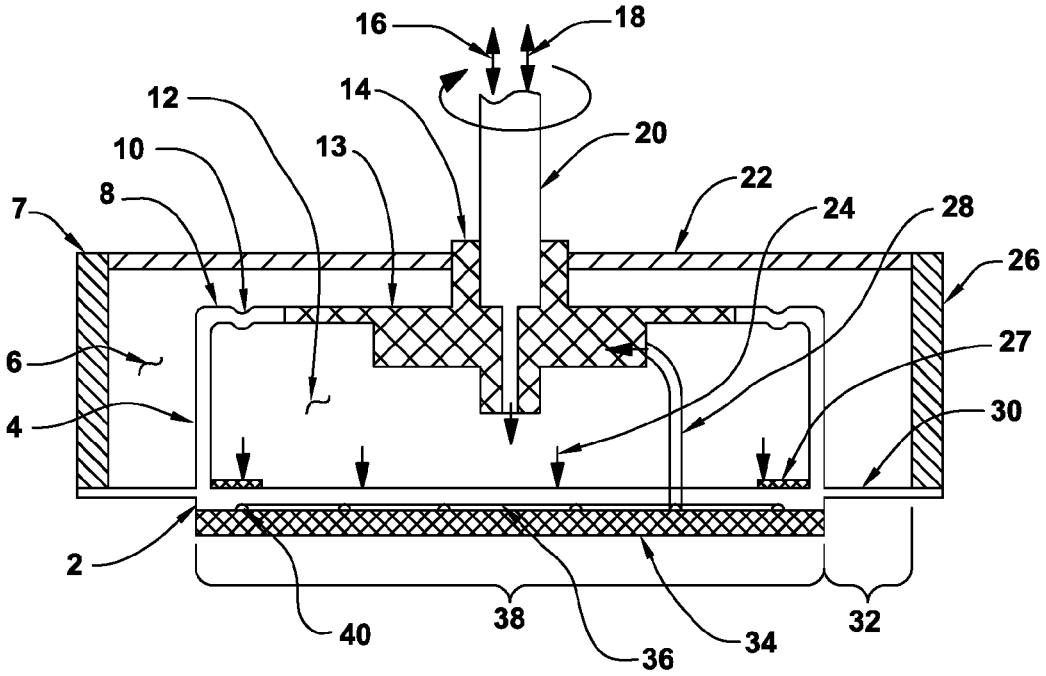
FIG. 1 is a cross section view of a membrane workpiece carrier rotation abrading device.

FIG. 1 is a cross section view of a flexible vacuum-grooved membrane workpiece carrier rotation abrading device having a flexible thin metal annular membrane support ring device which is used for lapping or polishing semiconductor wafers or other workpiece substrates. A rotatable workpiece carrier head 7 has a flat-surfaced workpiece 34 that is attached by vacuum to a floating workpiece carrier flexible elastomeric membrane 2 that is rotationally driven by an annular-wall device 26. A vertical rotatable hollow drive shaft 20 is supported by bearings (not shown) that are supported by a stationary-positioned rotatable carrier housing (not shown) where the rotatable carrier housing is adjustable in a vertical direction and is held stationary in a vertical position by an abrading machine frame (not shown). Rotational torque is supplied by the drive shaft 20 to an attached drive hub 14 that has an attached rotational drive device 22 that rotates the annular-wall device 26. Torque is transmitted from the annular-wall device 26 to a flexible membrane outer annular band 30 that is an integral extension of the flexible membrane 2 where the transmitted torque rotates both the flexible membrane 2 and the workpiece 34 that is attached to the flexible membrane 2. A flexible thin metal annular membrane support device 27 is attached to the flexible elastomeric membrane 2.

The workpiece carrier flexible elastomeric membrane 2 that has a nominally-horizontal integral outer annular band 30 and also has a nominally-vertical annular wall 4 that has a nominally-horizontal annular portion 8 that can have an annular indentation 10. The upper membrane wall annular portion 8 is attached to the hub annular extension 13 of the drive hub 14 where a sealed pressure chamber 12 is formed by the membrane 2, the annular wall 4, the hub annular extension 13 and the drive hub 14. Pressurized fluid or vacuum 16 can be applied to the sealed pressure chamber 12 via the hollow drive shaft 20 create an abrading pressure 24 that is transmitted to the workpiece 34 through the thickness of the flexible membrane 2.

The flexible membrane 2 having a flexible thin metal annular membrane support ring device 27 has a circular inner zone portion 38 and an integral outer annular band 30 annular portion 32 where the attached laterally-rigid semiconductor wafer workpiece 34 is firmly attached with vacuum to the flexible membrane 2 circular inner zone portion 38 which rigidizes the circular inner zone portion 38 of the membrane 2. Vacuum 18 is supplied through the hollow drive shaft 20 and through fluid passageways in the drive hub 14 to a flexible hollow tube 28 that is fluid-connected to grooved passageways 36, 40 in the exposed surface of the membrane 2. When a circular workpiece 34 is attached by the vacuum 18 to the membrane 2, the grooved vacuum passageways 36, 40 in the exposed surface of the membrane 2 are sealed by mutual flat-surfaced contact of the workpiece 34 and the membrane 2 circular inner zone portion 38.

The flexible elastomer membrane 2 circular inner zone portion 38 has a nominal thickness that ranges from 0.010 to 0.375 inches and the grooved vacuum passageways 36, 40 have a groove depth that ranges form 0.002 to 0.035 inches depending on the thickness of the membrane 2 circular inner zone portion 38. The cross-sectional shapes of the grooved vacuum passageways 36, 40 comprise half-circular, half-oval and rectangular shapes. Half-circular and half-oval cross-sectional shapes are preferred as the present continuous-curved shapes that are easy to clean with water or pressurized air to dislodge any accumulated abrading debris prior to attaching a "new" semiconductor wafer after an existing wafer has been abrasively polished.

Another annular non-pressurized vented chamber 6 surrounds the sealed pressure chamber 12. Pressurized fluid 18 can also be supplied to the flexible hollow tube 28 that is fluid-connected to grooved passageways 36, 40 in the exposed surface of the membrane 2 to provide fluid pressure to separate the workpiece 34 from the flexible membrane 2 upon completion of an abrading procedure. The flexible elastomeric membrane 2 flexible elastomeric integral outer annular band 30 annular portion 32 can flex in a vertical direction that is perpendicular to the nominally flat surface of the workpiece 34 which allows the workpiece 34 to move in a vertical direction when pressure or vacuum 16 is applied to the sealed pressure chamber 12. Flexible localized movement of the membrane 2 and its integral components, the annular wall 4, the annular portion 8 and the annular indentation 10 allow the workpiece 34 to assume flat-surfaced abrading contact with the flat surface of an abrasive coating (not shown) on a rotary flat-surfaced platen.

The flexible thin metal annular membrane support ring device 27 that is attached to the flexible elastomeric membrane 2 restrains the membrane 2 attached wafer workpiece 34 against flat-surfaced abrasive lateral forces acting tangentially along the flat abrasive coated surface of the rotating platen (not shown) and also against abrading torsional forces. The membrane 2 attached wafer 34 "floats" in a restrained position that is near-concentric with the rotating circular wafer carrier head 7 without any force contact of the periphery of the rigid-material silicon wafer 34 with a rigid retaining ring device (not shown). Chipping and degradation of the very expensive and fragile thin silicon wafer 34 by having a peripheral edge in rolling contact with a rigid retainer ring is eliminated with the use of the membrane support ring 27. The annular membrane support ring 27 is very flexible in a vertical direction that is perpendicular to the plane of the support ring 27 but is very rigid in a radial horizontal direction that is parallel to the plane of the support ring 27. However, the radially restrained wafer 34 moves freely in a vertical direction that is perpendicular to the plane of the circular wafer 34 surface.

The annular support rings 27 can be attached to the central portion of a carrier head 7 vacuum-grooved elastomer flexible membrane 2 approximately concentric to a semiconductor wafer 34 that is attached to this membrane 2 grooved bottom with vacuum. The thin flat-surfaced silicon wafer 34 is very flexible in a vertical direction that is perpendicular to the plane of the wafer but is very rigid in a radial horizontal direction that is parallel to the plane of the wafer 34. Because both the wafer 34 and the support ring 27 are mutually attached to the wafer membrane 2 and are near-concentric with each other, the planar structural stiffness of the wafer 34 reinforces the planar structural stiffness of the support ring 27 and the planar structural stiffness of the support ring 27 reinforces the planar structural stiffness of the wafer 34. Lateral abrading forces that are applied to the horizontal abraded surface of the rotating wafer 34 by the horizontal moving abrasive are transmitted to the rotating support ring 27 that is restrained laterally.

When controlled abrading air pressure 24 is applied to the upper surface of the wafer attachment membrane 2 located within a sealed chamber pressure chamber 12 formed in part by the flexible membrane 2 that contains the annular membrane support ring 27, both the annular support ring 27 and the membrane 2 flex and transmit this abrading pressure 24 directly to the abraded surface of a wafer 34 attached to the vacuum grooved membrane 2. Because the abrading pressure 24 is uniform across the full upper surface of the wafer attachment membrane 2, it is transmitted through the thickness of the membrane 2 wherein the abrading pressure 24 is also applied uniformly across the full abraded surface of the wafer 34.

The thin annular membrane support ring 27 can be restrained by the use of wires or spokes (not shown) that protrude out radially from the elastomer membrane 2 device and are attached to a torsional drive ring 26 that is attached to the rotatable wafer carrier head 7. The radial spokes can be formed into patterns where the spokes are angled to each other to provide torsional rigidity for the vacuum-grooved membrane 2 and the attached wafer 34. Radial slack can be provided along the individual lengths of the spokes to allow the wafer 34 to freely move up and down vertically from the abrasive surface to compensate for wafer 34 thickness abrading wear. When the wafer 34 translates a controlled incremental distance laterally, due to abrading forces that are applied laterally to the wafer 34, the slack in the "upstream" location spokes disappears and these spokes become rigid under force tension and restrain the wafer 34 from moving further downstream as the wafer 34 is rotated. At the same time, the slack in the "downstream" spokes increases. Because the slack in the downstream spokes is maintained as the wafer 34 rotates, the wafer 34 can move freely up and down vertically to compensate for changes in the wafer 34 thickness as material is abrasively removed from the abraded surface of the wafer 34.

The thin annular membrane support ring 27 can be attached to the flexible membrane 2 by different techniques and materials including: adhesives, mechanical attachment devices, heat-fusing the support ring 27 ring to a thermoplastic elastomeric membrane 2 or by molding the annular ring 27 into the body of the elastomeric membrane 2. Also, the flexible annular support ring 27 can be configured to have non-annular shapes (not shown) that include: circular, oval, triangular, square, rectangular, star, diamond, pentagon, octagon, hexagon and polygon shapes. These non-annular shapes can have one or more circular or non-circular open areas (not shown).

The annular membrane support ring 27 can be constructed from materials including: metals, spring steel, polymers, fiber or wire reinforced polymers, inorganic materials, organic materials and composite woven fiber impregnated polymers. The reinforcing fiber materials comprise: metals, carbon fibers, inorganic materials and organic materials.

The annular support rings 27 can be attached to the central portion of a carrier head 7 vacuum-grooved elastomer flexible membrane 2 approximately concentric to a semiconductor wafer 34 that is attached to this membrane 2 grooved bottom with vacuum. Lateral abrading forces that are applied to the horizontal abraded surface of the rotating wafer 34 by the horizontal moving abrasive are transmitted to the rotating support ring 27 that is restrained laterally in a horizontal direction.

Figure 2:
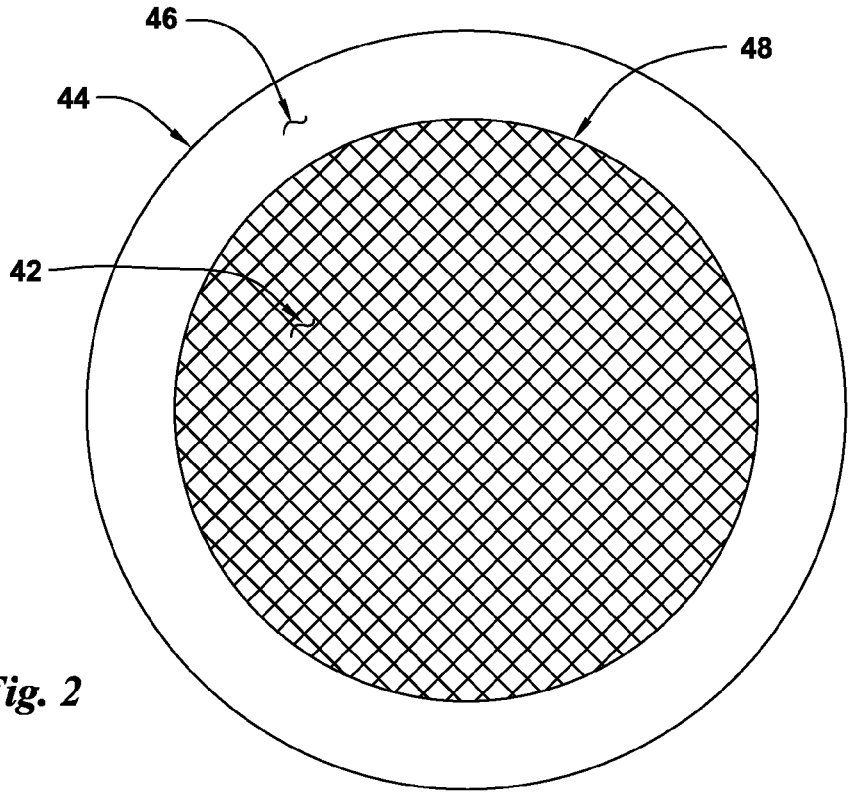
FIG. 2 is a top view of a membrane workpiece carrier rotation abrading device.

FIG. 2 is a top view of a FIG. 1 is a cross section view of a flexible membrane workpiece carrier rotation abrading device having a flexible thin metal annular membrane support ring device attached to the flexible membrane. A flexible elastomeric membrane 44 has a circular semiconductor wafer 48 attached to the central region 42 of the circular elastomeric membrane 44 having an attached flexible membrane support ring (not shown). The elastomeric membrane 44 also has an integral outer annular band 46 that is flexible in a direction that is perpendicular to the wafer 48 flat surface but is nominally stiff in a radial direction. The radial stiffness of the integral outer annular elastomeric band 46 and the membrane support ring maintains the circular wafer 48 nominally at the center of the circular elastomeric membrane 44 as the rotating wafer 48 is subjected to abrading forces by moving abrasive (not shown) that contacts the rotating wafer 48. Attachment of the radially-rigid wafer 48 to the flexible membrane 44 rigidizes the circular inner zone portion of the membrane 44.

Figure 3:
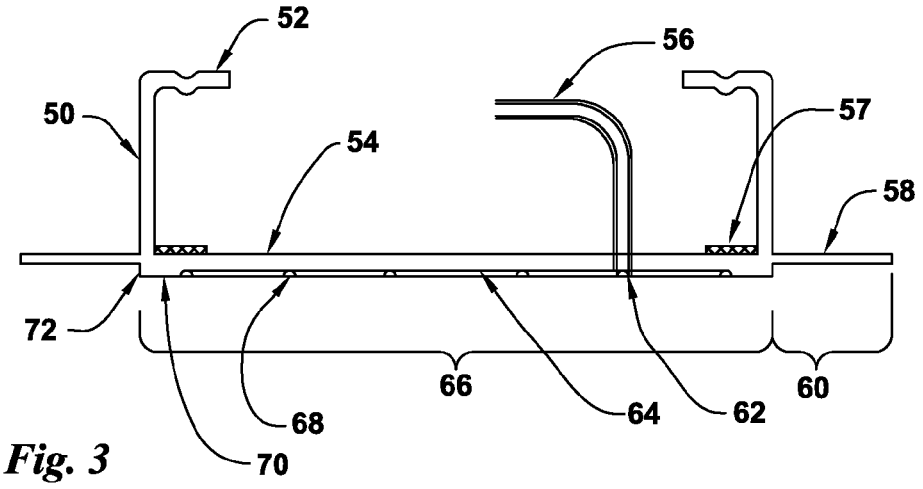
FIG. 3 is a cross section view of a workpiece carrier abrading device flexible membrane.

FIG. 3 is a cross section view of a workpiece carrier abrading device flexible membrane having a flexible thin metal annular membrane support ring device attached to the flexible membrane. A flexible elastomeric membrane 72 has a central region 66 and also has an integral outer annular band 58 outer region 60. Both the flexible elastomeric membrane 72 central region 66 and the integral outer annular band 58 outer region 60 are flexible in a direction that is perpendicular to the circular membrane 72 flat surface 70 but are nominally stiff in a radial direction. The elastomeric membrane 72 has an integral annular wall 50 that has an integral angled wall top 52 where the angled wall top 52 allows vertical motion of the annular wall 50 and the elastomeric membrane 72 when abrading pressure is applied to the inner surface 54 of the elastomeric membrane 72. A flexible membrane 72 flexible support ring 57 is attached to the membrane 72.

A flexible hollow tube 56 is attached to the elastomeric membrane 72 at the fluid joint 62 which allows vacuum or fluid pressure to be supplied to the grooved radial fluid passageways 64 that supply vacuum or fluid pressure to the grooved annular fluid passageways 68. Vacuum that is present in the grooved passageways 64, 68 attaches wafers or workpieces (not shown) to the flat bottom surface 70 of the elastomeric membrane 72 and fluid pressure present in the grooved passageways 64, 68 allows the wafers or workpieces to be separated from the flat bottom surface 70 of the elastomeric membrane 72.

Figure 4:
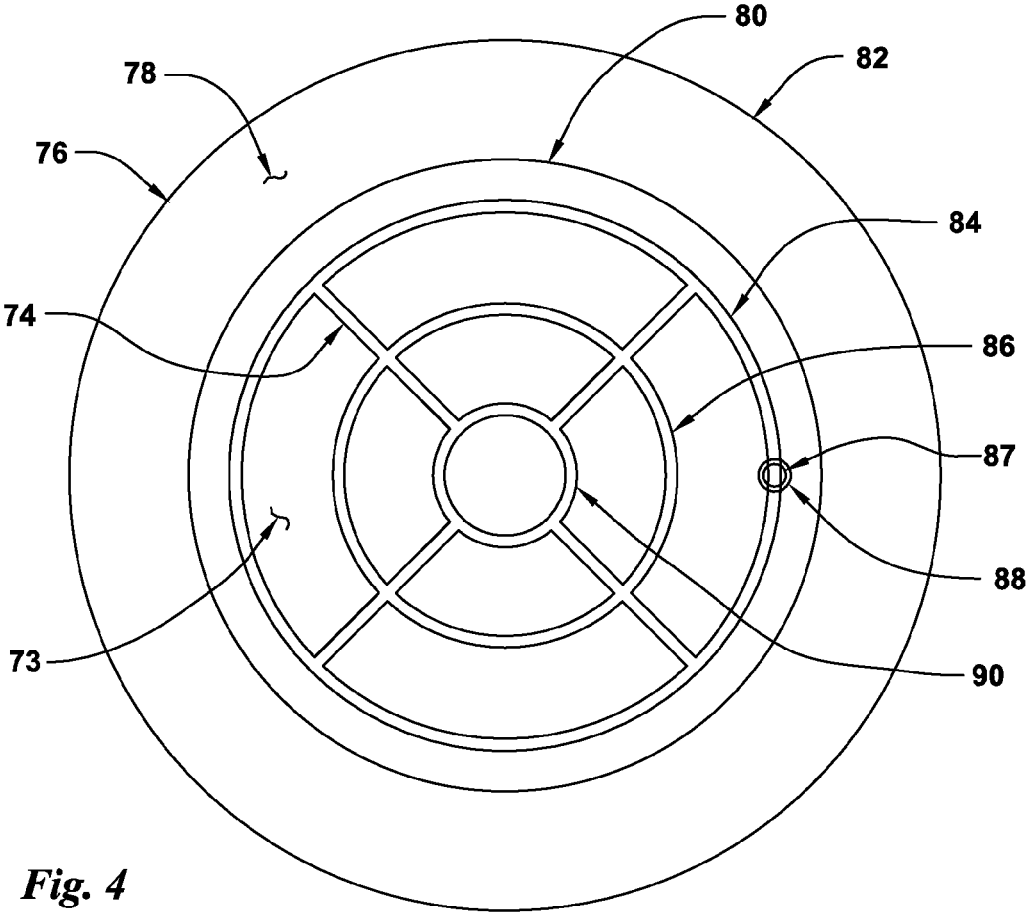
FIG. 4 is a top view of a vacuum-grooved workpiece carrier flexible membrane.

FIG. 4 is a top view of a workpiece carrier abrading device flexible membrane. A flexible elastomeric membrane 76 has a central region 80 and also has an integral outer annular band 82 outer region 78. Both the flexible elastomeric membrane 76 central region 80 and the integral outer annular band 82 outer region 78 are flexible in a direction that is perpendicular to the circular membrane 76 flat surface 73 but are nominally stiff in a radial direction.

A flexible hollow tube 87 is attached to the elastomeric membrane 76 at the fluid joint 88 which allows vacuum or fluid pressure to be supplied to both the grooved annular fluid passageways 84 and to the grooved radial fluid passageways 74. Vacuum that is present in the grooved passageways 74, 84 attaches wafers or workpieces (not shown) to the flat bottom surface 73 of the elastomeric membrane 76 and fluid pressure present in the grooved passageways 64, 68 allows the wafers or workpieces to be separated from the flat bottom surface 73 of the elastomeric membrane 76. The elastomeric membrane 76 is shown with three annular grooved open-type passageways 84, 86 and 90 where more or fewer annular grooved open-type passageways can be used to attach wafers or workpieces to the flat bottom surface 73 of the elastomeric membrane 76.

Figure 5:
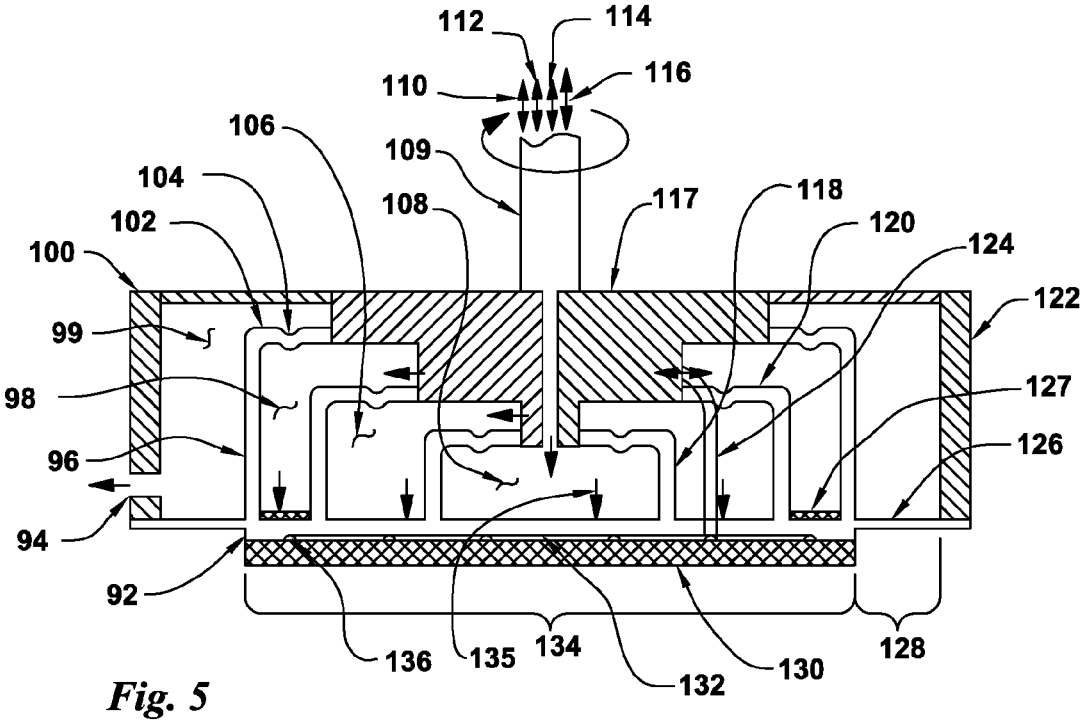
FIG. 5 is a cross section view of a workpiece carrier with multiple flexible membranes.

FIG. 5 is a cross section view of a flexible vacuum-grooved membrane wafer workpiece carrier having a flexible thin metal annular membrane support ring device with multiple pressure chambers. A flat-surfaced workpiece 130 is attached with vacuum to a nominally-horizontal floating workpiece carrier rotor 100 having a flexible membrane 92 that is rotationally driven by a drive hub 117 that is attached to a hollow drive shaft 109. A flexible membrane 92 flexible support ring 127 is attached to the membrane 92. The flexible thin metal annular membrane support ring device 127 that is attached to the flexible elastomeric membrane 92 is restrained by the workpiece carrier rotor 100 and restrains the membrane 92 attached wafer workpiece 130 against flat-surfaced abrasive lateral forces acting tangentially along the flat abrasive coated surface of the rotating platen (not shown) and also against abrading torsional forces.

Pressurized air or another fluid such as water 110, 112 and 114 or vacuum is supplied through the hollow drive shaft 109 that has fluid passages which allows multiple pressurized air or another fluid such as water 110, 112 and 114 to fill the independent sealed pressure chambers 98, 106 and 108 that are formed by the sealed annular flexible elastomer walls 118 and the elastomer membrane 92. Different controlled fluid 110, 112 and 114 pressures are present in each of the independent annular or circular sealed chambers 98, 106 and 108 to provide uniform abrading action across the full flat abraded surface of the workpiece 130 that is in abrading contact with the abrasive coating (not shown) on the rotary platen (not shown).

The flexible membrane 92 has a circular inner zone portion 134 and an integral outer annular band 126 annular portion 128 where the attached laterally-rigid semiconductor wafer workpiece 130 is firmly attached with vacuum to the flexible membrane 92 circular inner zone portion 134 which rigidizes the circular inner zone portion 134 of the membrane 92. Vacuum 116 is supplied through the hollow drive shaft 109 and through fluid passageways in the drive hub 117 to a flexible hollow tube 124 that is fluid-connected to grooved passageways 132, 136 in the exposed surface of the elastomeric membrane 92. When a circular workpiece 130 is attached by the vacuum 116 to the membrane 92, the grooved vacuum passageways 132, 136 in the exposed surface of the membrane 92 are sealed by mutual flat-surfaced contact of the workpiece 130 and the membrane 92 circular inner zone portion 134.

Vacuum or pressure can be supplied independently to the annular or circular sealed chambers 98, 106 and 108 and vacuum 116 can be provided through passageways in the drive hub 117 from a rotary fluid union (not shown). A flexible hollow tube 124 that is attached to the flexible elastomer membrane 92 can provide attachment of workpieces 130 to the central flexible bottom portion of the membrane 92 and fluid pressure can be applied to the flexible hollow tube 124 to separate the workpiece or wafer from the flexible elastomer membrane 92 upon completion of the procedure to abrasively lap, abrade or polish the wafer 130. A combination of vacuum or pressures in the individual chambers 98, 106 and 108 may be used to optimize the uniform abrading of the abraded surface of the workpieces 130. An outer annular chamber 99 has a vent hole 94 to prevent pressure variations in the chamber 99 as the other adjacent chambers 98, 106 and 108 are pressurized.

The elastomeric membrane 92 has integral annular walls 96 that have integral angled wall tops 102 where the angled wall tops 102 and optionally, angled wall top out-of plane distortions 104, allows vertical motion of the annular walls 96 and the elastomeric membrane 92 when abrading pressures 135 are applied to the inner surface of the elastomeric membrane 92. A rigid annular drive member 122 is attached to the drive hub 117 and is attached to the outer periphery of the elastomeric membrane 92 integral or attached flexible elastomeric outer annular band 126. Here, rotation of the rotatable hub 117 rotates the rigid annular drive member 122 and the attached elastomeric outer annular band 126 and the workpiece 130 that is attached by vacuum to the elastomeric membrane workpiece holder 92.

Figure 6:
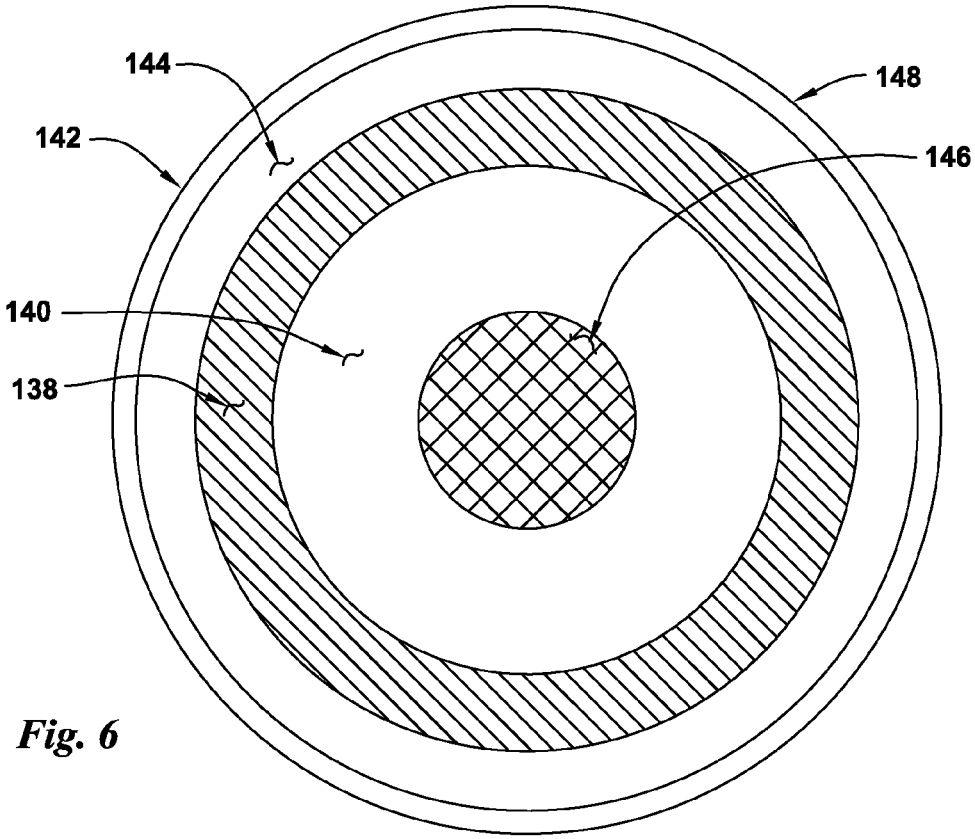
FIG. 6 is a top view of a workpiece carrier with multiple flexible membrane chambers.

FIG. 6 is a top view of a driven workpiece carrier with multiple pressure chambers. A elastomeric membrane flexible-bottom workpiece holder 142 has an annular outer abrading pressure zone 138, an annular inner abrading pressure zone 140 and a circular inner abrading pressure zone 146. The abrading pressure is independently controlled in each of the three zones 138, 140 and 146. The device shown here has three independent pressure zones but other device embodiments can have five or more independent pressure zones. The elastomeric membrane workpiece holder 142 has an integral or attached flexible elastomeric outer annular band 144 that is also attached to a rotatable hub 148 where rotation of the rotatable hub 148 rotates the elastomeric outer annular band 144 and the workpiece (not shown) that is attached by vacuum to the elastomeric membrane workpiece holder 142.

Figure 7:
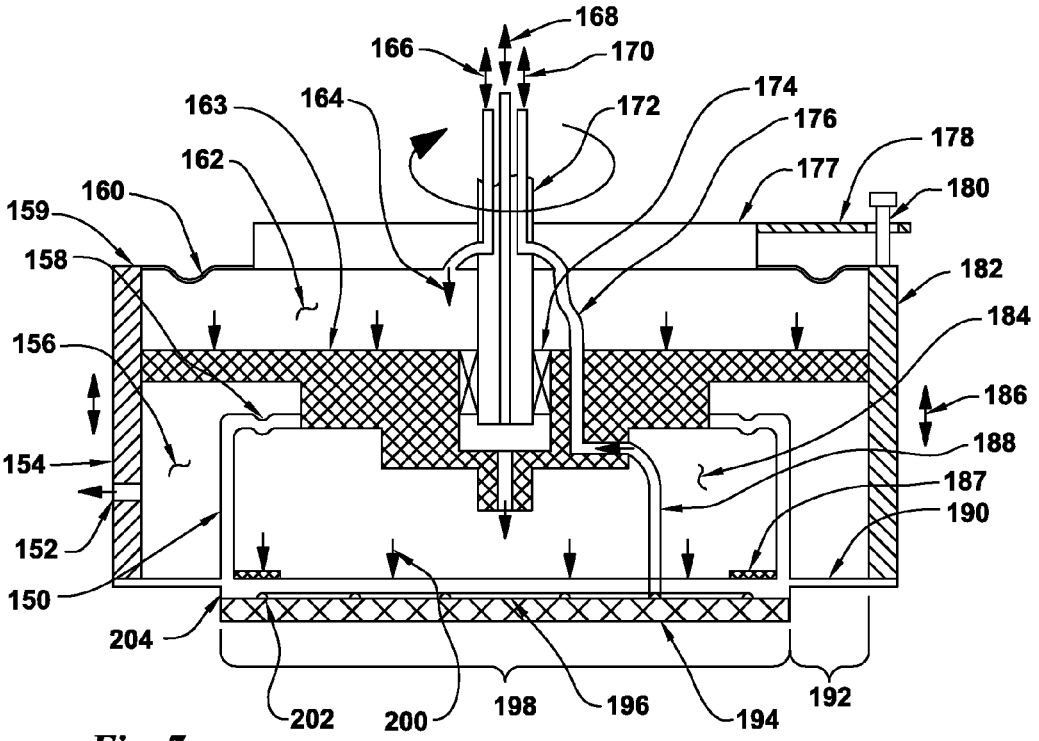
FIG. 7 is a cross section view of a pin-driven membrane workpiece carrier abrading device.

FIG. 7 is a cross section view of a pin-driven vacuum-grooved membrane workpiece carrier abrading device having a flexible thin metal annular membrane support ring device. A workpiece carrier head 159 has a flat-surfaced workpiece 194 that is attached to a slidable workpiece carrier rotor housing 154 attached flexible membrane 204 where the rotor housing 154 is rotationally driven by a drive-pin device 180. A nominally-horizontal drive plate 163 is supported by slidable shaft bearings 174 that are attached to a hollow drive shaft 172 where the carrier housing 154 can be raised and lowered in a vertical direction 186 by sliding in the bearings 174 along the hollow drive shaft 172. A flexible membrane 204 flexible support ring 187 is attached to the membrane 204. The flexible thin metal annular membrane support ring device 187 that is attached to the flexible elastomeric membrane 204 is restrained by the workpiece carrier rotor housing 154 and restrains the membrane 204 attached wafer workpiece 194 against flat-surfaced abrasive lateral forces acting tangentially along the flat abrasive coated surface of the rotating platen (not shown) and also against abrading torsional forces.

A rigid drive hub 177 that is attached to the hollow drive shaft 172 has an attached rotational drive arm 178 where rotation of the hollow drive shaft 172 rotates the rotational drive arm 178. The slidable drive-pin device 180 is attached a rigid annular member 182 that is attached to the rotor housing 154 and rotation of the drive arm 178 that is in sliding contact with the drive-pin device 180 causes the rotor housing 154 to rotate. An annular flexible diaphragm device 160 that is attached to the rigid drive hub 177 and to the rotor housing 154 forms a sealed pressure chamber 162 and the flexible diaphragm device 160 allows the slidable workpiece carrier rotor housing 154 to be translated vertically 186 along the rotational axis of the rotatable hollow drive shaft 172.

Fluid pressure or vacuum 166 can be supplied to fluid passageways in the rotatable hollow drive shaft 172 to create a pressure or vacuum 164 in the sealed pressure chamber 162 where the pressure 164 moves the carrier rotor housing 154 vertically downward and where vacuum 164 moves the carrier rotor housing 154 vertically upward.

The workpiece carrier head 154 has a flat-surfaced workpiece 194 that is attached by vacuum to a floating workpiece carrier flexible elastomeric membrane 204 that is rotationally driven by the rotor housing 154. The vertical rotatable hollow drive shaft 172 is supported by bearings (not shown) that are supported by a stationary-positioned rotatable carrier housing (not shown) where the rotatable carrier housing is adjustable in a vertical direction and is held stationary in a vertical position by an abrading machine frame (not shown). Rotational torque is supplied by the drive shaft 172 to rotate the annular-wall device 182 and the rotor housing 154. Torque is transmitted from the annular-wall device 182 to a flexible membrane outer annular band 190 that is an integral extension of the flexible membrane 204 where the transmitted torque rotates both the flexible membrane 204 and the workpiece 194 that is attached to the flexible membrane 204.

The workpiece carrier flexible elastomeric membrane 204 that has a nominally-horizontal integral outer annular band 190 also has a nominally-vertical annular wall 150 that has a nominally-horizontal annular portion 158 that can have an annular indentation. The upper membrane wall annular portion 158 is attached to the drive hub 163 where a sealed pressure chamber 184 is formed by the membrane 204, the annular wall 150, the annular portion 158 and the drive hub 163. Pressurized fluid or vacuum 168 can be applied to the sealed pressure chamber 184 via the hollow drive shaft 172 to create an abrading pressure 200 that is transmitted uniformly across the full abraded surface of the workpiece 194 through the thickness of the flexible membrane 204.

The flexible membrane 204 has a circular inner zone portion 198 and an integral outer annular band 190 annular portion 192 where the attached laterally-rigid semiconductor wafer workpiece 194 is firmly attached with vacuum to the flexible membrane 204 circular inner zone portion 198 which rigidizes the circular inner zone portion 198 of the membrane 204. Vacuum 170 is supplied through the hollow drive shaft 172 and through flexible fluid passageways 176 to the drive hub 163 to a flexible hollow tube 188 that is fluid-connected to grooved passageways 202 in the exposed surface of the membrane 204. When a circular workpiece 194 is attached by the vacuum 170 to the membrane 204, the grooved vacuum passageways 202 in the exposed surface of the membrane 204 are sealed by mutual flat-surfaced contact of the workpiece 194 and the membrane 204 circular inner zone portion 198.

Another annular non-pressurized vented chamber 156 having a vent hole 152 surrounds the sealed pressure chamber 184. Pressurized fluid 170 can also be supplied to the flexible hollow tube 188 that is fluid-connected to grooved passageways 202 in the exposed surface of the membrane 204 to provide fluid pressure to separate the workpiece 194 from the flexible membrane 204 upon completion of an abrading procedure. The flexible elastomeric membrane 204 flexible elastomeric integral outer annular band 190 annular portion 192 can flex in a vertical direction that is perpendicular to the nominally flat surface of the workpiece 194 which allows the workpiece 194 to move in a vertical direction when pressure or vacuum 168 is applied to the sealed pressure chamber 184. Flexible localized movement of the membrane 204 and its integral components, the annular wall 150 and the annular portion 158 allow the equivalent-floating workpiece 194 to assume conformal flat-surfaced abrading contact with the flat surface of an abrasive coating (not shown) on a rotary flat-surfaced platen (not shown).

Figure 8:
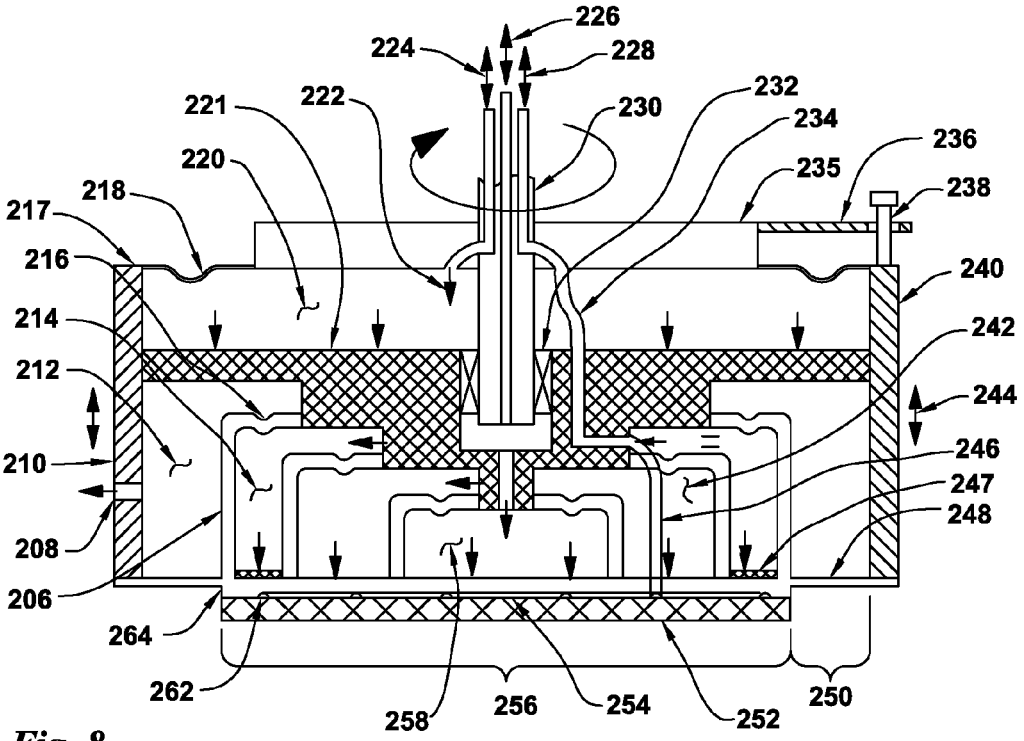
FIG. 8 is a cross section view of a pin-driven multiple-chamber workpiece carrier device.

FIG. 8 is a cross section view of a pin-driven multiple pressure chamber workpiece carrier device having a flexible thin metal annular membrane support ring device. A workpiece carrier head 217 has a flat-surfaced workpiece 252 that is attached to a slidable workpiece carrier rotor housing 210 attached flexible membrane 264 where the rotor housing 210 is rotationally driven by a drive-pin device 238. A nominally-horizontal drive plate 221 is supported by slidable shaft bearings 232 that are attached to a hollow drive shaft 230 where the carrier housing 210 can be raised and lowered in a vertical direction 244 by sliding in the bearings 232 along the hollow drive shaft 230. A flexible membrane 264 flexible support ring 247 is attached to the membrane 264. The flexible thin metal annular membrane support ring device 247 that is attached to the flexible elastomeric membrane 264 is restrained by the workpiece carrier rotor housing 210 and restrains the membrane 264 attached wafer workpiece 252 against flat-surfaced abrasive lateral forces acting tangentially along the flat abrasive coated surface of the rotating platen (not shown) and also against abrading torsional forces.

A rigid drive hub 235 that is attached to the hollow drive shaft 230 has an attached rotational drive arm 235 where rotation of the hollow drive shaft 230 rotates the rotational drive arm 236. The slidable drive-pin device 238 is attached a rigid annular member 240 that is attached to the rotor housing 210 and rotation of the drive arm 236 that is in sliding contact with the drive-pin device 238 causes the rotor housing 210 to rotate. An annular flexible diaphragm device 218 that is attached to the rigid drive hub 235 and to the rotor housing 210 forms a sealed pressure chamber 220 and the flexible diaphragm device 218 allows the slidable workpiece carrier rotor housing 210 to be translated vertically 244 along the rotational axis of the rotatable hollow drive shaft 230.

Fluid pressure or vacuum 224 can be supplied to fluid passageways in the rotatable hollow drive shaft 230 to create a pressure or vacuum 222 in the sealed pressure chamber 220 where the pressure 222 moves the carrier rotor housing 210 vertically downward and where vacuum 222 moves the carrier rotor housing 210 vertically upward.

The workpiece carrier head 210 has a flat-surfaced workpiece 252 that is attached by vacuum to a floating workpiece carrier flexible elastomeric membrane 264 that is rotationally driven by the rotor housing 210. The vertical rotatable hollow drive shaft 230 is supported by bearings (not shown) that are supported by a stationary-positioned rotatable carrier housing (not shown) where the rotatable carrier housing is adjustable in a vertical direction and is held stationary in a vertical position by an abrading machine frame (not shown). Rotational torque is supplied by the drive shaft 230 to rotate the annular-wall device 240 and the rotor housing 210. Torque is transmitted from the annular-wall device 240 to a flexible membrane outer annular band 248 that is an integral extension of the flexible membrane 264 where the transmitted torque rotates both the flexible membrane 264 and the workpiece 252 that is attached to the flexible membrane 264.

The workpiece carrier flexible elastomeric membrane 264 that has a nominally-horizontal integral outer annular band 248 also has a nominally-vertical annular wall 206 that has a nominally-horizontal annular portion 216 that can have an annular indentation. The upper membrane wall annular portion 216 is attached to the drive hub 221 where a sealed pressure chamber 242 is formed by the membrane 264, the annular wall 206, the annular portion 216 and the drive hub 221. Pressurized fluid or vacuum 226 can be applied to the sealed pressure chamber 242 via the hollow drive shaft 230 to create an abrading pressure 260 that is transmitted uniformly across the full abraded surface of the workpiece 252 through the thickness of the flexible membrane 264. Other of the multiple abrading pressure chambers are 214 and 258.

The flexible membrane 264 has a circular inner zone portion 256 and an integral outer annular band 248 annular portion 250 where the attached laterally-rigid semiconductor wafer workpiece 252 is firmly attached with vacuum to the flexible membrane 264 circular inner zone portion 256 which rigidizes the circular inner zone portion 256 of the membrane 264. Vacuum 228 is supplied through the hollow drive shaft 230 and through flexible fluid passageways 234 to the drive hub 221 to a flexible hollow tube 246 that is fluid-connected to grooved passageways 257, 262 in the exposed surface of the membrane 264. When a circular workpiece 252 is attached by the vacuum 228 to the membrane 264, the grooved vacuum passageways 257, 262 in the exposed bottom surface 254 of the membrane 264 are sealed by mutual flat-surfaced contact of the workpiece 252 and the membrane 264 circular inner zone portion 256.

Another annular non-pressurized vented chamber 212 having a vent hole 208 surrounds the sealed pressure chamber 242. Pressurized fluid 228 can also be supplied to the flexible hollow tube 246 that is fluid-connected to grooved passageways 257, 262 in the exposed surface of the membrane 264 to provide fluid pressure to separate the workpiece 252 from the flexible membrane 264 upon completion of an abrading procedure. The flexible elastomeric membrane 264 flexible elastomeric integral outer annular band 248 annular portion 250 can flex in a vertical direction that is perpendicular to the nominally flat surface of the workpiece 252 which allows the workpiece 252 to move in a vertical direction when pressure or vacuum 226 is applied to the sealed pressure chamber 242. Flexible localized movement of the membrane 264 and its integral components, the annular wall 206 and the annular portion 216 allow the equivalent-floating workpiece 252 to assume conformal flat-surfaced abrading contact with the flat surface of an abrasive coating (not shown) on a rotary flat-surfaced platen (not shown).

Figure 9:
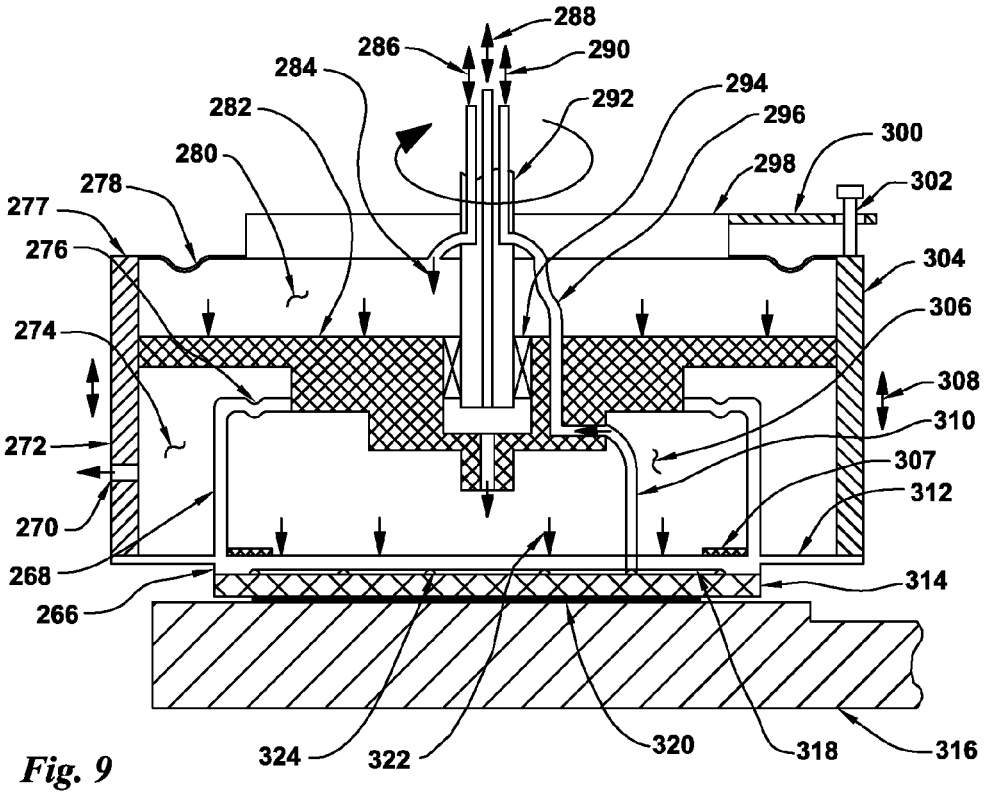
FIG. 9 is a cross section view of a membrane workpiece carrier with an abrasive platen.

FIG. 9 is a cross section view of a pin-driven vacuum-grooved flexible membrane workpiece carrier having a flexible thin metal annular membrane support ring device with a workpiece in abrading contact with an abrasive coated rotatable platen. The grooved-membrane carrier is used for flat-lapping hard material workpieces or polishing semiconductor wafers or other workpiece substrates such as sapphire substrates.

A workpiece carrier head 277 has a flat-surfaced workpiece 314 that is attached to a slidable workpiece carrier rotor housing 272 attached flexible membrane 266 where the rotor housing 272 is rotationally driven by a drive-pin device 302. A nominally-horizontal drive plate 282 is supported by slidable shaft bearings 294 that are attached to a hollow drive shaft 292 where the carrier housing 272 can be raised and lowered in a vertical direction 308 by sliding in the bearings 294 along the hollow drive shaft 292.

A flexible membrane 266 flexible support ring 307 is attached to the membrane 266. The flexible thin metal annular membrane support ring device 307 that is attached to the flexible elastomeric membrane 266 is restrained by the workpiece carrier rotor housing 272 and restrains the membrane 266 attached wafer workpiece 314 against flat-surfaced abrasive lateral forces acting horizontally in a tangential direction along the flat abrasive 320 coated surface of the rotating platen 316 and also against abrading torsional forces acting horizontally along the flat abrasive 320 coated surface of the rotating platen 316.

A rigid drive hub 298 that is attached to the hollow drive shaft 292 has an attached rotational drive arm 300 where rotation of the hollow drive shaft 292 rotates the rotational drive arm 300. The slidable drive-pin device 302 is attached a rigid annular member 304 that is attached to the rotor housing 272 and rotation of the drive arm 300 that is in sliding contact with the drive-pin device 302 causes the rotor housing 272 to rotate. An annular flexible diaphragm device 278 that is attached to the rigid drive hub 298 and to the rotor housing 272 forms a sealed pressure chamber 280 and the flexible diaphragm device 278 allows the slidable workpiece carrier rotor housing 272 to be translated vertically 308 along the rotational axis of the rotatable hollow drive shaft 292.

Fluid pressure or vacuum 286 can be supplied to fluid passageways in the rotatable hollow drive shaft 292 to create a pressure or vacuum 284 in the sealed pressure chamber 280 where the pressure 284 moves the carrier rotor housing 272 vertically downward and where vacuum 284 moves the carrier rotor housing 272 vertically upward.

The workpiece carrier head 272 has a flat-surfaced workpiece 314 that is attached by vacuum to a floating workpiece carrier flexible elastomeric membrane 266 that is rotationally driven by the rotor housing 272. The vertical rotatable hollow drive shaft 292 is supported by bearings (not shown) that are supported by a stationary-positioned rotatable carrier housing (not shown) where the rotatable carrier housing is adjustable in a vertical direction and is held stationary in a vertical position by an abrading machine frame (not shown). Rotational torque is supplied by the drive shaft 292 to rotate the annular-wall device 304 and the rotor housing 272. Torque is transmitted from the annular-wall device 304 to a flexible membrane outer annular band 312 that is an integral extension of the flexible membrane 266 where the transmitted torque rotates both the flexible membrane 266 and the workpiece 314 that is attached to the flexible membrane 266.

The flexible elastomeric membrane 266 flexible elastomeric integral outer annular band 312 can be constructed from individual wires or the outer annular band 312 can be constructed as a radially-stiff diaphragm comprising: fibers, filaments, strings, wires, cables, woven mats, non-woven fabric, polymers, and laminated materials. The outer annular band 312 is flexible in a direction that is nominally-perpendicular to the flexible membrane 266 nominally-flat bottom surface and is nominally-stiff in directions parallel to the flexible membrane 266 nominally-flat bottom surface.

The workpiece carrier flexible elastomeric membrane 266 that has a nominally-horizontal integral outer annular band 312 also has a nominally-vertical annular wall 268 that has a nominally-horizontal annular portion 276 that can have an annular indentation. The upper membrane wall annular portion 276 is attached to the drive hub 282 where a sealed pressure chamber 306 is formed by the membrane 266, the annular wall 268, the annular portion 276 and the drive hub 282. Pressurized fluid or vacuum 288 can be applied to the sealed pressure chamber 306 via the hollow drive shaft 292 to create an abrading pressure 322 that is transmitted uniformly across the full abraded surface of the workpiece 314 through the thickness of the flexible membrane 266.

The flexible membrane 266 has a circular inner zone portion and an integral outer annular band 312 annular portion where the attached laterally-rigid semiconductor wafer workpiece 314 is firmly attached with vacuum to the flexible membrane 266 circular inner zone portion which rigidizes the circular inner zone portion of the membrane 266. Vacuum 290 is supplied through the hollow drive shaft 292 and through flexible fluid passageways 296 to the drive hub 282 to a flexible hollow tube 310 that is fluid-connected to grooved passageways 318, 324 in the exposed surface of the membrane 266. When a circular workpiece 314 is attached by the vacuum 290 to the membrane 266, the grooved vacuum passageways 318, 324 in the exposed surface of the membrane 266 are sealed by mutual flat-surfaced contact of the workpiece 314 and the membrane 266 circular inner zone portion.

Another annular non-pressurized vented chamber 274 having a vent hole 270 surrounds the sealed pressure chamber 306. Pressurized fluid 290 can also be supplied to the flexible hollow tube 310 that is fluid-connected to grooved passageways 318, 324 in the exposed surface of the membrane 266 to provide fluid pressure to separate the workpiece 314 from the flexible membrane 266 upon completion of an abrading procedure. The flexible elastomeric membrane 266 flexible elastomeric integral outer annular band 312 annular portion can flex in a vertical direction that is perpendicular to the nominally flat surface of the workpiece 314 which allows the workpiece 314 to move in a vertical direction when pressure or vacuum 288 is applied to the sealed pressure chamber 306. Flexible localized movement of the membrane 266 and its integral components, the annular wall 268 and the annular portion 276 allow the equivalent-floating workpiece 314 to assume conformal flat-surfaced abrading contact with the flat surface of an abrasive coating 320 on a rotary flat-surfaced platen 316.

Figure 10:
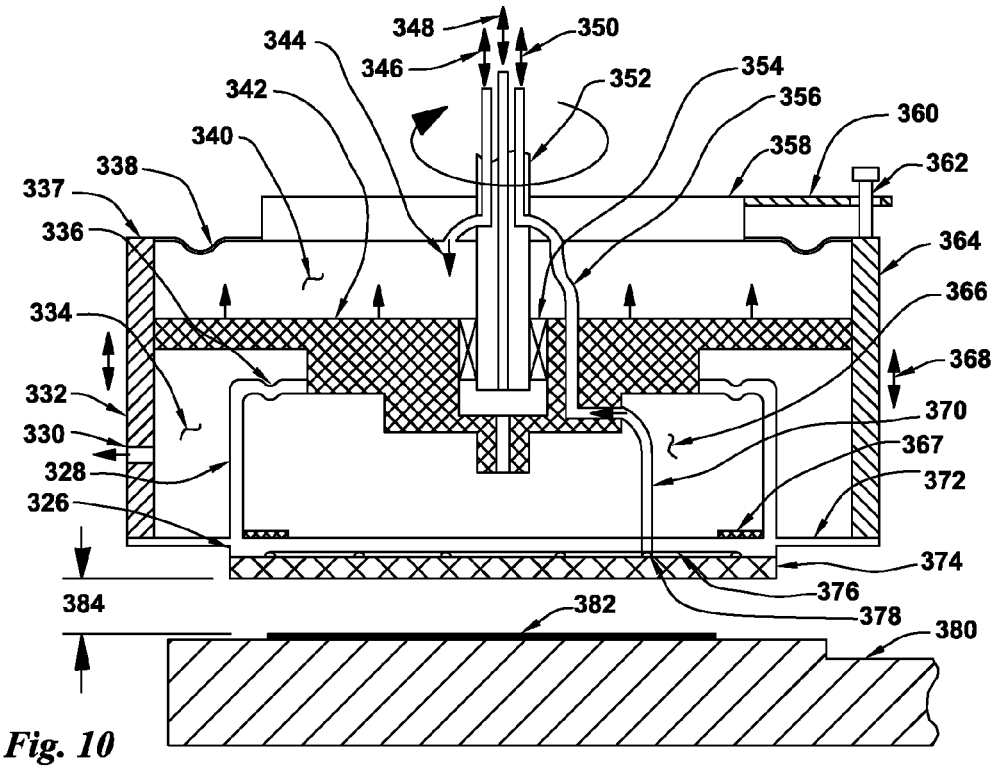
FIG. 10 is a cross section view of a membrane carrier with a workpiece raised from a platen.

FIG. 10 is a cross section view of a pin-driven vacuum-grooved flexible membrane workpiece carrier having a flexible thin metal annular membrane support ring device with a workpiece raised from abrading contact with an abrasive coated rotatable platen. A workpiece carrier head 337 has a flat-surfaced workpiece 374 that is attached to a slidable workpiece carrier rotor housing 332 attached flexible membrane 326 where the rotor housing 332 is rotationally driven by a drive-pin device 362. A nominally-horizontal drive plate 342 is supported by slidable shaft bearings 354 that are attached to a hollow drive shaft 352 where the carrier housing 332 can be raised and lowered in a vertical direction 368 by sliding in the bearings 354 along the hollow drive shaft 352.

A flexible membrane 326 flexible support ring 367 is attached to the membrane 326. The flexible thin metal annular membrane support ring device 367 that is attached to the flexible elastomeric membrane 326 is restrained by the workpiece carrier rotor housing 332 and restrains the membrane 326 attached wafer workpiece 374 against flat-surfaced abrasive lateral forces acting horizontally in a tangential direction along the flat abrasive 382 coated surface of the rotating platen 380 and also against abrading torsional forces acting horizontally along the flat abrasive 382 coated surface of the rotating platen 380.

A rigid drive hub 358 that is attached to the hollow drive shaft 352 has an attached rotational drive arm 360 where rotation of the hollow drive shaft 352 rotates the rotational drive arm 360. The slidable drive-pin device 362 is attached a rigid annular member 364 that is attached to the rotor housing 332 and rotation of the drive arm 360 that is in sliding contact with the drive-pin device 362 causes the rotor housing 332 to rotate. An annular flexible diaphragm device 338 that is attached to the rigid drive hub 358 and to the rotor housing 332 forms a sealed pressure chamber 340 and the flexible diaphragm device 338 allows the slidable workpiece carrier rotor housing 332 to be translated vertically 368 along the rotational axis of the rotatable hollow drive shaft 352.

Vacuum 346 can be supplied to fluid passageways in the rotatable hollow drive shaft 352 to create a vacuum 344 in the sealed pressure chamber 340 where the vacuum 344 moves the carrier rotor housing 332 vertically upward 368 and the workpiece 374 is raised a distance 384 from the surface of the abrasive 382 coating on the rotatable platen 380.

The workpiece carrier head 332 has a flat-surfaced workpiece 374 that is attached by vacuum to a floating workpiece carrier flexible elastomeric membrane 326 that is rotationally driven by the rotor housing 332. The vertical rotatable hollow drive shaft 352 is supported by bearings (not shown) that are supported by a stationary-positioned rotatable carrier housing (not shown) where the rotatable carrier housing is adjustable in a vertical direction and is held stationary in a vertical position by an abrading machine frame (not shown). Rotational torque is supplied by the drive shaft 352 to rotate the annular-wall device 364 and the rotor housing 332. Torque is transmitted from the annular-wall device 364 to a flexible membrane outer annular band 372 that is an integral extension of the flexible membrane 326 where the transmitted torque rotates both the flexible membrane 326 and the workpiece 374 that is attached to the flexible membrane 326.

The workpiece carrier flexible elastomeric membrane 326 that has a nominally-horizontal integral outer annular band 372 also has a nominally-vertical annular wall 328 that has a nominally-horizontal annular portion 336 that can have an annular indentation. The upper membrane wall annular portion 336 is attached to the drive hub 342 where a sealed pressure chamber 366 is formed by the membrane 326, the annular wall 328, the annular portion 336 and the drive hub 342.

The flexible membrane 326 has a circular inner zone portion and an integral outer annular band 372 annular portion where the attached laterally-rigid semiconductor wafer workpiece 374 is firmly attached with vacuum to the flexible membrane 326 circular inner zone portion which rigidizes the circular inner zone portion of the membrane 326. Vacuum 350 is supplied through the hollow drive shaft 352 and through flexible fluid passageways 356 to the drive hub 342 to a flexible hollow tube 370 that is fluid-connected to grooved passageways 376, 378 in the exposed surface of the membrane 326. When a circular workpiece 374 is attached by the vacuum 350 to the membrane 326, the grooved vacuum passageways 376, 378 in the exposed surface of the membrane 326 are sealed by mutual flat-surfaced contact of the workpiece 374 and the membrane 326 circular inner zone portion.

Another annular non-pressurized vented chamber 334 having a vent hole 330 surrounds the sealed pressure chamber 366. Pressurized fluid 350 can also be supplied to the flexible hollow tube 370 that is fluid-connected to grooved passageways 376, 378 in the exposed surface of the membrane 326 to provide fluid pressure to separate the workpiece 374 from the flexible membrane 326 upon completion of an abrading procedure. The flexible elastomeric membrane 326 flexible elastomeric integral outer annular band 372 annular portion can flex in a vertical direction that is perpendicular to the nominally flat surface of the workpiece 374 which allows the workpiece 374 to move in a vertical direction when pressure or vacuum 348 is applied to the sealed pressure chamber 366. Flexible localized movement of the membrane 326 and its integral components, the annular wall 328 and the annular portion 336 allow the equivalent-floating workpiece 374 to assume conformal flat-surfaced abrading contact with the flat surface of an abrasive coating 382 on a rotary flat-surfaced platen 380.

Figure 11:
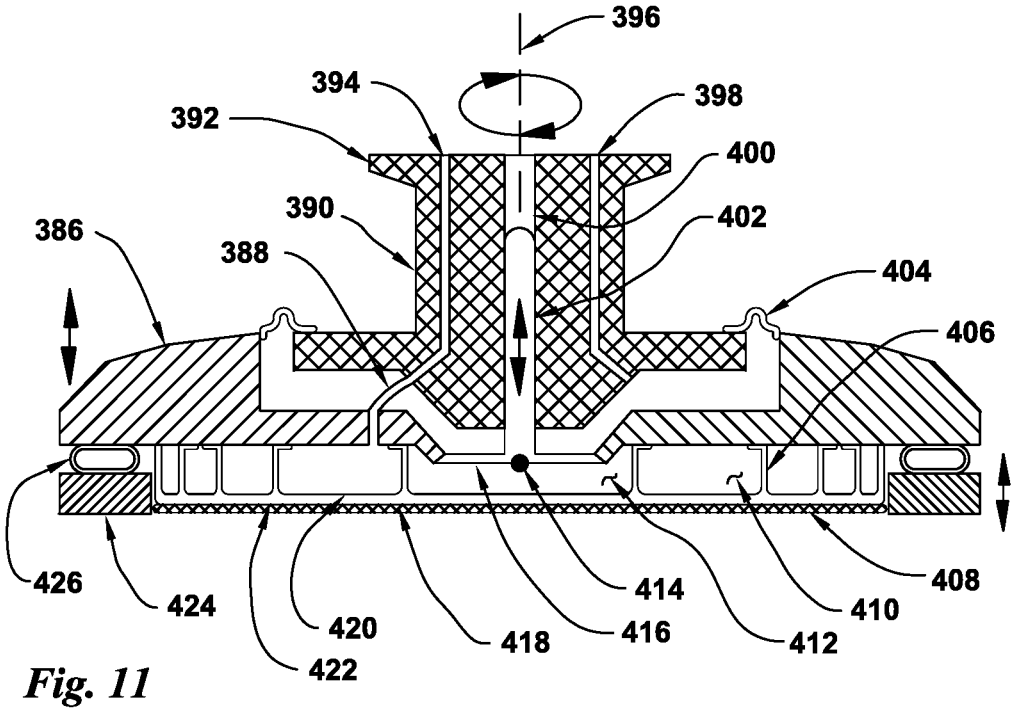
Fig. 11 Prior Art
FIG. 11 is a cross section view of a prior art pneumatic bladder type of wafer carrier.

FIG. 11 is a cross section view of a conventional prior art pneumatic bladder type of wafer carrier. A rotatable wafer carrier head 390 having a wafer carrier hub 392 is attached to the rotatable head (not shown) of a polishing machine tool (not shown) where the carrier hub 392 is loosely attached with flexible joint device 404 and a rigid slide-pin 402 to a rigid carrier plate 386. The cylindrical rigid slide-pin 402 can move along a cylindrical hole 400 in the carrier hub 392 which allows the rigid carrier plate 386 to move axially along the hole 400 where the movement of the carrier plate 386 is relative to the carrier hub 392. The rigid slide-pin 402 is attached to a flexible diaphragm 416 that is attached to carrier plate 386 which allows the carrier plate 386 to be spherically rotated about a rotation point 414 relative to the rotatable carrier hub 392 that is remains aligned with its rotational axis 396.

A sealed flexible elastomeric diaphragm device 420 has a number of individual annular sealed pressure chambers 410 having flexible elastomeric chamber walls 406 and a circular center chamber 412 where the air pressure can be independently adjusted for each of the individual chambers 410, 412 to provide different abrading pressures to a wafer workpiece 408 that is attached to the wafer mounting surface 422 of the elastomeric diaphragm 420. A wafer 408 carrier annular back-up ring 424 provides containment of the wafer 408 within the rotating but stationary-positioned wafer carrier head 390 as the wafer 408 abraded surface 418 is subjected to abrasion-friction forces by the moving abrasive (not shown) coated platen (not shown). An air-pressure annular bladder 426 applies controlled contact pressure of the wafer 408 carrier annular back-up ring 424 with the platen abrasive coating surface. Controlled-pressure air is supplied from air inlet passageways 394 and 398 in the carrier hub 392 to each of the multiple flexible pressure chambers 410, 412 by flexible tubes 388.

When CMP polishing of wafers takes place, a resilient porous CMP pad is saturated with a liquid loose-abrasive slurry mixture and is held in moving contact with the flat-surfaced semiconductor wafers to remove a small amount of excess deposited material from the top surface of the wafers. The wafers are held by a wafer carrier head that rotates as the wafer is held in abrading contact with the CMP pad that is attached to a rotating rigid platen. Both the carrier head and the pad are rotated at the same slow speeds.

The pneumatic-chamber wafer carrier heads typically are constructed with a flexible elastomer membrane that supports a wafer where five individual annular chambers allow the abrading pressure to be varied across the radial surface of the wafer. The rotating carrier head has a rigid hub and a floating wafer carrier plate that has a "spherical" center of rotation where the wafer is held in flat-surfaced abrading contact with a moving resilient CMP pad. A rigid wafer retaining ring that contacts the edge of the wafer is used to resist the abrading forces applied to the wafer by the moving pad.

There is a substantial difference with the technique described in the present invention of restraining the wafer membrane by use of the membrane-attached annular thin metal membrane support ring and the prior art wafer carrier heads 390 in common use that have rigid retainer rings 424 that are in rolling contact with the rigid and fragile silicon wafers 408. Wafers 408 that are attached to the wafer carrier heads 390 having wafer retainer rings 424 tend to be positioned slightly off-center from the center of rotation 396 of the rotating wafer carrier head 390 during abrading procedures. This non-concentric wafer 408 off-center position occurs because it is required that the circular wafer 408 outside diameter must be slightly less than the inside diameter of the rigid retainer ring 424 to allow the wafer 408 to be freely inserted within the retainer ring 424 prior to starting the wafer 408 abrasive polishing procedure.

The differences in diameter between the wafer 408 and retainer ring 424 results in a nominal gap between the wafer 408 periphery edge and the retainer ring 424 around the circumference of the wafer 408. During the abrasive polishing procedure, lateral abrading forces that are applied to the wafer 408 abraded surface 418 by the moving abrasive urges the rotating flat surfaced rigid circular wafer 408 outer peripheral edge into single-point rolling contact with the rigid wafer retainer ring 424. The structurally-weak rubber-like flexible elastomer membrane 420 that the wafer 408 is casually attached to, by flat-contact adhesion, distorts an incremental distance laterally along the flat surface of the abrasive due to the lateral abrading forces that are applied to the wafer 408.

During an abrasive polishing procedure, the wafer-edge rolling contact point is always located at a "far-downstream" position of the circular wafer 408 at the location where the moving rotational platen (not shown) abrasive surface "exits" the stationary-positioned flat abraded surface 418 of the rotating wafer 408. As the wafer carrier head 390 is rotated, the downstream wafer-edge contact point remains at a fixed position relative to the abrasive wafer 408 polishing machine frame (not shown). Here, the rotating wafer 408 remains slightly off-set from the center of the stationary-positioned rotating wafer carrier head 390 that is coincident with the rotatable carrier hub 392 rotational axis 396. However, this rolling contact point changes location on the circumference of both the circular wafer 408 and the inner diameter of the rigid retainer ring 424 as both are mutually rotated by the rotating wafer holder head 390.

The rigid retainer ring 424 applies a compressive force on the downstream rolling contact point on the planer-rigid silicon wafer 408 as a reaction to the applied "upstream" lateral rotating platen tangential abrading forces. Upstream forces on the wafer 408 are generally-located from the center-half portion of the wafer 408 toward the direction of the platen abrasive that approaches the stationary-positioned rotating wafer 408 as the platen rotates. Downstream forces on the wafer 408 are generally-located from the center-half portion of the wafer 408 toward the direction of the platen abrasive that exits the stationary-positioned rotating wafer 408 as the platen rotates.

Rotational torque forces are also applied to the wafer 408 as it is rotated when the wafer 408 abraded surface 418 is in abrading-pressure friction contact with the platen abrasive. When large torsional forces are applied to rotate the wafer 408, the wafer 408 is prevented from slipping relate to the wafer carrier head 390 by friction that is present between the single rolling point of contact between the wafer 408 and the retained ring 424. The flexible wafer-attachment elastomeric diaphragm membrane 420 has very little structural torsional stiffness so the nominally-flat membrane 420 wafer mounting surface 422 surface will tend to twist and "wrinkle" if the wafer 408 is not rotationally-locked to the retainer ring 424 by friction between the two at the rolling contact point. Any distortion of the flexible flat bottom surface 422 of the wafer head wafer attachment diaphragm membrane 420 will tend to result in non-uniform flatness of the attached wafer 408 that is weak and flexible in a direction that is perpendicular to the abraded plane of the wafer 408. Out-of-plane distortion of the wafer 408 during an abrading procedure will tend to result in undesirable non-uniform abrasive polishing of the wafer 408 abraded surface 418.

Figure 12:
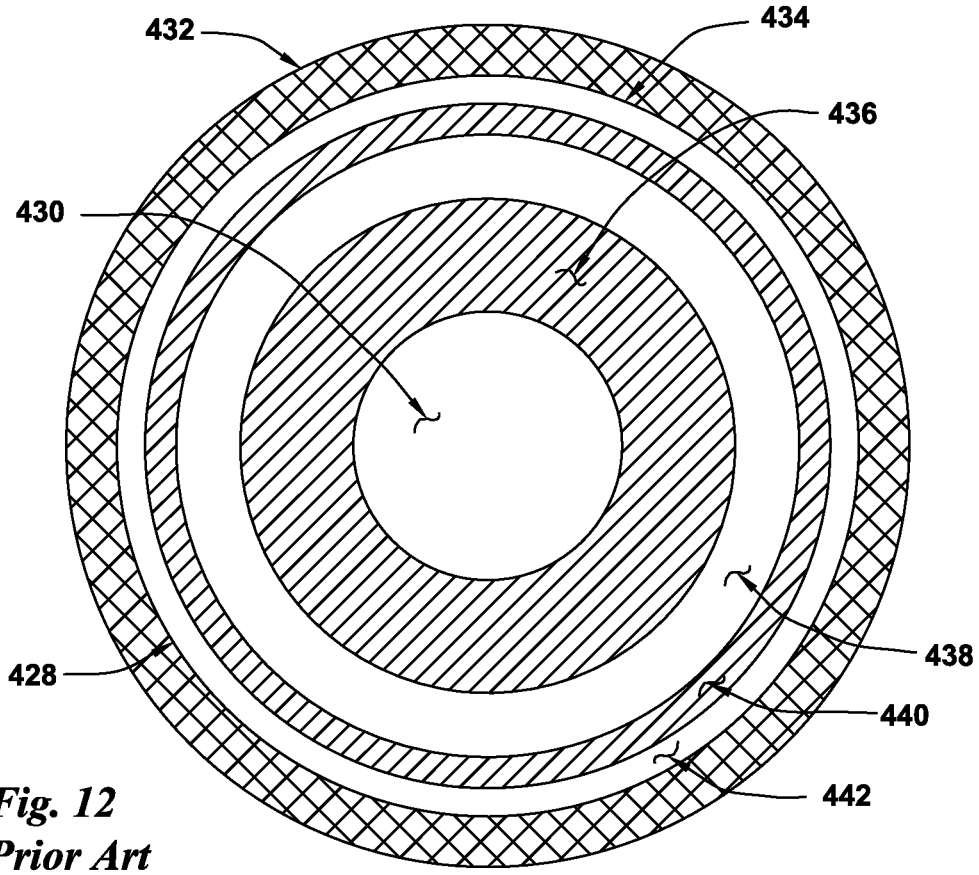
Fig. 12 Prior Art
FIG. 12 is a bottom view of a prior art pneumatic bladder type of wafer carrier.

FIG. 12 is a bottom view of a conventional prior art pneumatic bladder type of wafer carrier. A wafer carrier head 432 having an continuous nominally-flat surface elastomeric diaphragm 434 is shown having multiple annular pneumatic pressure chamber areas 436, 438, 440, 442 and one circular center pressure chamber area 430. The wafer carrier head 432 can have more or less than five individual pressure chambers. A wafer carrier head 432 annular back-up ring 428 provides containment of the wafer (not shown) within the wafer carrier head 432 as the wafer (not shown) that is attached to the continuous nominally-flat surface of the elastomeric diaphragm device 434 is subjected to abrasive friction forces. Here, the semiconductor wafer substrate is loosely attached to a flexible continuous-surface of a membrane that is attached to the rigid portion of the substrate carrier. Multiple pneumatic air-pressure chambers that exist between the substrate mounting surface of the membrane and the rigid portion of the substrate carrier are an integral part of the carrier membrane.

Each of the five annular pneumatic chambers shown here can be individually pressurized to provide different abrading pressures to different annular portions of the wafer substrate. These different localized abrading pressures are provided to compensate for the non-uniform abrading action that occurs with this wafer polishing system.

The flexible semiconductor wafer is extremely flat on both opposed surfaces. Attachment of the wafer to the carrier membrane is accomplished by pushing the very flexible membrane against the flat backside surface of a water-wetted wafer to drive out all of the air and excess water that exists between the wafer and the membrane. The absence of an air film in this wafer-surface contact are provides an effective suction-attachment of the wafer to the carrier membrane surface. Sometimes localized "vacuum pockets" are used to enhance the attachment of the wafer to the flexible flat-surfaced membrane.

Each of the five annular pressure chambers expand vertically when pressurized. The bottom surfaces of each of these chambers move independently from their adjacent annular chambers. By having different pressures in each annular ring-chamber, the individual chamber bottom surfaces are not in a common plane if the wafer is not held in flat-surfaced abrading contact with a rigid abrasive surface. If the abrasive surface is rigid, then the bottom surfaces of all of the five annular rings will be in a common plane. However, when the abrasive surface is supported by a resilient pad, each individual pressure chamber will distort the abraded wafer where the full wafer surface is not in a common plane. Resilient support pads are used both for CMP pad polishing and for fixed-abrasive web polishing.

Because of the basic design of the flexible membrane wafer carrier head that has five annular zones, each annular abrading pressure-controlled zone provides an "average" pressure for that annular segment. This constant or average pressure that exist across the radial width of that annular pressure chamber does not accurately compensate for the non-linear wear rate that actually occurs across the radial width of that annular band area of the wafer surface.

Overall, this flexible membrane wafer substrate carrier head is relatively effective for CMP pad polishing of wafers. Use of it with resilient CMP pads require that the whole system be operated at very low speeds, typically at 30 rpm. However, the use of this carrier head also causes many problems results in non-uniform material removal across the full surface of a wafer.

Figure 13:
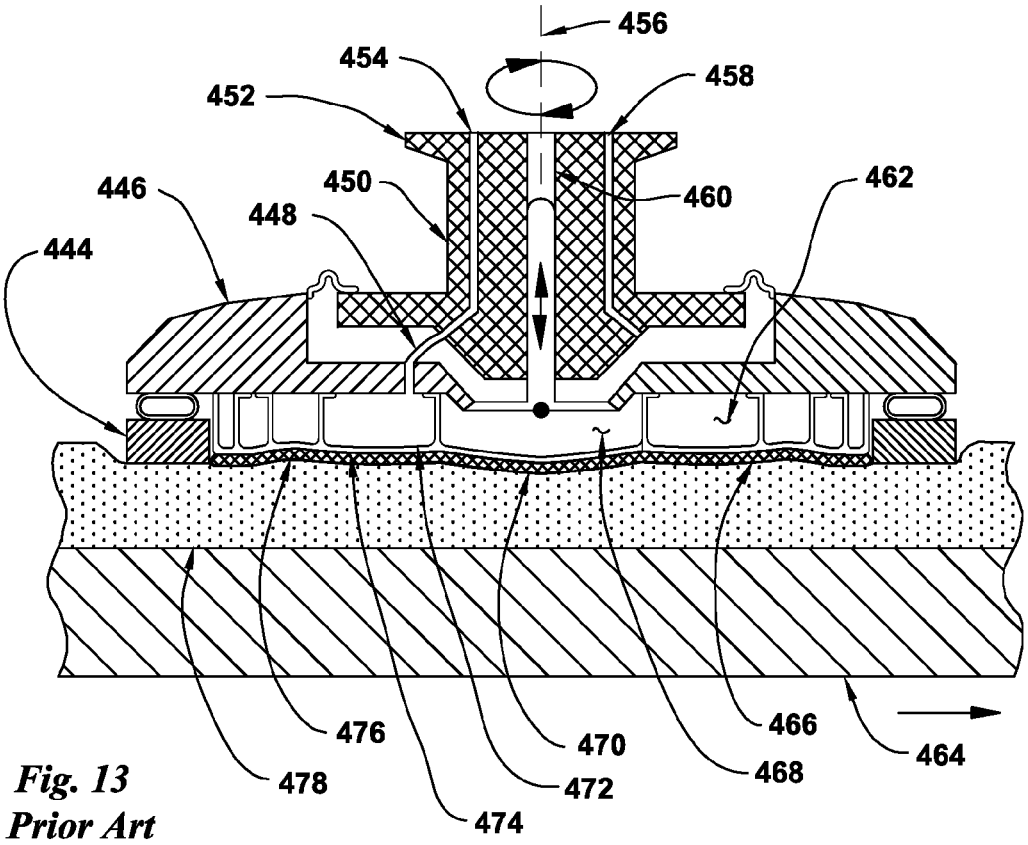
Fig. 13 Prior Art
FIG. 13 is a cross section view of a prior art bladder type of wafer carrier distorted bottom.

FIG. 13 is a cross section view of a prior art pneumatic bladder type of wafer carrier with a distorted bottom surface. A rotatable wafer carrier head 450 having a wafer carrier hub 452 is attached to the rotatable head (not shown) of a wafer polishing machine tool (not shown) where the carrier hub 452 is loosely attached with flexible joint devices and a rigid slide-pin to a rigid carrier plate 446. The cylindrical rigid slide-pin can move along a cylindrical hole 460 in the carrier hub 452 which allows the rigid carrier plate 446 to move axially along the hole 460 where the movement of the carrier plate 446 is relative to the carrier hub 452. The rigid slide-pin is attached to a flexible diaphragm that is attached to carrier plate 446 which allows the carrier plate 446 to be spherically rotated about a rotation point relative to the rotatable carrier hub 452 that is remains aligned with its rotational axis 456.

A sealed flexible elastomeric diaphragm device 472 having a nominally-flat but flexible wafer 466 mounting surface 474 has a number of individual annular sealed pressure chambers 462 and a circular center chamber 468 where the air pressure can be independently adjusted for each of the individual chambers 462, 468 to provide different abrading pressures to a wafer workpiece 466 that is attached to the wafer mounting surface 474 of the elastomeric diaphragm 472. A wafer 466 carrier annular back-up ring 444 provides containment of the wafer 466 within the rotating but stationary-positioned wafer carrier head 450 as the wafer 466 abraded surface 476 is subjected to abrasion-friction forces by the moving abrasive coated platen (not shown). An air-pressure annular bladder applies controlled contact pressure of the wafer 466 carrier annular back-up ring 444 with the platen abrasive coating surface. Controlled-pressure air is supplied from air inlet passageways 454 and 458 in the carrier hub 452 to each of the multiple flexible pressure chambers 462, 468 by flexible tubes 448.

When air, or other fluids such as water, pressures are applied to the individual sealed pressure chambers 462, 468, the flexible bottom wafer mounting surface 474 of the elastomeric diaphragm 472 is deflected different amounts in the individual annular or circular bottom areas of the sealed pressure chambers 462, 468 where the nominally-flat but flexible wafer 466 is distorted into a non-flat condition as shown by 470 as the wafer 466 is pushed downward into the flexible and resilient CMP pad 478 which is supported by a rigid rotatable platen 464.

When the multi-zone wafer carrier is used to polish wafer surfaces with a resilient CMP abrasive slurry saturated polishing pad, the individual annular rings push different annular portions of the wafer into the resilient pad. Each of the wafer carrier air-pressure chambers exerts a different pressure on the wafer to provide uniform material removal across the full surface of the wafer. Typically the circular center of the wafer carrier flexible diaphragm has the highest pressure. This high-pressure center-area distorts the whole thickness of the wafer as it is forced deeper into the resilient CMP wafer pad. Adjacent annular pressure zones independently distort other portions of the wafer.

Here, the wafer body is substantially distorted out-of-plane by the independent annual pressure chambers. However, the elastomer membrane that is used to attach the wafer to the rotating wafer carrier is flexible enough to allow the individual pressure chambers to flex the wafer while still maintaining the attachment of the wafer to the membrane. As the wafer body is distorted, the distorted and moving resilient CMP pad is thick enough to allow this out-of-plane distortion to take place while providing polishing action on the wafer surface.

When a wafer carrier pressure chamber is expanded downward, the chamber flexible wall pushes a portion of the wafer down into the depths of the resilient CMP pad. The resilient CMP pad is compressible and acts as an equivalent series of compression springs. The more that a spring is compressed, the higher the resultant force is. The compression of a spring is defined as $F=KX$ where F is the spring force, K is the spring constant and X is the distance that the end of the spring is deflected.

The CMP resilient pads have a stiffness that resists wafers being forced into the depths of the pads. Each pad has a spring constant that is typically linear. In order to develop a higher abrading pressure at a localized region of the flat surface of a wafer, it is necessary to move that portion of the wafer down into the depth of the compressible CMP pad. The more that the wafer is moved downward to compresses the pad, the higher the resultant abrading force in that localized area of the wafer. If the spring-like pad is not compressed, the required wafer abrading forces are not developed.

Due to non-uniform localized abrading speeds on the wafer surface, and other causes such as distorted resilient pads, it is necessary to compress the CMP pad different amounts at different radial areas of the wafer. However, the multi-zone pressure chamber wafer carrier head has abrupt chamber-bottom membrane deflection discontinuities at the annular joints that exist between adjacent chambers having different chamber pressures. Undesirable wafer abrading pressure discontinuities exist at these membrane deflection discontinuity annular ring-like areas.

Often, wafers that are polished using the pneumatic wafer carrier heads are bowed. These bowed wafers can be attached to the flexible elastomeric membranes of the carrier heads. However, in a free-state, these bowed wafers will be first attached to the center-portion of the carrier head. Here, the outer periphery of the bowed wafer contacts the CMP pad surface before the wafer center does. Pressing the wafer into forced contact with the CMP pad allows more of the wafer surface to be in abrading contact with the pad. Using higher fluid pressures in the circular center of the carrier head chamber forces this center portion of the bowed wafer into the pad to allow uniform abrading and material removal across this center portion of the surface of the wafer. There is no defined planar reference surface for abrading the surface of the wafer.

Figure 14:
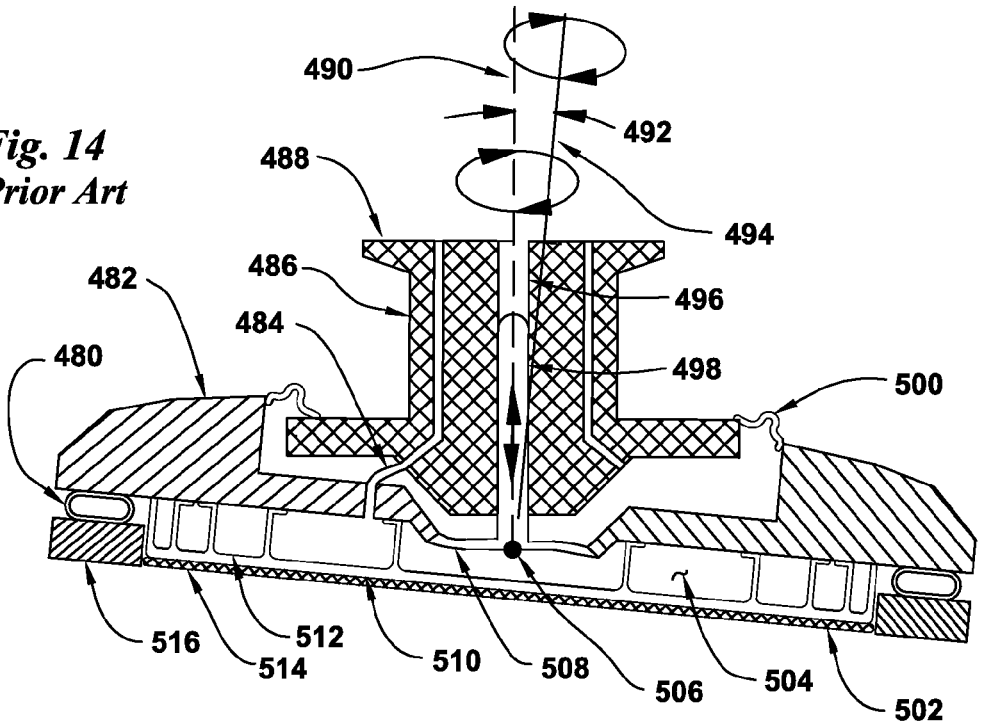
Fig. 14 Prior Art
FIG. 14 is a cross section view of a prior art bladder type of wafer carrier tilted wafer carrier.

FIG. 14 is a cross section view of a prior art pneumatic bladder type of wafer carrier head with a tilted wafer carrier. The pneumatic-chamber carrier head is made up of two internal parts to allow "spherical-action" motion of the floating annular plate type of substrate carrier that is supported by a rotating carrier hub. The floating substrate carrier plate is attached to the rotating drive hub by a flexible elastomeric or a flexible metal diaphragm at the top portion of the hub. This upper elastomeric diaphragm allows approximate-spherical motion of the substrate carrier to provide flat-surfaced contact of the wafer substrate with the "flat" but indented resilient CMP pad. The CM pad is saturated with a liquid abrasive slurry mixture.

To keep the substrate nominally centered with the rotating carrier drive hub, a stiff (or flexible) post is attached to a flexible annular portion of the rigid substrate carrier structure. This circular centering-post fits in a cylindrical sliding-bearing receptacle-tube that is attached to the rotatable hub along the hub rotation axis. When misalignment of the polishing tool (machine) components occurs or large lateral friction abrading forces tilt the carrier head, the flexible centering post tends to slide vertically along the length of the carrier head rotation axis. This post-sliding action and out-of-plane distortion of the annular diaphragm that is attached to the base of the centering posts together provide the required "spherical-action" motion of the rigid carrier plate. In this way, the surface of the wafer substrate is held in flat-surfaced contact with the nominal-flatness of the CMP pad as the carrier head rotates.

Here, the "spherical action" motion of the substrate carrier depends upon the localized distortion of the structural member of the carrier head. This includes diaphragm-bending of the flexible annular base portion of the rigid substrate carrier which the center-post shaft is attached to. All of these carrier head components are continuously flexed upon each rotation of the carrier head which often requires that the wafer substrate carrier head is typically operated at very slow operating speeds of only 30 rpm.

A rotatable wafer carrier head 486 having a wafer carrier hub 488 is attached to the rotatable head (not shown) of a polishing machine tool (not shown) where the carrier hub 488 is loosely attached with flexible joint device 500 and a rigid slide-pin 498 to a rigid carrier plate 482. The cylindrical rigid slide-pin 498 can move along a cylindrical hole 496 in the carrier hub 488 which allows the rigid carrier plate 482 to move axially along the hole 496 where the movement of the carrier plate 482 is relative to the carrier hub 488. The rigid slide-pin 498 is attached to a flexible diaphragm 508 that is attached to the carrier plate 482 which allows the carrier plate 482 to be spherically rotated about a rotation point 506 relative to the rotatable carrier hub 488 that is remains aligned with its rotational axis 346.

The carrier plate 482 is shown spherically rotated about a rotation point 506 relative to the rotatable carrier hub 488 where the slide-pin axis 490 is at a tilt-angle 492 with an axis 494 that is perpendicular with the wafer 502 abraded surface 510 and where the carrier plate 482 and the wafer 502 are shown here to rotate about the axis 494. The flexible diaphragm 508 that is attached to the carrier plate 482 is distorted when the carrier plate 482 is spherically rotated about a rotation point 506 relative to the rotatable carrier hub 488.

A sealed flexible elastomeric diaphragm device 512 has a number of individual annular sealed pressure chambers 504 and a circular center chamber where the air pressure can be independently adjusted for each of the individual chambers 504 to provide different abrading pressures to a wafer workpiece 502 that is attached to the wafer mounting surface 514 of the elastomeric diaphragm 512. A wafer 502 carrier annular back-up ring 516 provides containment of the wafer 502 within the rotating but stationary-positioned wafer carrier head 486 as the wafer 502 abraded surface 510 is subjected to abrasion-friction forces by the moving abrasive coated platen (not shown). An air-pressure annular bladder 480 applies controlled contact pressure of the wafer 502 carrier annular back-up ring 516 with the platen abrasive coating surface. Controlled-pressure air is supplied from air inlet passageways in the carrier hub 488 to each of the multiple flexible pressure chambers 504 by flexible tubes 484.

The pneumatic abrading pressures that are applied during CMP polishing procedures range from 1 to 8 psi. The downward pressures that are applied by the wafer retaining ring to push-down the resilient CMP pad prior to it contacting the leading edge of the wafer are often much higher than the nominal abrading forces applied to the wafer. For a 300 mm (12 inch) diameter semiconductor wafer substrate, that has a surface area of 113 sq. inches, an abrading force of 4 psi is often applied for polishing with a resilient CMP pad. The resultant downward abrading force on the wafer substrate is 4×113=452 lbs. An abrading force of 2 psi results in a downward force of 226 lbs.

The coefficient of friction between a resilient pad and a wafer substrate can vary between 0.5 and 2.0. Here, the wafer is plunged into the depths of the resilient CMP pad. A lateral force is applied to the wafer substrate along the wafer flat surface that is a multiple of the coefficient of friction and the applied downward abrading force. If the downward force is 452 lbs and the coefficient of friction is 0.5, then the lateral force is 226 lbs. If the downward force is 452 lbs and the coefficient of friction is 2.0, then the lateral force is 904 lbs. If a 2 psi downward force is 226 lbs and the coefficient of friction is 2.0, then the lateral force is 452 lbs.

When this lateral force of 226 to 904 lbs is applied to the wafer, it tends to drive the wafer against the rigid outer wafer retaining ring of the wafer carrier head. Great care is taken not to damage or chip the fragile, very thin and expensive semiconductor wafer due to this wafer-edge contact. This wafer edge-contact position changes continually along the periphery of the wafer during every revolution of the carrier head. Also, the overall structure of the carrier head is subjected to this same lateral force that can range from 226 to 904 lbs.

All the head internal components tend to tilt and distort when the head is subjected to the very large friction forces caused by forced-contact with the moving abrasive surface. The plastic components that the pneumatic head is constructed from have a stiffness that is a very small fraction of the stiffness of same-sized metal components. This is especially the case for the very flexible elastomeric diaphragm materials that are used to attach the wafers to the carrier head. These plastic and elastomeric components tend to bend and distort substantial amounts when they are subjected to these large lateral abrading friction forces.

The equivalent-vacuum attachment of a water-wetted wafer, plus the coefficient-of-friction surface characteristics of the elastomer membrane, are sufficient to successfully maintain the attachment of the wafer to the membrane even when the wafer is subjected to the large lateral friction-caused abrading forces. However, to maintain the attachment of the wafer to the membrane, it is necessary that the flexible elastomer membrane is distorted laterally by the friction forces to where the outer periphery edge of the wafer is shifted laterally to contact the wall of the rigid wafer substrate retainer ring. Because the thin wafer is constructed form a very rigid silicon material, it is very stiff in a direction along the flat surface of the wafer.

The rigid wafer outer periphery edge is continually pushed against the substrate retainer ring to resist the very large lateral abrading forces. This allows the wafer to remain attached to the flexible elastomer diaphragm flat surface because the very weak diaphragm flat surface is also pushed laterally by the abrading friction forces. Most of the lateral abrading friction forces are resisted by the body of the wafer and a small amount is resisted by the elastomer bladder-type diaphragm. Contact of the wafer edge with the retainer ring continually moves along the wafer periphery upon each revolution of the wafer carrier head.

Figure 15:
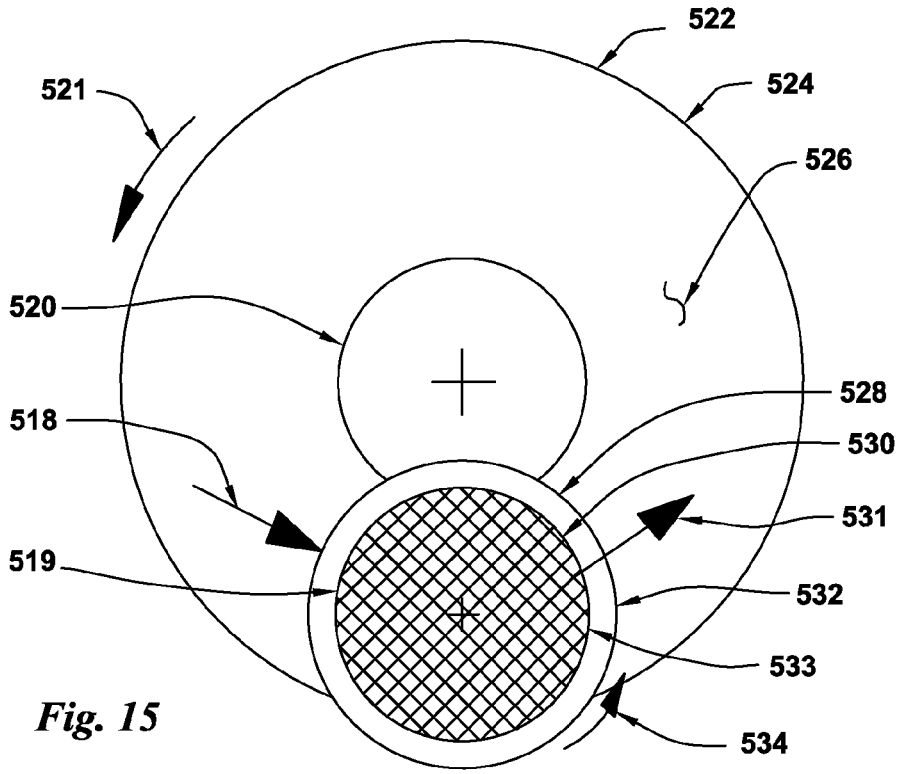
FIG. 15 is a top view of a membrane workpiece carrier and an abrasive coated platen.

FIG. 15 is a top view of a vacuum-grooved membrane workpiece carrier and an abrasive coated platen used for lapping or polishing semiconductor wafers or other workpiece substrates. A vacuum-grooved membrane workpiece carrier 528 has a flat-surfaced workpiece 530 that is attached with vacuum to the vacuum-grooved membrane 532 that is part of the workpiece carrier 528 that is rotationally driven. An abrasive disk 524 that has an annular band of abrasive 526 having an inner abrasive periphery 520 is attached to a rotating platen 522. The workpiece 530 overhangs both the inner and outer radii of the annular band 526 of fixed abrasive to provide uniform wear-down of both the annular band 526 of fixed abrasive and the abraded surface of the workpiece 530.

The workpiece 530 is rotated in a rotation direction 534 that is the same as the platen 522 rotation direction 521 and the workpiece 530 and the platen 522 are typically rotated at approximately at the same rpm rotation speeds as the workpiece 530 is in flat-surfaced abrading contact with the annular band of abrasive 526 o provide uniform wear-down of both the annular band 526 of fixed abrasive and the abraded surface of the workpiece 530. The moving abrasive 526 applies an "upstream" abrading force 518 on the shown upstream side 519 of the workpiece 530 as the platen 522 is rotated. Likewise, a "downstream" abrading force 531 on the shown downstream side 533 of the workpiece 530 as the platen 522 is rotated. When the platen 522 has a precision-flat surface and the water cooled fixed-abrasive raised-island disk 524 has a precisely uniform thickness over the full annular abrasive surface 526, the platen 522 can be rotated at very high speeds to provide high speed material removal from the surface of the workpiece 530 without hydroplaning of the workpiece 530.

Figure 16:
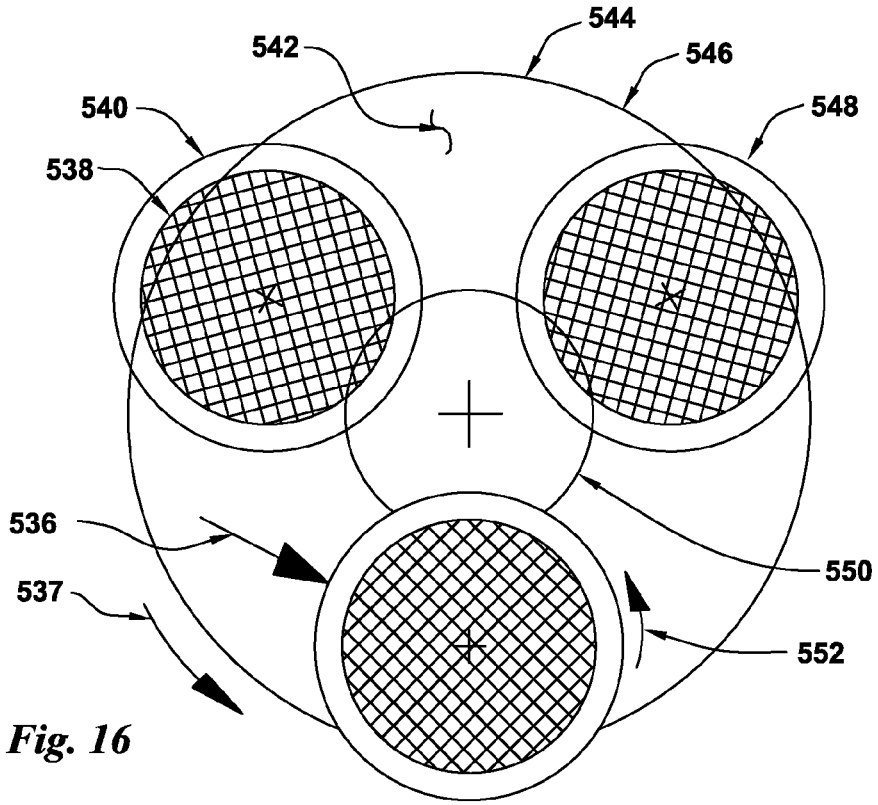
FIG. 16 is a top view of multiple membrane workpiece carriers and a abrasive coated platen.

FIG. 16 is a top view of multiple vacuum-grooved membrane workpiece carriers used with an abrasive coated platen to provide simultaneous lapping or polishing multiple semiconductor wafers or other workpiece substrates. Three vacuum-grooved membrane workpiece carriers 540 have flat-surfaced workpieces 538 that are attached with vacuum to the vacuum-grooved membranes 548 that are part of the workpiece carriers 540 that are rotationally driven. An abrasive disk 546 that has an annular band of abrasive 542 having an inner abrasive periphery 550 is attached to a rotating platen 544. The workpieces 538 overhang both the inner and outer radii of the annular band 542 of fixed abrasive to provide uniform wear-down of both the annular band 542 of fixed abrasive and the abraded surface of the workpieces 538.

The workpieces 538 are rotated in a rotation direction 552 that is the same as the platen 544 rotation direction 537 and the workpieces 538 and the platen 544 are typically rotated at approximately at the same rpm rotation speeds as the workpieces 538 are in flat-surfaced abrading contact with the annular band of abrasive 542 o provide uniform wear-down of both the annular band 542 of fixed abrasive and the abraded surfaces of the workpieces 538. The moving abrasive 542 applies an abrading force 536 on the shown upstream side of each of the workpieces 538 as the platen 544 is rotated. When the platen 544 has a precision-flat surface and the water cooled fixed-abrasive raised-island disk 546 has a precisely uniform thickness over the full annular abrasive surface 542, the platen 544 can be rotated at very high speeds to provide high speed material removal simultaneously from the surfaces of the workpieces 538 without hydroplaning of the workpieces 538.

Figure 17:
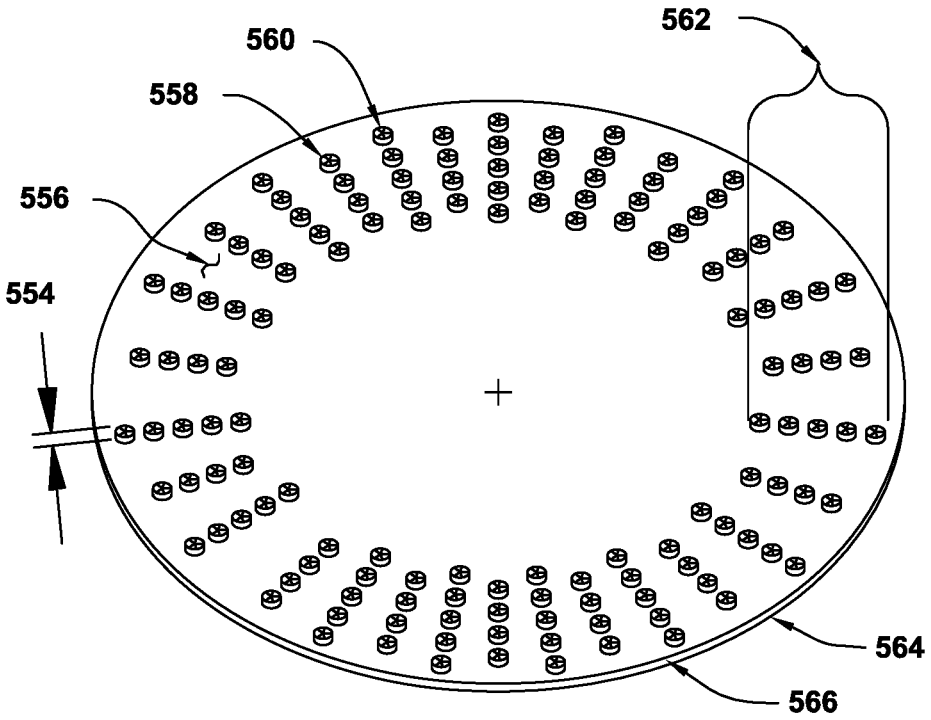
FIG. 17 is an isometric view of an abrasive disk with an annual band of raised islands.

FIG. 17 is an isometric view of an abrasive disk with an annual band of raised islands. A flexible abrasive disk 564 has attached raised island structures 558 that are top-coated with abrasive particles 560 where the island structures 558 are attached to a disk 564 transparent or non-transparent backing 566. The raised-island disk 564 has annular bands of abrasive-coated 560 raised islands 558 where the annular bands have a radial width of 562. Each island 558 has a typical width 554. The islands 558 can be circular as shown here or can have a variety of shapes comprising radial bars (not shown) where the abrasive-coated 560 raised islands 558 allow the abrasive disks 564 to be used successfully at very high abrading speeds in the presence of coolant water without hydroplaning of the workpieces (not shown). There are channel gap openings 556 that exist on the abrasive disk 564 between the raised island structures 558.

For high speed flat lapping or polishing, the abrasive disk 564 has an overall thickness variation, as measured from the top of the abrasive-coated 560 raised islands 558 to the bottom surface of the abrasive disk backing 566, that is typically less than 0.0001 inches 0.254 micron). This abrasive disk 564 precision surface flatness is necessary to provide an abrasive coating that is uniformly flat across the full annular band abrading surface of the abrasive disk 564 which allows the abrasive disk 564 to be used at very high abrading speeds of 10,000 surface feet (3,048 m) per minute or more. These high abrading speeds are desirable as the workpiece material removal rate is directly proportional to the abrading speeds.

Figure 18:
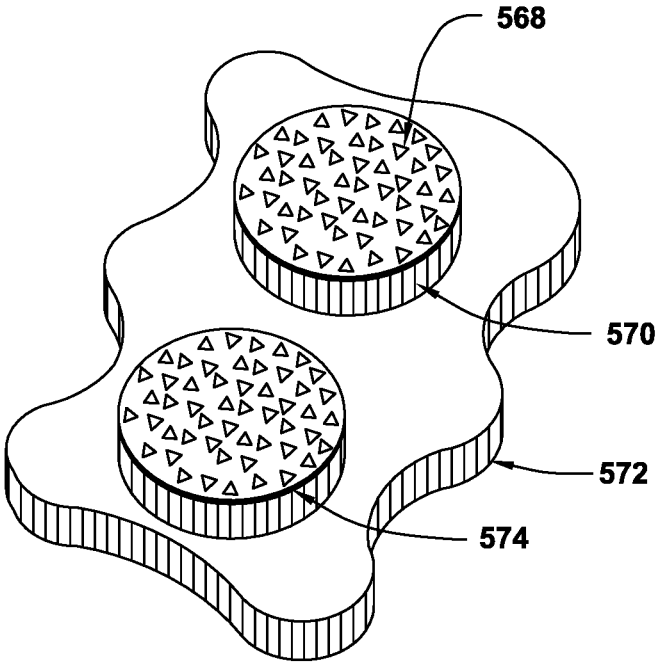
FIG. 18 is an isometric view of a portion of an abrasive disk with individual raised islands.

FIG. 18 is an isometric view of a portion of an abrasive disk with individual raised islands. A transparent or non-transparent backing sheet 572 has raised island structures 570 that are top-coated with a solidified abrasive-slurry layer mixture 574 which is filled with abrasive particles 568. The fixed-abrasive coating 574 on the raised islands 570 includes individual abrasive particles 568 or ceramic spherical beads (not shown) that are filled with very small diamond, cubic boron nitride (CBN) or aluminum oxide abrasive particles. The sizes of the abrasive particles 568 contained in the beads ranges from 60 microns to submicron sizes where the smaller sizes are typically used to polish semiconductor wafers.

The raised island structures 570 shown here are circular-shaped islands 570. Island shapes can have many different configurations including pie-shapes, diamond shapes, serpentine shapes and oval shapes. The width of the raised islands 570 is typically minimized in a direction that is tangential to a rotary platen (not shown) to minimize hydrodynamic lifting or hydroplaning of a wafer or workpiece (not shown) when it is polished at very high abrading speeds with the presence of coolant water on the surface of the raised islands 570. Used of fixed-abrasives for polishing wafers eliminates the mess of cleaning up wafers between sequential production steps when polishing wafers using liquid abrasive slurries having progressively smaller abrasive particle sizes.

Figure 19:
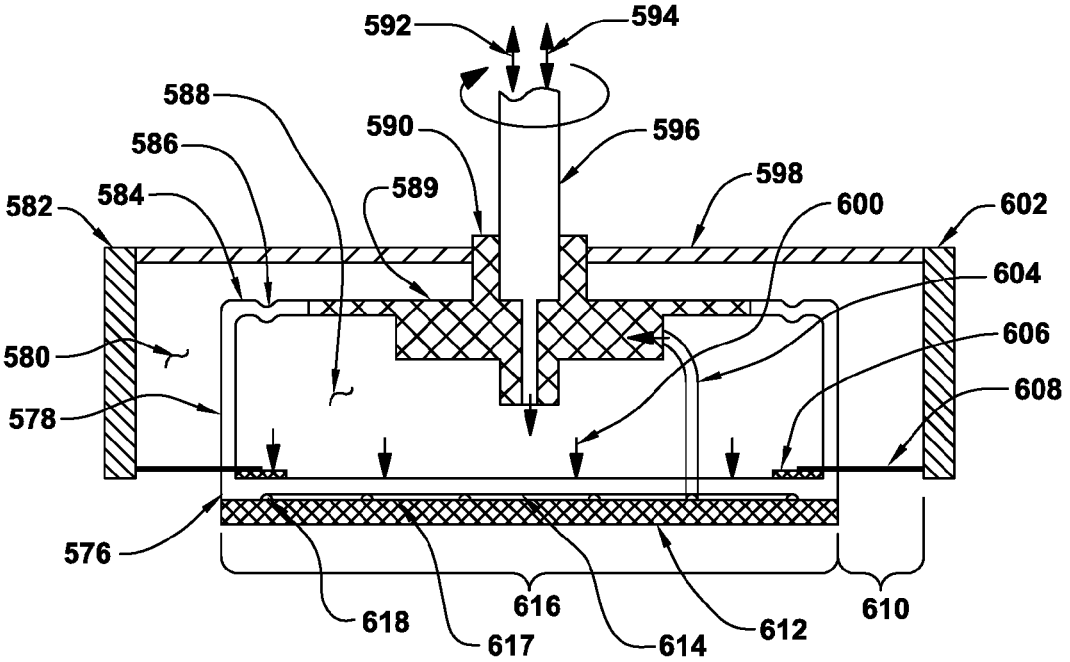
FIG. 19 is a cross section view of a workpiece carrier membrane reinforced annular ring.

FIG. 19 is a cross section view of a workpiece carrier vacuum-grooved membrane having a flexible thin metal annular membrane support ring device with a reinforced annular ring. A rotatable workpiece carrier head 582 has a flat-surfaced workpiece 612 that is attached by vacuum to a floating workpiece carrier flexible elastomeric membrane 576 having external vacuum grooves 614, 618 that is rotationally driven by an annular-wall device 602. A vertical rotatable hollow drive shaft 596 is supported by bearings (not shown) that are supported by a stationary-positioned rotatable carrier housing (not shown) where the rotatable carrier housing is adjustable in a vertical direction and is held stationary in a vertical position by an abrading machine frame (not shown). Rotational torque is supplied by the drive shaft 596 to an attached drive hub 590 that has an attached rotational drive device 598 that rotates the annular-wall device 602. Torque is transmitted from the annular-wall device 602 to an attached flexible wire-spoke outer annular band device 608 that is attached to a flexible thin metal annular membrane support ring device 606 that is attached to the workpiece carrier vacuum-grooved membrane 576. The transmitted torque rotates both the flexible membrane 576 and the workpiece 612 that is attached to the flexible membrane 576. The flexible wire-spoke outer annular 608 is flexible vertically but has a controlled stiffness radially.

The workpiece carrier flexible elastomeric membrane 576 that has a nominally-horizontal integral outer annular band 608 also has a nominally-vertical annular wall 578 that has a nominally-horizontal annular portion 584 that can have an annular indentation 586. The upper membrane wall annular portion 584 is attached to the hub annular extension 589 of the drive hub 590 where a sealed pressure chamber 588 is formed by the membrane 576, the annular wall 578, the hub annular extension 589 and the drive hub 590. Pressurized fluid or vacuum 592 can be applied to the sealed pressure chamber 588 via the hollow drive shaft 596 create an abrading pressure 600 that is transmitted to the workpiece 612 through the thickness of the flexible membrane 576.

The flexible membrane 576 has a circular inner zone portion 616 and an integral wire-spoke outer annular band 608 annular portion 610 where the attached laterally-rigid semiconductor wafer workpiece 612 is firmly attached with vacuum to the flexible membrane 576 circular inner zone portion 616 which radially-rigidizes the circular inner zone portion 616 of the membrane 576. Vacuum 594 is supplied through the hollow drive shaft 596 and through fluid passageways in the drive hub 590 to a flexible hollow tube 604 that is fluid-connected to grooved passageways 614, 618 in the exposed surface of the membrane 576. When a circular workpiece 612 is attached by the vacuum 594 to the membrane 576, the grooved vacuum passageways 614, 618 in the exposed surface of the membrane 576 are sealed by mutual flat-surfaced contact of the workpiece 612 and the membrane 576 circular inner zone portion 616.

Another annular non-pressurized vented chamber 580 surrounds the sealed pressure chamber 588. Pressurized fluid 594 can also be supplied to the flexible hollow tube 604 that is fluid-connected to grooved passageways 614, 618 in the exposed surface of the membrane 576 to provide fluid pressure to separate the workpiece 612 from the flexible membrane 576 upon completion of an abrading procedure. The flexible elastomeric membrane 576 flexible elastomeric integral wire-spoke outer annular band 608 annular portion 610 can flex in a vertical direction that is perpendicular to the nominally flat surface of the workpiece 612 which allows the workpiece 612 to move in a vertical direction when pressure or vacuum 592 is applied to the sealed pressure chamber 588. Flexible localized movement of the membrane 576 and its integral components, the annular wall 578, the annular portion 584 and the annular indentation 586 allow the workpiece 612 to assume flat-surfaced abrading contact with the flat surface of an abrasive coating (not shown) on a rotary flat-surfaced platen.

The thin annular membrane support ring 606 can be attached to the flexible membrane 576 by different techniques including: adhesives, mechanical attachment devices, heat-fusing the ring 606 to a thermoplastic elastomeric membrane or by molding the annular ring 606 into the body of the elastomeric membrane 576. The flexible elastomeric membrane 576 flexible elastomeric integral wire-spoke outer annular band 608 can be constructed from individual wires or the wire-spoke outer annular band 608 can be constructed as a radially-stiff diaphragm using: fibers, filaments, strings, wires, cables, woven mats, non-woven fabric, polymers, and laminated materials. The outer annular band 608 is flexible in a direction that is nominally-perpendicular to the flexible membrane 576 nominally-flat bottom surface and is nominally-stiff in directions parallel to the flexible membrane 576 nominally-flat bottom surface.

The annular membrane support ring 606 can be constructed from materials comprising: metals, spring steel, polymers, fiber or wire reinforced polymers, inorganic materials, organic materials and composite woven fiber impregnated polymers. The reinforcing fiber materials comprise: metals, carbon fibers, inorganic materials and organic materials. The annular membrane support ring 606 is very flexible in a vertical direction that is perpendicular to the plane of the annular membrane support ring 606 but is very rigid in a radial horizontal direction that is parallel to the plane of the support ring 606.

The flexible elastomer membrane 576 vacuum grooves 614, 618 located on the exposed surface 617 of the elastomer membrane 576 are shallow in depth and narrow in width where the depth of the grooves 614, 618 range from 0.005 to 0.100 inches with a preferred depth of 0.030 inches. The width of the vacuum grooves 614, 618 range from 0.005 to 0.100 inches with a preferred width of 0.030 inches. Because the vacuum grooves 614, 618 are protected from exposure from abrading debris by the wafer workpiece 612 that covers the whole network pattern of the vacuum grooves 614, 618. Any debris that resides within the confines of the vacuum grooves 614, 618 can be easily removed by washing the exposed surface 617 of the elastomer membrane 576 with water or other cleansing liquids after a polished wafer workpiece 612 is removed and another wafer workpiece 612 is attached with vacuum to the elastomer membrane 576. The procedure of cleaning the exposed surface 617 of the elastomer membrane 576 is similar to the procedure of cleaning the exposed surface of the elastomer membrane of a conventional prior art pneumatic bladder type of wafer carrier (not shown).

Figure 20:
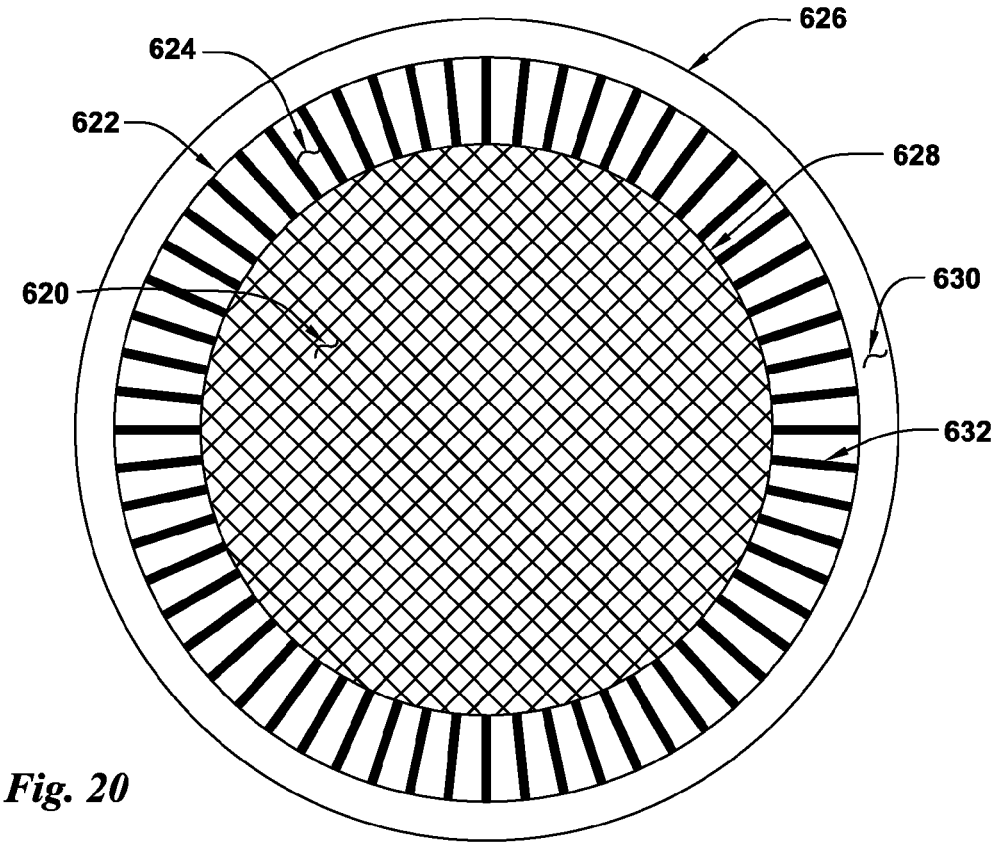
FIG. 20 is a top view of a workpiece carrier membrane with a reinforced annular ring.

FIG. 20 is a top view of a workpiece carrier vacuum-grooved membrane with a reinforced annular ring. A flexible elastomeric membrane 622 has a circular semiconductor wafer 628 attached to the central region 620 of the circular elastomeric membrane 622. The elastomeric membrane 622 also has an outer annular band 624 that is attached to an annular-wall device 630 and that is attached to an annular membrane support ring device (not shown) and that is flexible in a direction that is perpendicular to the wafer 628 flat surface but is nominally stiff in a radial direction. The radial stiffness of the integral outer annular elastomeric band 624 maintains the circular wafer 628 nominally at the center of the circular elastomeric membrane 622 as the rotating wafer 628 is subjected to abrading forces by moving abrasive (not shown) that contacts the rotating wafer 628. Vacuum attachment of the radially-rigid wafer 628 to the flexible membrane 622 rigidizes the circular inner zone portion of the membrane 622.

The elastomeric membrane 622 integral outer annular band 624 is attached at its outer periphery to a rotatable workpiece carrier drive housing 626 and radial reinforcement cables or wires 632 are attached to the elastomeric membrane 622 integral outer annular band 624. The radial reinforcement strings, cables or wire devices 632 are flexible vertically to allow flexible vertical motion of both the elastomeric membrane 622 integral outer annular band 624 in a direction that is perpendicular to the flat surface of the elastomeric membrane 622 but provide added radial stiffness to the elastomeric membrane 622 integral outer annular band 624.

The radial reinforcement strings, cables or wire devices 632 comprise threads, monofilament strands, braided strands of fibers, woven matrices, woven cloths, and laminated layers. The reinforcing materials comprise: polymers, inorganic or organic materials and metals. The radial reinforcement devices 632 typically can be constructed of small-diameter stretch-resistant filaments to provide axial rigidity to the strands but also provide flexibility perpendicular to the axis of the individual fibers or strands of fibers. In addition, thin layers of metal with narrow radial spokes that project from a narrow annular band can be used to provide substantial radial stiffness but allow vertical flexibility to the elastomeric membrane 622 integral outer annular band 624. Reinforcement types of continuous filaments or threads can be woven or formed into radial loops or other geometric patterns to provide direction-controlled radial and circumferential or tangential rigidity to the reinforcement devices 632. Adhesives are typically used to attach the radial reinforcement devices 632 to the elastomeric membrane 622 integral outer annular band 624.

Figure 21:
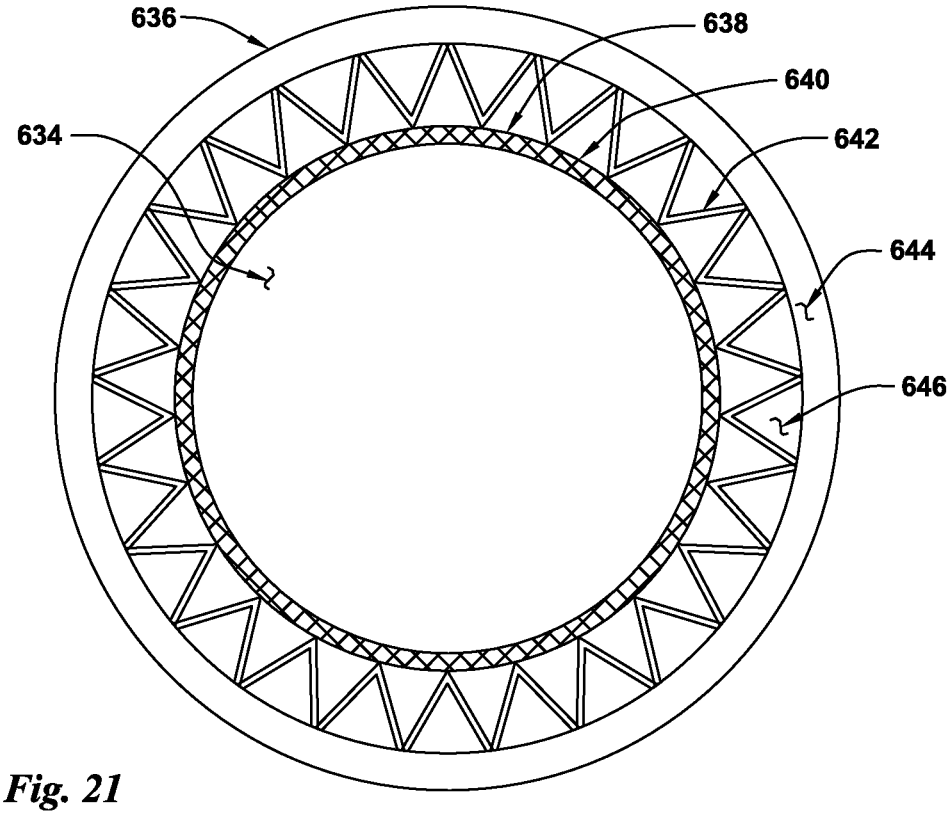
FIG. 21 is a top view of an elastomeric membrane with a reinforced outer annular band.

FIG. 21 is a top view of an elastomeric membrane with an angled-spoke reinforced outer annular band. A workpiece carrier 636 has a vacuum-grooved flexible elastomer membrane 640 that has an attached annular membrane 640 flexible support ring 638 and that has an outer annular band 646 that is attached to a rotatable annular housing 644. A wafer or workpiece 634 is vacuum attached to the vacuum-grooved flexible elastomer membrane 640 where the rotatable housing 644 rotates the outer annular band 646 that rotates the elastomer membrane 640 and rotates the vacuum-attached wafer or workpiece 634. A pattern of spokes of reinforcing thread, wire, fiber or cable 642 provide radial and circumferential or tangential reinforcement of the outer annular band 646 to transmit rotational torque from the rotatable housing 644 to the flexible elastomer membrane 640 attached flexible support ring 638 and to maintain the wafer or workpiece 634 at the geometric center of the rotatable annular housing 644 when the wafer or workpiece 634 is subjected to abrading forces that are parallel to the abraded surfaces of the wafer or workpiece 634.

The thin annular membrane support ring 638 can be restrained by the use of wires or spokes 642 that protrude out radially from the elastomer membrane 640 device and are attached to a torsional drive housing 644 that is attached to the rotatable wafer carrier head 636. The radial spokes 642 can be formed into patterns where the spokes 642 are angled to each other to provide torsional rigidity for the vacuum-grooved membrane 640 and the attached wafer 634. Radial slack can be provided along the individual lengths of the spokes 642 to allow the wafer 634 to freely move up and down vertically from the abrasive (not shown) surface to compensate for wafer 634 thickness abrading wear. When the wafer 634 translates a controlled incremental distance laterally in a horizontal direction due to abrading forces that are applied laterally to the wafer 634, the slack in the incoming abrasive surface "upstream" location spokes disappears and these upstream spokes become rigid under applied abrading force tension and restrain the wafer 634 from moving "downstream" as the wafer 634 is rotated. At the same time, the slack in the "downstream" spokes 642 increases. Because the slack in the downstream spokes 642 is maintained as the wafer 634 rotates, the wafer 634 can move freely up and down vertically to compensate for changes in the wafer 634 thickness as material is abrasively removed from the abraded surface of the wafer 634.

Figure 22:
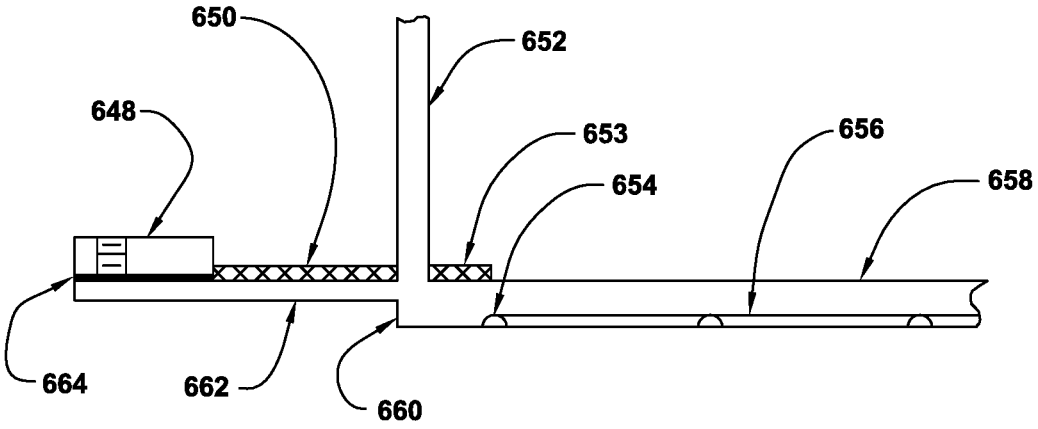
FIG. 22 is a cross section view of an elastomeric membrane with a reinforced outer band.

FIG. 22 is a cross section view of an elastomeric membrane with a reinforced outer band. A flexible circular membrane 660 has a top surface 658, recessed radial vacuum grooves 656 and circumferential vacuum grooves 654 that are used to attach a wafer (not shown) with vacuum to the flexible membrane 660. The flexible membrane 660 has an outer vertical annular wall 652 and an outer annular band 662 that has an attached or outer annular band 662 annular reinforcement device 650. The outer annular band 662 is shown here attached to an annular ring 648 that can be attached to a rotatable annular housing (not shown) with fasteners (not shown) and where the outer annular band 662 can be attached to the annular rotary drive ring 648 with an adhesive 664 or with the use of mechanical fasteners. The flexible elastomer membrane 660 has an attached flexible support ring 653 that is also attached to the outer annular band 662 annular reinforcement device 650 that is attached to the annular rotary drive ring 648.

Figure 23:
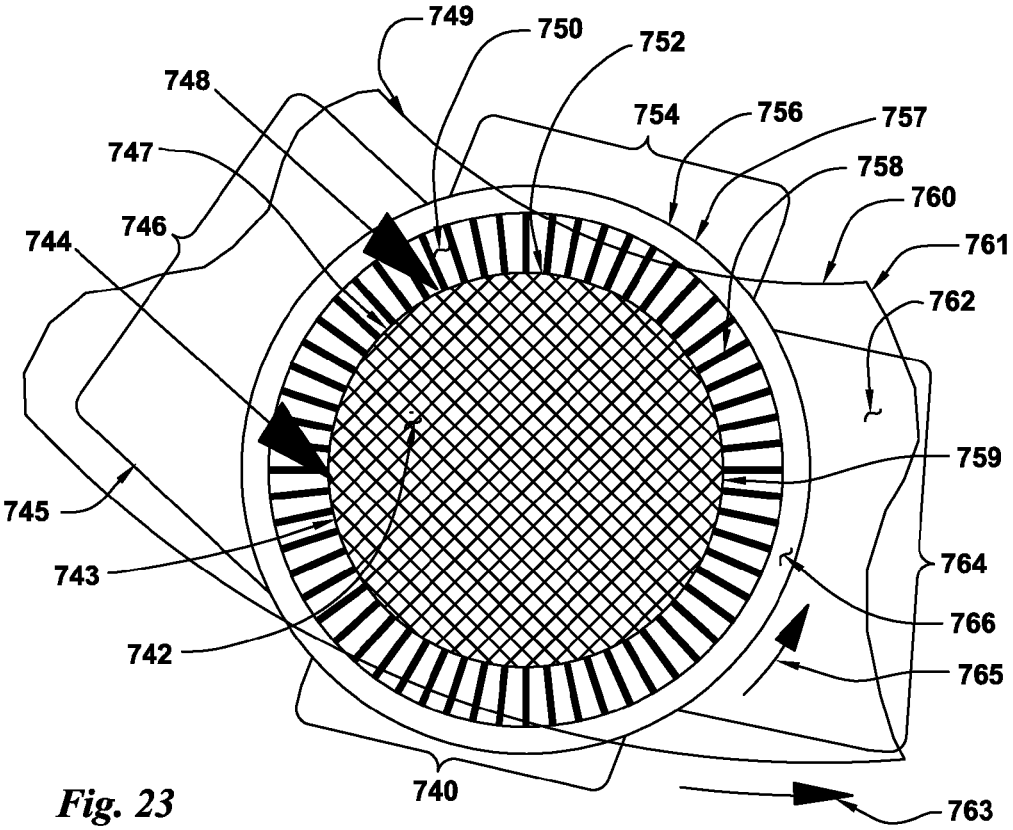
FIG. 23 is a top view of a workpiece carrier membrane abrading forces on an annular ring.

FIG. 23 is a top view of a vacuum-grooved membrane workpiece carrier and an abrasive coated platen and abrading forces on a polished wafer and on a membrane outer annular ring. A vacuum-grooved membrane workpiece carrier 757 has a flat-surfaced workpiece 752 that is attached with vacuum to a vacuum-grooved membrane 743 having an attached flexible support ring (not shown) that is part of the workpiece carrier 757 that is rotationally driven. An abrasive disk 760 that has an annular band of abrasive 762 having an inner abrasive periphery 749 is attached to a rotating platen 761. The workpiece 752 overhangs both the inner 749 and outer radii 745 of the annular band 762 of fixed abrasive to provide uniform wear-down of both the annular band 762 of fixed abrasive and the abraded surface of the workpiece 752.

The workpiece 752 is rotated in a rotation direction 765 that is the same as the platen 761 rotation direction 763 and the workpiece 752 and the platen 761 are typically rotated at approximately at the same rpm rotation speeds as the workpiece 752 is in flat-surfaced abrading contact with the annular band of abrasive 762 to provide uniform wear-down of both the annular band 762 of fixed abrasive and the abraded surface of the workpiece 752. The moving abrasive 762 applies abrading forces 744, 748 on the shown upstream side 747 of the workpiece 752 as the platen 761 is rotated.

The flexible elastomeric membrane 743 has the circular semiconductor wafer 752 attached to the central region 742 of the circular elastomeric membrane 743. The elastomeric membrane 743 also has an integral outer annular elastomer band 750 that is attached to an annular-wall device 766 and that is flexible in a direction that is perpendicular to the wafer 752 flat surface but is nominally stiff in a radial direction. The radial stiffness of the integral outer annular elastomeric band 750 maintains the circular wafer 752 nominally at the center of the circular elastomeric membrane 743 and the center of the annular-wall device 766 as the rotating wafer 752 is subjected to abrading forces 744, 748 by the moving abrasive 762. The moving abrasive 762 contacts the upstream side 747 of the rotating wafer 752 and also contacts the full flat abraded surface of the wafer 752. Vacuum attachment of the radially-rigid wafer 752 to the flexible membrane 743 rigidizes the circular inner zone portion of the membrane 743.

The elastomeric membrane 743 integral outer annular band 750 is attached at its outer periphery to a rotatable workpiece carrier 757 drive housing 756 and radial reinforcement device comprising cables or wires 758 is attached to the elastomeric membrane 743 integral outer annular band 750. The radial reinforcement strings, cables or wire devices 758 are flexible vertically to allow flexible vertical motion of both the elastomeric membrane 743 integral outer annular band 750 in a direction that is perpendicular to the flat surface of the elastomeric membrane 743 but provide added radial stiffness to the elastomeric membrane 743 integral outer annular band 750. The radial reinforcement strings, cables or wire devices 758 are attached to the elastomeric membrane 743 with adhesives or solvents, by impregnation or by thermal bonding or melting of the elastomer.

During an abrading procedure the abrading forces 744, 748 act upon the upstream side 747 of the wafer 752 which are counteracted by tension forces in the radial reinforcement strings, cables or wire devices 758 which occurs in the zone 746. On the downstream side 759 of the wafer 752 in zone 764, the radial reinforcement strings, cables or wire devices 758 tend to be in compression but these flexible radial reinforcement strings, cables or wire devices are typically weak in compression and develop slack so they contribute very little support in keeping the wafer 752 centered in the middle of the elastomeric membrane 743 or the annular-wall device 766. There is substantially little radial forces in the radial reinforcement strings, cables or wire devices 758 due to the applied abrading forces 744, 748 in the zones 740 and 754 because the zones 740 and 754 are approximately perpendicular to the applied abrading forces 744, 748.

Figure 24:
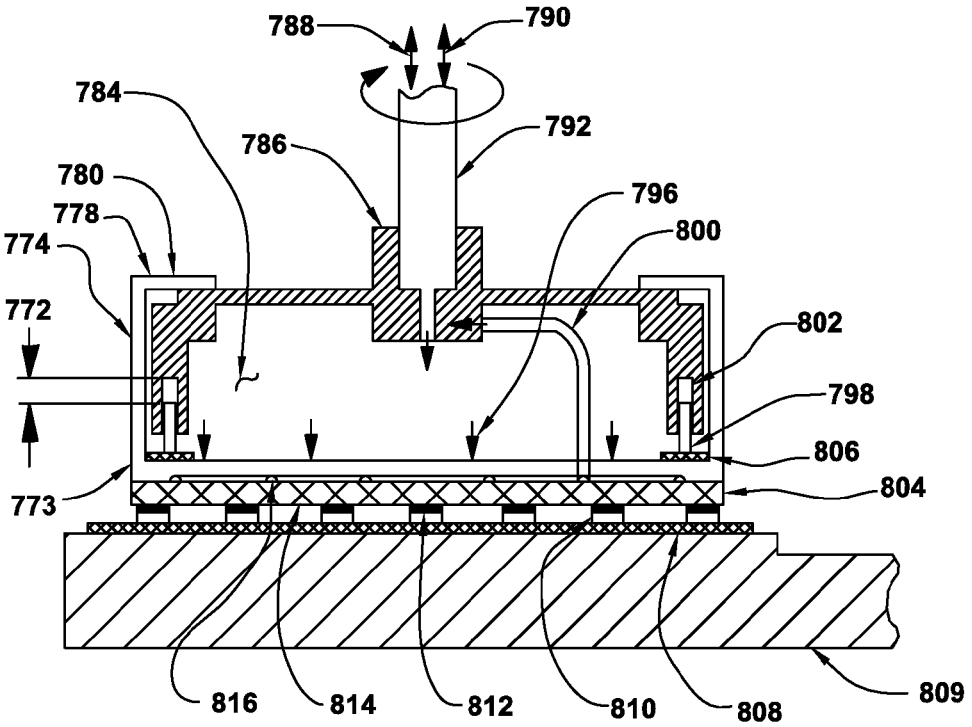
FIG. 24 is a cross section view of a pin-driven membrane support ring and abrasive disk.

FIG. 24 is a cross section view of a vacuum-groove membrane carrier membrane support ring having attached drive pins with a wafer workpiece in abrading contact with a raised-island abrasive disk that is attached to a precision-flat surfaced rotatable platen. A workpiece carrier head 778 having an attached drive hub 786 shown at a stationary position and it has a flat-surfaced workpiece 804 that is attached by vacuum to a floating workpiece carrier flexible elastomeric membrane 773 that is rotationally driven by a drive hub 786. A vertical rotatable hollow drive shaft 792 is supported by bearings (not shown) that are supported by a stationary-positioned rotatable carrier housing (not shown) where the rotatable carrier housing is adjustable in a vertical direction and is held stationary in a vertical position by an abrading machine frame (not shown).

Rotational torque is supplied by the drive shaft 792 to an attached drive hub 786 that rotates the one or multiple mechanically-coupled membrane drive pins 798 that are attached to a membrane flexible annular support ring 806 that is attached to the flexible elastomeric membrane 773. Multiple membrane drive pins 798 are typically attached around the circumference of the membrane flexible annular support ring 806 where one or more of the membrane drive pins 798 are engaged by corresponding respective drive pin holes 802 that are located around the circumference of the attached drive hub 786.

The membrane drive pins 798 have drive pin 798 shaft outside diameters that are slightly less than the inside diameters of the drive pin holes 802 to allow a slight tilting of the individual membrane drive pins 798 which allows the localized flexing of the membrane flexible annular support ring 848 at the location of each individual drive pin 798. The localized flexing of the membrane flexible annular support ring 848 at the individual drive pins 798 allows the flexible annular support ring 848 to flex locally at each pin 798 location whereby the workpiece carrier flexible elastomeric membrane 773 can flex and the attached flat-surfaced workpiece 804 can flex to provide uniform abrading contact of the abraded surface 814 of the wafer 804 with the abrasive 812 coated raised islands 810 or with other types of abrasive coating on the rotating platen 809.

The membrane drive pins 798 move freely in a vertical direction along the length of the drive pin holes 802 to allow the attached workpiece 804 to move vertically as the horizontal moving abrasive islands 810 remove material from the workpiece 804. The workpiece 804 is required to move vertically downward to maintain controlled abrading pressure on the workpiece 804 abraded surface 814. A low friction bearing (not shown) can be placed in the drive pin holes 802 to provide low friction sliding contact of the membrane drive pins 798 with the drive pin holes 802.

The workpiece carrier flexible elastomeric membrane 773 has a nominally-vertical elastomeric annular wall 774 that has a nominally-horizontal annular portion 780 that is attached to the attached drive hub 786. The upper membrane wall annular portion 780 is attached to the drive hub 786 where a sealed pressure chamber 784 is formed by the membrane 773, the annular wall 774 and the drive hub 786. Pressurized fluid 788 can be applied to the sealed pressure chamber 784 via the hollow drive shaft 792 create an abrading pressure 796 that is transmitted to the workpiece 804 through the thickness of the flexible membrane 773.

The flexible membrane 773 has a circular inner zone portion where the attached laterally-rigid semiconductor wafer workpiece 804 is firmly attached with vacuum to the flexible membrane 773 circular inner zone portion which rigidizes the circular inner zone portion of the membrane 773. Vacuum 790 is supplied through the hollow drive shaft 792 and through fluid passageways in the drive hub 786 to a flexible hollow tube 800 that is fluid-connected to grooved passageways 816 in the exposed bottom surface of the membrane 773. When a circular workpiece 804 is attached by vacuum 790 to the membrane 773, the grooved vacuum passageways 816 in the exposed surface of the membrane 773 are sealed by mutual flat-surfaced contact of the workpiece 804 and the membrane 773 circular inner zone portion.

The flexible elastomeric membrane 773 nominally-horizontal upper membrane annular portion 780 can flex in a vertical direction that is perpendicular to the nominally flat surface of the workpiece 804 which allows the workpiece 804 to move in a vertical direction when pressure or vacuum 788 is applied to the sealed pressure chamber 784. Flexible localized movement of the membrane 773 and its integral components, the annular wall 774 and the upper membrane annular portion 780 allow the workpiece 804 to assume flat-surfaced abrading contact with the flat annular surface of the fixed-abrasive disk 808 that is attached to the rotary flat-surfaced platen 809.

The fixed-abrasive disk 808 that is attached to the rigid rotary flat-surfaced platen 809 has raised island structures 810 that are top-coated with fixed abrasive 812. The abraded surface 814 of the workpiece or wafer 804 is in flat-surfaced abrading contact with the precision-flat annular band of abrasive 812 coated raised islands 810. The fixed-abrasive disk 808 is rigid through the thickness of the abrasive disk 808 from the top surface of the fixed-abrasive 812 to the bottom attachment surface of the abrasive disk 808 that is in conformal flat-surfaced contact with the rigid platen 809. Here, the full abraded surface 814 of the wafer 804 contacts the rigid fixed-abrasive 812 coating on the rigid-thickness abrasive disk 808 that is supported by the rigid platen 809. As both the wafer 804 and the vacuum-grooved membrane 773 are flexible in a direction that is perpendicular to the abraded surface 814 of the wafer 804, the abraded surface 814 of the wafer 804 assumes flat conformal contact with the rigid fixed-abrasive 812 surface when abrading pressure 796 is present in the sealed abrading chamber 784.

When an abrading or wafer 804 polishing procedure is begun, the hollow drive shaft 792 and the attached drive hub 786 are lowered vertically where the non-rotating wafer 804 abraded surface 814 is in flat-surfaced contact with the non-rotating annular band of abrasive 812 coated raised islands 810. This vertical alignment of the workpiece carrier head 778, the hollow drive shaft 792 and the attached drive hub 786 with the fixed-abrasive 812 coating on the rigid platen 809 is relatively easy to make because the thickness of the wafer 804 is known or can be measured. The distance between the attached drive hub 786 and the platen 809 abrading surface 812 can be measured by a distance-measuring device (not shown) that is attached to the lapping or polishing machine frame (not shown).

Because very little material is removed (approximately 0.8 microns or 0.03 mils or 0.03 thousandths of an inch) from the full abraded surface 814 of the wafer 804 during a wafer 804 polishing procedure or from the abrasively lapped surface 814 of the workpiece 804 during a workpiece 804 flat-lapping procedure, the plane of the flexible elastomeric membrane 773 nominally remains in a horizontal position throughout the full abrading procedure. The abrading forces that are applied to the rotating wafer 804 by the moving abrasive 812 are resisted by the restraint provided by the flexible annular support ring 806 attached to the elastomeric membrane 773 that is restrained by the individual drive pins 798 that are restrained by the drive pin holes 802 that are an integral part of the rotating rigid attached drive hub 786.

Figure 25:
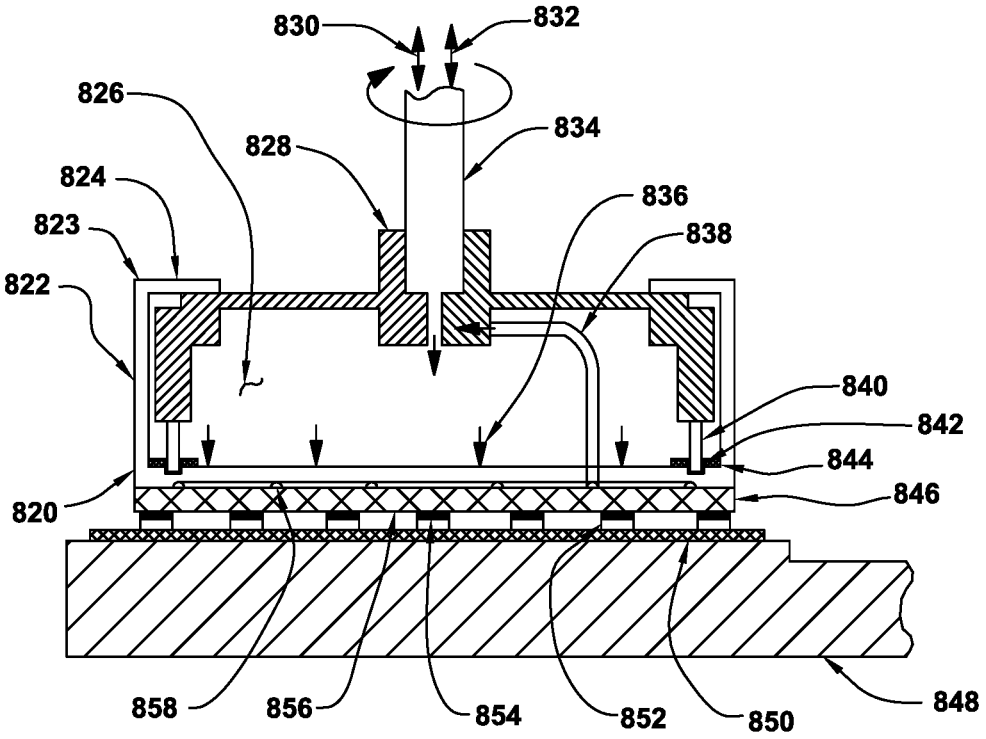
FIG. 25 is a cross section view of a carrier pin driven elastomer membrane support ring.

FIG. 25 is a cross section view of a vacuum-groove elastomer membrane carrier with a pin-driven membrane support ring having a wafer workpiece in abrading contact with a raised-island abrasive disk that is attached to a precision-flat surfaced rotatable platen. A workpiece carrier head 823 having an attached drive hub 828 shown at a stationary position has a flat-surfaced workpiece 846 that is attached by vacuum to a floating workpiece carrier flexible elastomeric membrane 820 that is rotationally driven by the attached drive hub 828. A vertical rotatable hollow drive shaft 834 is supported by bearings (not shown) that are supported by a stationary-positioned rotatable carrier housing (not shown) where the rotatable carrier housing is adjustable in a vertical direction and is held stationary in a vertical position by an abrading machine frame (not shown).

Rotational torque is supplied by the drive shaft 834 to the attached drive hub 828 that rotates the mechanically-coupled membrane drive pins 840 that are attached to the drive hub 828 where the drive pins 840 are mechanically-coupled to corresponding receptacle drive pin holes 842 that are located in the membrane flexible annular support ring 844 that is attached to the flexible elastomeric membrane 820. Multiple drive hub 828 drive pins 840 are typically attached around the circumference of the drive hub 828 where one or more of the drive hub 828 drive pins 840 are engaged by corresponding flexible annular support ring 844 receptacle drive pin holes 842.

The drive hub 828 drive pins 840 have drive pin 840 diameters that are slightly less than the diameters of the flexible annular support ring 844 receptacle drive pin holes 842 to allow the localized flexing or tilting of the membrane flexible annular support ring 844 at the location of each individual flexible annular support ring 844 receptacle drive pin holes 842. This allows the flexible annular support ring 844 to flex or tilt locally at each receptacle drive pin hole 842 location. Here, the workpiece carrier flexible elastomeric membrane 820 can flex and the attached flat-surfaced workpiece 846 can flex to provide uniform abrading contact of the abraded surface 856 of the wafer 846 with the abrasive 854 coated raised islands 852 or with other types of abrasive coating on the rotating platen 848. The support ring 844 receptacle drive pin holes 842 move freely in a vertical direction along the length of the drive hub 828 drive pins 840 to allow the attached workpiece 846 to move vertically as the horizontal moving abrasive islands 852 remove material from the workpiece 846. The workpiece 846 is required to move vertically downward to maintain controlled uniform abrading pressure on the workpiece 846 abraded surface 856.

The workpiece carrier flexible elastomeric membrane 820 has a nominally-vertical annular wall 822 that has a nominally-horizontal annular portion 824 that is attached to the attached drive hub 828. The upper membrane wall annular portion 824 is attached to the drive hub 828 where a sealed pressure chamber 826 is formed by the membrane 820, the annular wall 822 and the drive hub 828. Pressurized fluid or vacuum 830 can be applied to the sealed pressure chamber 826 via the hollow drive shaft 834 create an abrading pressure 836 that is transmitted to the workpiece 846 through the thickness of the flexible membrane 820.

The flexible membrane 820 has a circular inner zone portion where the attached laterally-rigid semiconductor wafer workpiece 846 is firmly attached with vacuum to the flexible membrane 820 circular inner zone portion which rigidizes the circular inner zone portion of the membrane 820. Vacuum 832 is supplied through the hollow drive shaft 834 and through fluid passageways in the drive hub 828 to a flexible hollow tube 838 that is fluid-connected to grooved passageways 858 in the exposed surface of the membrane 820. When a circular workpiece 846 is attached by the vacuum 832 to the membrane 820, the grooved vacuum passageways 858 in the exposed surface of the membrane 820 are sealed by mutual flat-surfaced contact of the workpiece 846 and the membrane 820 circular inner zone portion.

The flexible elastomeric membrane 820 nominally-horizontal upper membrane annular portion 824 can flex in a vertical direction that is perpendicular to the nominally flat surface of the workpiece 846 which allows the workpiece 846 to move in a vertical direction when pressure or vacuum 830 is applied to the sealed pressure chamber 826. Flexible localized movement of the membrane 820 and its integral components, the annular wall 822 and the upper membrane annular portion 824 allow the workpiece 846 to assume flat-surfaced abrading contact with the flat annular surface of the fixed-abrasive disk 850 that is attached to the rotary flat-surfaced platen 848.

The fixed-abrasive disk 850 that is attached to the rigid rotary flat-surfaced platen 848 has raised island structures 852 that are top-coated with fixed abrasive 854. The abraded surface 856 of the workpiece or wafer 846 is in flat-surfaced abrading contact with the precision-flat annular band of abrasive 854 coated raised islands 852. The fixed-abrasive disk 850 is rigid through the thickness of the abrasive disk 850 from the top surface of the fixed-abrasive 854 to the bottom attachment surface of the abrasive disk 850 that is in conformal flat-surfaced contact with the rigid platen 848. Here, the full abraded surface 856 of the wafer 846 contacts the rigid fixed-abrasive 854 coating on the rigid-thickness abrasive disk 850 that is supported by the rigid platen 848. As both the wafer 846 and the vacuum-grooved membrane 820 are flexible in a direction that is perpendicular to the abraded surface 856 of the wafer 846, the abraded surface 856 of the wafer 846 assumes flat conformal contact with the rigid fixed-abrasive 854 surface when abrading pressure 836 is present in the sealed abrading chamber 826.

When a workpiece or wafer 846 polishing procedure is begun, the hollow drive shaft 834 and the attached drive hub 828 are lowered vertically whereby the non-rotating wafer 846 abraded surface 856 assumes flat-surfaced contact with the non-rotating annular band of abrasive 854 coated raised islands 852. This vertical alignment of the workpiece carrier head 823, the hollow drive shaft 834 and the attached drive hub 828 with the fixed-abrasive 854 coating on the rigid platen 848 is relatively easy to make because the thickness of the wafer 846 is known or can be measured. The distance between the attached drive hub 828 and the platen 848 abrading surface 854 can be measured by a distance-measuring device (not shown) that is attached to the lapping or polishing machine frame (not shown).

Figure 26:
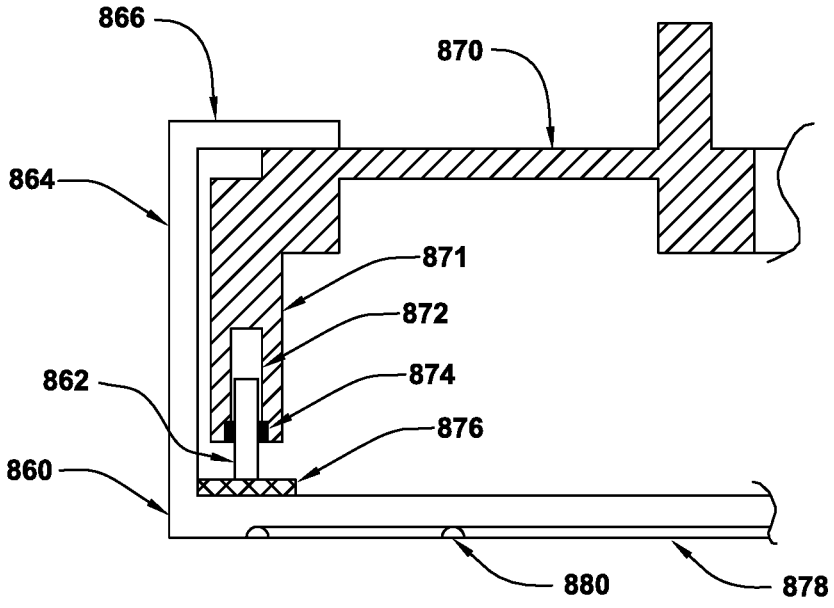
FIG. 26 is a cross section view of a pin-driven membrane support ring with a pin bearing.

FIG. 26 is a cross section view of a pin-driven membrane support ring with a pin bearing. A rotatable drive hub 870 has an annular wall 871 that has one or multiple pin holes 872 located around the circumference of the annular wall 871. Each pin hole 872 is mechanically coupled with a corresponding drive pin 862 that is attached to a flexible membrane annular drive ring 876 that is attached to a flexible elastomeric membrane 860 having a wafer (not shown) mounting surface 878 that has vacuum grooves 880. The elastomer grooved membrane 860 has an integral vertical annular elastomeric wall 864 and an integral elastomeric horizontal annular portion 866 that is attached at its inner diameter to the rotatable drive hub 870.

The flexible elastomeric membrane 860 wafer mounting surface 878 is movable vertically where the elastomeric horizontal annular portion 866 flexes in a vertical direction and where the membrane annular drive ring 876 and the attached drive pins 862 are also movable vertically. When the drive pins 862 move vertically they slide in a corresponding low friction bearings 874 that are attached to the rotatable drive hub 870 annular wall 871 within the pin holes 872. The drive pins 862 can be attached to the flexible membrane annular drive ring 876 that is typically constructed from 0.005 to 0.020 inch thick high-strength spring steel by various techniques comprising: welding, spot welding, TIG (tungsten inert gas) welding, brazing, silver soldering, friction welding and swaging.

The drive pins 862 are preferably constructed from high strength steel, stainless steel or other metal materials and have diameters that range from 0.005 to 0.25 inches with a preferred diameter of 0.125 inches. The outer diameter of the membrane annular drive ring 876 typically is slightly less or equal to the inside diameter of the elastomer grooved membrane 860 integral vertical annular elastomeric wall 864 where some of the abrading forces applied to the elastomer grooved membrane 860 are transmitted to the annular drive ring 876 by contact of the annular drive ring 876 with the elastomer grooved membrane 860.

Figure 27:
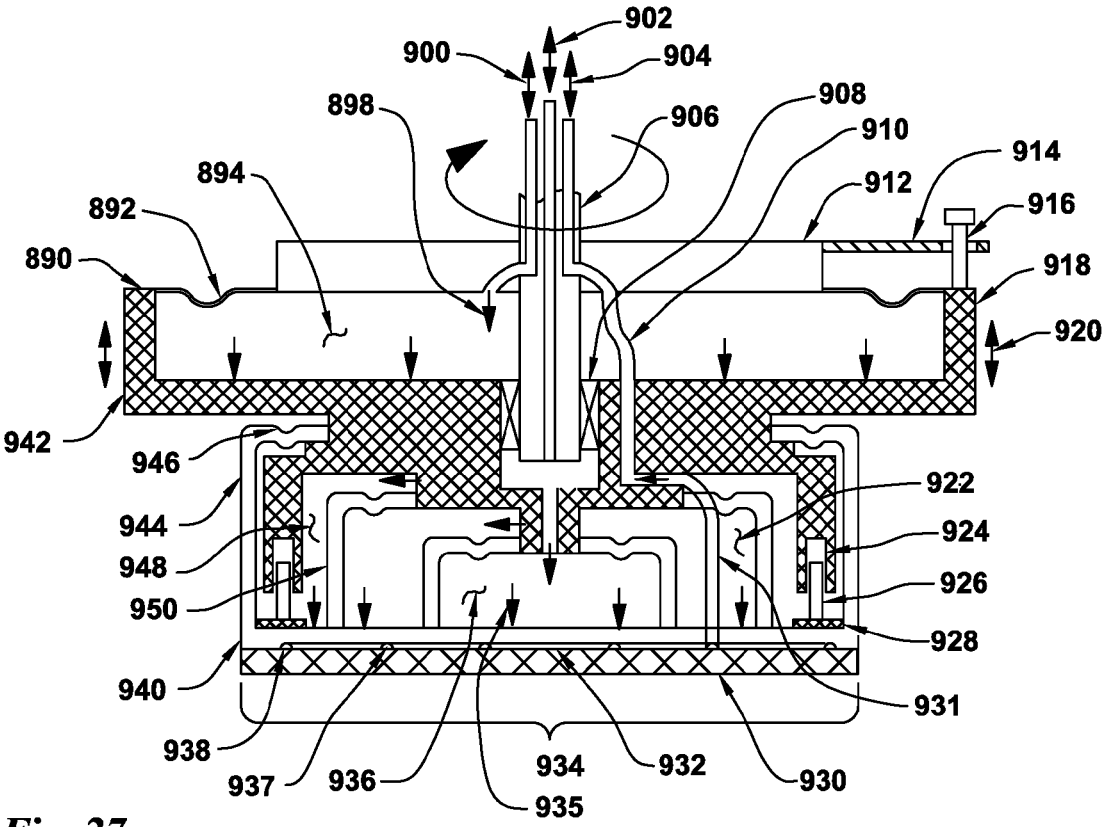
FIG. 27 is a cross section view of a pin-driven multiple-chamber workpiece carrier head.

FIG. 27 is a cross section view of a pin-driven multiple-chamber workpiece carrier head having a flexible thin metal annular membrane support ring device. A workpiece carrier head 890 has a flat-surfaced workpiece 930 that is attached to a slidable workpiece carrier rotor housing 942 having an attached flexible membrane 940 where the rotor housing 942 is rotationally driven by a drive-pin device 916. The rotor housing 942 is supported by slidable shaft bearings 908 that are attached to a hollow drive shaft 906 where the carrier housing 942 can be raised and lowered in a vertical direction 920 by sliding in the bearings 908 along the hollow drive shaft 906. A flexible membrane 940 flexible support ring 928 is attached to the membrane 940.

A rigid drive hub 912 that is attached to the hollow drive shaft 906 has an attached rotational drive arm 914 where rotation of the hollow drive shaft 906 rotates the rotational drive arm 914. The slidable drive-pin device 916 is attached to the rotor housing 942 and rotation of the drive arm 914 that is in sliding contact with the drive-pin device 916 causes the rotor housing 942 to rotate. An annular flexible diaphragm device 892 that is attached to the rigid drive hub 912 and to the rotor housing 942 forms a sealed pressure chamber 894 and the flexible diaphragm device 892 allows the slidable workpiece carrier rotor housing 942 to be translated vertically 920 along the rotational axis of the rotatable hollow drive shaft 906.

Fluid pressure or vacuum 900 can be supplied to fluid passageways in the rotatable hollow drive shaft 906 to create a pressure or vacuum 898 in the sealed pressure chamber 894 where the pressure 898 moves the carrier rotor housing 942 vertically downward and where vacuum 898 moves the carrier rotor housing 942 vertically upward.

The workpiece carrier head 942 has a flat-surfaced workpiece 930 that is attached by vacuum to a floating workpiece carrier flexible elastomeric membrane 940 that is rotationally driven by the rotor housing 942. The vertical rotatable hollow drive shaft 906 is supported by bearings (not shown) that are supported by a stationary-positioned rotatable carrier housing (not shown) where the rotatable carrier housing is adjustable in a vertical direction and is held stationary in a vertical position by an abrading machine frame (not shown). Rotational torque is supplied by the drive shaft 906 to rotate the rotor housing 942. Torque is transmitted from the rotor housing 942 having drive holes 924 that are slide-coupled to drive pins 926 that are attached to a flexible membrane annular ring 928 that is attached to the flexible membrane 940 where the transmitted torque rotates both the flexible membrane 940 and the workpiece 930 that is attached to the flexible membrane 940.

The workpiece carrier flexible elastomeric membrane 940 has a nominally-vertical annular wall 944 that has a nominally-horizontal annular portion 946 that can have an annular indentation. The upper membrane wall annular portion 946 is attached to the rotor housing 942 where a sealed pressure chamber 948 is formed by the membrane 940, the annular wall 944, the annular portion 946 and the membrane 940 annular wall 950. Pressurized fluid or vacuum 902 can be applied to the sealed pressure chamber 948 via the hollow drive shaft 906 to create an abrading pressure 935 that can be transmitted uniformly across the full abraded surface of the workpiece 930 through the bottom thickness of the flexible membrane 940. Or individual abrading pressures can be provided in the other of the individual multiple abrading pressure chambers 922 and 936 that are adjacent to each other and to the pressure chamber 948.

The flexible membrane 940 has a circular inner zone portion 934 where the attached laterally-rigid semiconductor wafer workpiece 930 is firmly attached with vacuum to the flexible membrane 940 circular inner zone portion 934 which rigidizes the circular inner zone portion 934 of the membrane 940. Vacuum 904 is supplied through the hollow drive shaft 906 and through flexible fluid passageways 910 to a flexible hollow tube 931 that is fluid-connected to grooved passageways 937, 938 in the exposed bottom surface 932 of the membrane 940. When a circular workpiece 930 is attached by the vacuum 904 to the membrane 940, the grooved vacuum passageways 937, 938 in the exposed bottom surface 932 of the membrane 940 are sealed by mutual flat-surfaced contact of the workpiece 930 and the membrane 940 circular inner zone portion 934.

Pressurized fluid 904 can also be supplied to the flexible hollow tube 931 that is fluid-connected to grooved passageways 932, 938 in the exposed bottom surface 932 of the membrane 940 to provide fluid pressure to separate the flat contact suction-adhesive bonded workpiece 930 from the flexible membrane 940 upon completion of an abrading procedure. The flexible elastomeric membrane 940 flexible elastomeric integral outer annular wall 944 annular portion 946 can flex in a vertical direction that is perpendicular to the nominally flat surface of the workpiece 930 which allows the workpiece 930 to move in a vertical direction when pressure or vacuum 902 is applied to the sealed pressure chambers 922, 936 and 948. Flexible localized movement of the membrane 940 and its integral components, the annular walls 944 and 950 and the annular portion 946 allow the vertcial-floating but laterally-restrained workpiece 930 to assume conformal flat-surfaced abrading contact with the flat surface of an abrasive coating (not shown) on a rotary flat-surfaced platen (not shown).

The abrading machine floating workpiece substrate carrier apparatus and processes to use it are described here. An abrasive polishing wafer carrier apparatus comprising:

a) a movable carrier housing attached to a rotatable shaft having a rotatable shaft axis of rotation;

b) a flexible membrane attached to the movable carrier housing, the flexible membrane having a top surface, a nominally-circular and nominally-flat bottom surface, a flexible membrane thickness, and a rotation center nominally-concentric with the movable carrier housing rotatable axis of rotation, wherein the flexible membrane nominally-flat bottom surface has recessed vacuum grooves;

c) a vacuum source fluid-coupled to the flexible membrane recessed vacuum grooves; and d) a pressure source fluid-coupled to a sealed pressure chamber formed by the flexible membrane and the movable carrier housing;

e) a flexible membrane flexible annular support ring attached to the flexible membrane wherein the flexible annular support ring having an annular width and a flexible support ring thickness is positioned within the sealed pressure chamber.

In addition, the flexible annular support ring is flexible in a direction that is nominally-perpendicular to the flexible membrane nominally-flat bottom surface and is nominally-stiff in directions parallel to the flexible membrane nominally-flat bottom surface and wherein the flexible annular support ring is nominally-concentric with the movable carrier housing rotatable shaft axis of rotation.

Further, a circular wafer having opposed nominally-flat top and bottom surfaces is positioned such that the circular wafer nominally-flat top surface is in flat-surfaced conformal contact with the flexible membrane nominally-flat bottom surface, wherein the flexible membrane recessed vacuum grooves are sealed by the circular wafer and wherein vacuum present in the flexible membrane recessed vacuum grooves attaches the circular wafer to the flexible membrane nominally-flat bottom surface.

Also, the flexible annular support ring is mechanically coupled with the movable carrier housing wherein rotation of the movable carrier housing rotates the flexible annular support ring and the attached flexible membrane and wherein the movable carrier housing restrains the flexible annular support ring to be nominally-concentric with the movable carrier housing rotatable shaft axis of rotation and wherein the flexible annular support ring and the attached flexible membrane are movable relative to the movable carrier housing in a direction along the movable carrier housing rotatable shaft axis of rotation.

In addition, the movable carrier housing has at least one attached drive pin and wherein the flexible annular support ring has at least one drive pin receptacle hole wherein the at least one movable carrier housing drive pin engages with the respective at least one flexible annular support drive pin receptacle hole to mechanically couple the flexible annular support ring with the movable carrier housing wherein the at least one movable carrier housing attached drive pin is slidable within the respective at least one flexible annular support ring drive pin receptacle hole.

Also, the flexible annular support ring has at least one attached drive pin and wherein the movable carrier housing has at least one drive pin receptacle hole wherein the at least one flexible annular support ring drive pin engages with the respective at least one movable carrier housing drive pin receptacle hole to mechanically couple the flexible annular support ring with the movable carrier housing wherein the at least one flexible annular support ring attached drive pin is slidable within the respective at least one movable carrier housing drive pin receptacle hole.

In another embodiment, the flexible membrane has an outer annular portion that is flexible in a direction that is nominally-perpendicular to the flexible membrane nominally-flat bottom surface and is nominally-stiff in directions parallel to the flexible membrane nominally-flat bottom surface. And also, the flexible membrane outer annular portion has sufficient radial stiffness to maintain the center of the circular wafer that is vacuum-attached to the flexible membrane at a position nominally-concentric with the movable carrier housing rotatable shaft axis of rotation when the rotating abraded circular wafer is subjected to abrading forces.

In a further embodiment, the flexible membrane outer annular portion is reinforced with reinforcing materials comprises reinforcing materials selected from the group consisting of: fibers, filaments, strings, wires, cables, woven mats, non-woven fabric, polymers, and laminated materials wherein the reinforced flexible membrane outer annular portion is flexible in a direction that is nominally-perpendicular to the flexible membrane nominally-flat bottom surface and is nominally-stiff in directions parallel to the flexible membrane nominally-flat bottom surface.

In another embodiment, the flexible membrane outer annular portion transmits rotational torque from the movable carrier housing to the flexible membrane and wherein the flexible membrane transmits the rotational torque to the circular wafer that is vacuum-attached to the flexible membrane. And, the flexible membrane comprises flexible materials selected from the group consisting of: elastomers, silicone rubber, room temperature vulcanizing silicone rubber, natural rubber, synthetic rubber, thermoset polyurethane, thermoplastic polyurethane, flexible polymers, composite materials, polymer-impregnated woven cloths, sealed fiber materials, impervious flexible materials, and flexible metals.

Also, the flexible annular support ring can be constructed from materials comprising materials selected from the group consisting of: metals, spring steel, polymers, fiber or wire reinforced polymers, inorganic materials, organic materials and composite woven fiber impregnated polymers. And the flexible annular support ring can be attached to the flexible membrane by techniques and materials comprising techniques and materials selected from the group consisting of: adhesives, mechanical attachment devices, heat-fusing and molding the annular ring into the body of the flexible membrane. Further, the abrasive polishing wafer carrier apparatus can have multiple sealed pressure chambers formed by portions of the flexible membrane and the movable carrier housing.

In another embodiment, the abrasive polishing wafer carrier apparatus having an attached flexible diaphragm has a sealed flexible-diaphragm pressure chamber formed by the wafer carrier apparatus flexible annular diaphragm and the movable carrier housing wherein fluid pressure supplied to the flexible-diaphragm pressure chamber will move the movable carrier housing vertically downward along the movable carrier housing rotatable shaft axis of rotation and wherein vacuum supplied to the flexible-diaphragm pressure chamber will move the movable carrier housing vertically upward along the movable carrier housing rotatable shaft axis of rotation.

And a process for using the apparatus to polish the circular wafer or a workpiece is described comprising:

a) attaching the circular wafer or a workpiece with vacuum to the vacuum-grooved flexible membrane nominally-concentric with the flexible membrane bottom surface;

b) moving the movable carrier housing so that the circular wafer or the workpiece nominally-flat bottom surface is positioned in flat-surfaced abrading contact with a rotatable abrading platen surface flat abrasive coating;

c) supplying fluid pressure to the sealed pressure chamber formed by the flexible membrane and the movable carrier housing so that the fluid pressure is transmitted through the flexible membrane thickness to apply a controlled abrading pressure uniformly across the full abraded bottom surface of the circular wafer or the workpiece;

d) and wherein both the rotatable abrading platen having the flat abrading surface and the flexible membrane having the attached circular wafer or the workpiece are rotated to polish the circular wafer or the workpiece.

Another process for using the apparatus is where fluid pressure is applied to the flexible membrane bottom surface recessed vacuum grooves upon completion of a circular wafer abrading procedure to separate the circular wafer or the workpiece from the flexible membrane bottom surface. A further process is where the abrasive on the rotatable platen flat abrading surface is provided by a liquid slurry comprising: abrasive particles, a liquid, and abrasive-process enhancing chemicals.

A further process is where the abrasive on the rotatable platen flat abrading surface is provided by a flexible flat-surfaced fixed-abrasive disk that is conformably attached to the platen flat abrading surface and optionally, wherein the flexible abrasive disk can have an annular band of fixed-abrasive coated raised islands and wherein coolant water or coolant water containing abrasive-process enhancing chemicals is applied to cool the circular wafer or the workpiece during the abrading process.

Also, a process for using the apparatus is where vacuum applied to the sealed flexible-diaphragm pressure chamber moves the movable carrier housing vertically upward along the movable carrier housing rotatable shaft axis of rotation and wherein fluid pressure applied to the sealed flexible-diaphragm pressure chamber moves the movable carrier housing vertically downward along the movable carrier housing rotatable shaft axis of rotation.

An additional process is where the apparatus is used to polish the circular wafer or a workpiece comprising:

a) attaching the circular wafer or a workpiece with vacuum to the vacuum-grooved flexible membrane nominally-concentric with the flexible membrane bottom surface;

b) moving the movable carrier housing so that the circular wafer or the workpiece nominally-flat bottom surface is positioned in flat-surfaced abrading contact with a fixed-abrasive coated section of web backing material that is supported by a stationary flat-surfaced abrading plate;

c) supplying fluid pressure to the sealed pressure chamber formed by the flexible membrane and the movable carrier housing so that the fluid pressure is transmitted through the flexible membrane thickness to apply a controlled abrading pressure uniformly across the full abraded bottom surface of the circular wafer or the workpiece;

d) and wherein the flexible membrane having the attached circular wafer or the workpiece is rotated to polish the abraded surface of the circular wafer or the workpiece.

Also, the apparatus is used where the flexible annular support ring has non-annular shapes comprising shapes selected from the group consisting of: circular, oval, triangular, square, rectangular, star, diamond, pentagon, octagon, hexagon and polygon shapes and optionally wherein these non-circular shapes have at least one circular or non-circular open area.

What is claimed:

1. An abrasive polishing wafer carrier apparatus comprising:

a) a movable carrier housing attached to a rotatable shaft having a rotatable shaft axis of rotation;

b) a flexible membrane attached to the movable carrier housing, the flexible membrane having a top surface, a nominally-circular and nominally-flat bottom surface, a flexible membrane thickness, and a rotation center nominally-concentric with the movable carrier housing rotatable axis of rotation, wherein the flexible membrane nominally-flat bottom surface has recessed vacuum grooves therein;

c) a vacuum source fluid-coupled to the flexible membrane recessed vacuum grooves; and d) a pressure source fluid-coupled to a sealed pressure chamber formed by the flexible membrane and the movable carrier housing; and e) a flexible membrane flexible annular support ring attached to the flexible membrane wherein the flexible annular support ring has an annular width and a flexible support ring thickness that is positioned within the sealed pressure chamber.

2. The apparatus of claim 1 wherein the flexible annular support ring is flexible in a direction that is nominally-perpendicular to the flexible membrane nominally-flat bottom surface and is nominally-stiff in directions parallel to the flexible membrane nominally-flat bottom surface and wherein the flexible annular support ring is nominally-concentric with the movable carrier housing rotatable shaft axis of rotation.

3. The apparatus of claim 1 wherein a circular wafer having opposed nominally-flat top and bottom surfaces is positioned such that the circular wafer nominally-flat top surface is in flat-surfaced conformal contact with the flexible membrane nominally-flat bottom surface, wherein the flexible membrane recessed vacuum grooves are sealed by the circular wafer and wherein vacuum present in the flexible membrane recessed vacuum grooves attaches the circular wafer to the flexible membrane nominally-flat bottom surface.

4. The apparatus of claim 1 wherein the flexible annular support ring is mechanically coupled with the movable carrier housing wherein rotation of the movable carrier housing rotates the flexible annular support ring and the attached flexible membrane and wherein the movable carrier housing restrains the flexible annular support ring to be nominally-concentric with the movable carrier housing rotatable shaft axis of rotation and wherein the flexible annular support ring and the attached flexible membrane are movable relative to the movable carrier housing in a direction along the movable carrier housing rotatable shaft axis of rotation.

5. The apparatus of claim 4 wherein the movable carrier housing has at least one attached drive pin and wherein the flexible annular support ring has at least one drive pin receptacle hole wherein the at least one movable carrier housing drive pin engages with the respective at least one flexible annular support drive pin receptacle hole to mechanically couple the flexible annular support ring with the movable carrier housing wherein the at least one movable carrier housing attached drive pin is slidable within the respective at least one flexible annular support ring drive pin receptacle hole.

6. The apparatus of claim 4 wherein the flexible annular support ring has at least one attached drive pin and wherein the movable carrier housing has at least one drive pin receptacle hole wherein the at least one flexible annular support ring drive pin engages with the respective at least one movable carrier housing drive pin receptacle hole to mechanically couple the flexible annular support ring with the movable carrier housing, wherein the at least one flexible annular support ring attached drive pin is slidable within the respective at least one movable carrier housing drive pin receptacle hole.

7. The apparatus of claim 3 wherein the flexible membrane has an outer annular portion that is flexible in a direction that is nominally-perpendicular to the flexible membrane nominally-flat bottom surface and is nominally-stiff in directions parallel to the flexible membrane nominally-flat bottom surface.

8. The apparatus of claim 7 wherein the flexible membrane outer annular portion has sufficient radial stiffness to maintain the center of the circular wafer that is vacuum-attached to the flexible membrane at a position nominally-concentric with the movable carrier housing rotatable shaft axis of rotation when the rotating abraded circular wafer is subjected to abrading forces.

9. The apparatus of claim 7 wherein the flexible membrane outer annular portion is reinforced with reinforcing materials selected from the group consisting of: fibers, filaments, strings, wires, cables, woven mats, non-woven fabric, polymers, and laminated materials wherein the reinforced flexible membrane outer annular portion is flexible in a direction that is nominally-perpendicular to the flexible membrane nominally-flat bottom surface and is nominally-stiff in directions parallel to the flexible membrane nominally-flat bottom surface.

10. The apparatus of claim 7 wherein the flexible membrane outer annular portion transmits rotational torque from the movable carrier housing to the flexible membrane and wherein the flexible membrane transmits the rotational torque to the circular wafer that is vacuum-attached to the flexible membrane.

11. The apparatus of claim 1 wherein the flexible membrane comprises flexible materials selected from the group consisting of: elastomers, silicone rubber, room temperature vulcanizing silicone rubber, natural rubber, synthetic rubber, thermoset polyurethane, thermoplastic polyurethane, flexible polymers, composite materials, polymer-impregnated woven cloths, sealed fiber materials, impervious flexible materials, and flexible metals.

12. The apparatus of claim 1 wherein the flexible annular support ring is constructed from materials selected from the group consisting of: metals, spring steel, polymers, fiber or wire reinforced polymers, inorganic materials, organic materials and composite woven fiber impregnated polymers.

13. The apparatus of claim 1 wherein the flexible annular support ring is attached to the flexible membrane by techniques and materials selected from the group consisting of: adhesives, mechanical attachment devices, heat-fusing and molding the annular ring into the body of the flexible membrane.

14. The apparatus of claim 1 wherein the abrasive polishing wafer carrier apparatus has multiple sealed pressure chambers formed by portions of the flexible membrane and the movable carrier housing.

15. The apparatus of claim 1 wherein the abrasive polishing wafer carrier apparatus having an attached flexible diaphragm has a sealed flexible-diaphragm pressure chamber formed by the wafer carrier apparatus flexible annular diaphragm and the movable carrier housing wherein fluid pressure supplied to the flexible-diaphragm pressure chamber will move the movable carrier housing vertically downward along the movable carrier housing rotatable shaft axis of rotation and wherein vacuum supplied to the flexible-diaphragm pressure chamber will move the movable carrier housing vertically upward along the movable carrier housing rotatable shaft axis of rotation.

16. A process for using the apparatus of claim 3 to polish the circular wafer or a workpiece comprising:

a) attaching the circular wafer or a workpiece with vacuum to the vacuum-grooved flexible membrane nominally-concentric with the flexible membrane bottom surface;

b) moving the movable carrier housing so that the circular wafer or the workpiece nominally-flat bottom surface is positioned in flat-surfaced abrading contact with a rotatable abrading platen surface flat abrasive coating;

c) supplying fluid pressure to the sealed pressure chamber formed by the flexible membrane and the movable carrier housing so that the fluid pressure is transmitted through the flexible membrane thickness to apply a controlled abrading pressure uniformly across the full abraded bottom surface of the circular wafer or the workpiece;

d) and wherein both the rotatable abrading platen having the flat abrading surface and the flexible membrane having the attached circular wafer or the workpiece are rotated to polish the circular wafer or the workpiece.

17. A process according to claim 16 wherein fluid pressure is applied to the flexible membrane bottom surface recessed vacuum grooves upon completion of a circular wafer abrading procedure to separate the circular wafer or the workpiece from the flexible membrane bottom surface.

18. A process according to claim 16 wherein the abrasive on the rotatable platen flat abrading surface is provided by a liquid slurry comprising: abrasive particles, a liquid, and abrasive-process enhancing chemicals.

19. A process according to claim 16 wherein the abrasive on the rotatable platen flat abrading surface is provided by a flexible flat-surfaced fixed-abrasive disk that is conformably attached to the platen flat abrading surface and optionally, wherein the flexible abrasive disk has an annular band of fixed-abrasive coated raised islands and wherein coolant water or coolant water containing abrasive-process enhancing chemicals is applied to cool the circular wafer or the workpiece during the abrading process.

20. A process for using the apparatus of claim 15 wherein vacuum applied to the sealed flexible-diaphragm pressure chamber moves the movable carrier housing vertically upward along the movable carrier housing rotatable shaft axis of rotation and wherein fluid pressure applied to the sealed flexible-diaphragm pressure chamber moves the movable carrier housing vertically downward along the movable carrier housing rotatable shaft axis of rotation.

21. A process for using the apparatus of claim 3 to polish the circular wafer or a workpiece comprising:

a) attaching the circular wafer or a workpiece with vacuum to the vacuum-grooved flexible membrane nominally-concentric with the flexible membrane bottom surface;

b) moving the movable carrier housing so that the circular wafer or the workpiece nominally-flat bottom surface is positioned in flat-surfaced abrading contact with a fixed-abrasive coated section of web backing material that is supported by a stationary flat-surfaced abrading plate;

c) supplying fluid pressure to the sealed pressure chamber formed by the flexible membrane and the movable carrier housing so that the fluid pressure is transmitted through the flexible membrane thickness to apply a controlled abrading pressure uniformly across the full abraded bottom surface of the circular wafer or the workpiece;

d) and wherein the flexible membrane having the attached circular wafer or the workpiece is rotated to polish the abraded surface of the circular wafer or the workpiece.

22. The apparatus of claim 1 wherein the flexible annular support ring has non-annular shapes comprising shapes selected from the group consisting of: circular, oval, triangular, square, rectangular, star, diamond, pentagon, octagon, hexagon and polygon shapes and optionally wherein these non-circular shapes have at least one circular or non-circular open area.

* * * * *